US010152936B2

(12) United States Patent
Nakagawa et al.

(10) Patent No.: US 10,152,936 B2
(45) Date of Patent: Dec. 11, 2018

(54) CIRCUIT, DISPLAY SYSTEM, AND ELECTRONIC DEVICE

(71) Applicant: Semiconductor Energy Laboratory Co., Ltd., Kanagawa-ken (JP)

(72) Inventors: Takashi Nakagawa, Kanagawa (JP); Yoshiyuki Kurokawa, Kanagawa (JP); Seiichi Yoneda, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 15 days.

(21) Appl. No.: 15/596,264

(22) Filed: May 16, 2017

(65) Prior Publication Data

US 2017/0337888 A1 Nov. 23, 2017

(30) Foreign Application Priority Data

May 20, 2016 (JP) ..... 2016-101129

(51) Int. Cl.
*G09G 3/36* (2006.01)
*G09G 3/18* (2006.01)
(Continued)

(52) U.S. Cl.
CPC ..... *G09G 3/3648* (2013.01); *G09G 3/18* (2013.01); *G09G 3/3233* (2013.01); *G09G 3/3258* (2013.01); *G09G 3/3666* (2013.01); *G09G 3/3688* (2013.01); *G09G 2300/0861* (2013.01); *G09G 2310/0221* (2013.01); *G09G 2320/103* (2013.01); *G09G 2330/022* (2013.01)

(58) Field of Classification Search
None
See application file for complete search history.

(56) References Cited

U.S. PATENT DOCUMENTS 6,714,268 B2 3/2004 Wang et al.
7,038,641 B2 5/2006 Hirota et al.
(Continued)

FOREIGN PATENT DOCUMENTS

JP 2001-066593 A 3/2001
JP 2002-196702 A 7/2002
(Continued)

OTHER PUBLICATIONS

Shieh, H-P., "Transflective Display by Hybrid OLED and LCD," LEOS 2005 (IEEE Lasers and Electro-Optics Society Annual Meeting), Oct. 22, 2005, pp. 650-651, IEEE.
Lee, J-H. et al., "High Ambient-Contrast-Ratio Display Using Tandem Reflective Liquid Crystal Display and Organic Light-Emitting Device," Optics Express, Nov. 14, 2005, vol. 13, No. 23, pp. 9431-9438.

*Primary Examiner* — Xin Sheng
(74) *Attorney, Agent, or Firm* — Husch Blackwell LLP

(57) ABSTRACT

A novel circuit, a novel display portion, a novel display system, or the like is provided. A circuit, a display portion, a display system, or the like which has low power consumption is provided. A plurality kinds of video signals are generated by division of input data and supplied to different pixel groups. Thus, for example, the plurality of video signals can be supplied individually, and the operation states of a plurality of driver circuits can be controlled individually, leading to fine-grained operation with low power consumption. Accordingly, a decoder, a display portion, or a display system having low power consumption can be provided.

18 Claims, 26 Drawing Sheets

(51) Int. Cl.
*G09G 3/3233* (2016.01)
*G09G 3/3258* (2016.01)

(56) References Cited

U.S. PATENT DOCUMENTS

| | | | | |
|---|---|---|---|---|
| 7,084,936 | B2 | 8/2006 | Kato | |
| 7,102,704 | B2 | 9/2006 | Mitsui et al. | |
| 7,176,991 | B2 | 2/2007 | Mitsui et al. | |
| 7,239,361 | B2 | 7/2007 | Kato | |
| 7,248,235 | B2 | 7/2007 | Fujii et al. | |
| 7,385,654 | B2 | 6/2008 | Mitsui et al. | |
| 7,674,650 | B2 | 3/2010 | Akimoto et al. | |
| 2003/0201960 | A1 | 10/2003 | Fujieda | |
| 2006/0072047 | A1 | 4/2006 | Sekiguchi | |
| 2008/0111812 | A1* | 5/2008 | Shirasaki | G09G 3/3233 345/212 |
| 2008/0180618 | A1 | 7/2008 | Fujieda | |
| 2008/0307240 | A1* | 12/2008 | Dahan | G06F 1/06 713/320 |
| 2010/0171905 | A1 | 7/2010 | Huang et al. | |
| 2010/0295861 | A1* | 11/2010 | Somerville | G09G 3/3216 345/545 |
| 2012/0147067 | A1* | 6/2012 | Hashimoto | G09G 3/3413 345/690 |
| 2016/0232834 | A1* | 8/2016 | Kimura | G09G 3/3233 |
| 2017/0186364 | A1 | 6/2017 | Okamoto et al. | |
| 2017/0186365 | A1 | 6/2017 | Yoneda | |

FOREIGN PATENT DOCUMENTS

| | | | |
|---|---|---|---|
| JP | 2002-328630 | A | 11/2002 |
| JP | 2003-076302 | A | 3/2003 |
| JP | 2003-157026 | A | 5/2003 |
| JP | 2003-157029 | A | 5/2003 |
| JP | 2003-228304 | A | 8/2003 |
| JP | 2003-316295 | A | 11/2003 |
| JP | 2003-322850 | A | 11/2003 |
| JP | 2004-296162 | A | 10/2004 |
| JP | 2007-096055 | A | 4/2007 |
| JP | 2007-123861 | A | 5/2007 |
| JP | 2007-232882 | A | 9/2007 |
| JP | 4161574 | B2 | 10/2008 |
| JP | 2013-221965 | A | 10/2013 |
| WO | WO 2004/053819 | A1 | 6/2004 |

* cited by examiner

CIRCUIT, DISPLAY SYSTEM, AND ELECTRONIC DEVICE

BACKGROUND OF THE INVENTION

1. Field of the Invention

One embodiment of the present invention relates to a circuit, a display system, and an electronic device.

Note that one embodiment of the present invention is not limited to the above technical field. Examples of the technical field of one embodiment of the present invention disclosed in this specification and the like include a semiconductor device, a display device, a light-emitting device, a power storage device, a memory device, an electronic device, a lighting device, an input device, an input/output device, a driving method thereof, and a manufacturing method thereof.

In this specification and the like, a semiconductor device generally means a device that can function by utilizing semiconductor characteristics. A transistor, a semiconductor circuit, an arithmetic device, a memory device, and the like are each an embodiment of the semiconductor device. In addition, an imaging device, an electro-optical device, a power generation device (e.g., a thin film solar cell and an organic thin film solar cell), and an electronic device each may include a semiconductor device.

2. Description of the Related Art

As one of display devices, there is a liquid crystal display device provided with a liquid crystal element. For example, an active matrix liquid crystal display device, in which pixel electrodes are arranged in a matrix and transistors are used as switching elements connected to respective pixel electrodes, has attracted attention.

For example, an active matrix liquid crystal display device including transistors, in each of which metal oxide is included in a channel formation region, as switching elements connected to respective pixel electrodes has already been known (Patent Documents 1 and 2).

PATENT DOCUMENT

Reference

[Patent Document 1] Japanese Published Patent Application No. 2007-123861

[Patent Document 2] Japanese Published Patent Application No. 2007-096055

SUMMARY OF THE INVENTION

An object of one embodiment of the present invention is to provide a novel circuit, a novel display portion, a novel display system, or the like. Another object of one embodiment of the present invention is to provide a circuit, a display portion, a display system, or the like which has low power consumption. Another object of one embodiment of the present invention is to provide a circuit which can supply a video signal to the corresponding pixel group; a display portion, a display system, or the like, in which control of the operation state of a driver circuit can be performed for each of a plurality of pixel groups. Another object of one embodiment of the present invention is to provide a circuit, a display system, or the like, in which data input from the outside can be divided and a plurality of video signals can be generated.

One embodiment of the present invention does not necessarily achieve all the objects listed above and only needs to achieve at least one of the objects. The description of the above objects does not preclude the existence of other objects. Other objects will be apparent from and can be derived from the description of the specification, the drawings, the claims, and the like.

One embodiment of the present invention is a circuit including a first circuit, a second circuit, a third circuit, a fourth circuit, and a fifth circuit. The first circuit has a function of outputting a first signal corresponding to the kind of input data. The second circuit has a function of generating a first video signal in accordance with the data and the first signal. The third circuit has a function of generating a second video signal in accordance with the data and the first signal. The fourth circuit has a function of outputting the first video signal in the case where the first video signal and a third video signal output from the fourth circuit immediately before input of the first video signal to the fourth circuit do not match. The fourth circuit has a function of outputting a second signal corresponding to a result of comparison between the first video signal and the third video signal. The fifth circuit has a function of outputting the second video signal in the case where the second video signal and a fourth video signal output froth the fifth circuit immediately before input of the second video signal to the fifth circuit do not match. The fifth circuit has a function of outputting a third signal corresponding to a result of comparison between the second video signal and the fourth video signal. The first video signal and the second video signal are different kinds of video signals.

In the circuit of one embodiment of the present invention, the first video signal may be a video signal for displaying a character, and the second video signal may be a video signal for displaying a video other than a character.

Another embodiment of the present invention is a display system including the circuit and a display portion. The display portion includes a first pixel group, a second pixel group, a first driver circuit, and a second driver circuit. The first video signal is input to the first pixel group via the first driver circuit. The second video signal is input to the second pixel group via the second driver circuit.

In the display system of one embodiment of the present invention, the display portion may further include a sixth circuit and a seventh circuit, the sixth circuit may have a function of controlling power supply to the first driver circuit in accordance with the second signal, and the seventh circuit may have a function of controlling power supply to the second driver circuit in accordance with the third signal.

In the display system of one embodiment of the present invention, the first pixel group may include a first pixel, the second pixel group may include a second pixel, the first pixel may include a reflective liquid crystal element, and the second pixel may include a light-emitting element.

In the display system of one embodiment of the present invention, the first pixel and the second pixel may each include a transistor, and the transistor may include an oxide semiconductor in a channel formation region.

Another embodiment of the present invention is an electronic device including the circuit or the display system and having a function of displaying a predetermined video in accordance with the data input with a wireless signal.

According to one embodiment of the present invention, a novel circuit, a novel display portion, a novel display system, or the like can be provided. According to one embodiment of the present invention, a circuit, a display portion, a display system, or the like having low power consumption can be provided. According to one embodiment of the present invention, a circuit which can supply a video signal to the corresponding pixel group; a display portion, a display system, or the like in which control of the operation state of a driver circuit can be performed for each of a plurality of pixel groups can be provided. According to one embodiment of the present invention, a circuit, a display system, or the like in which data input from the outside can be divided and a plurality of video signals can be generated can be provided.

Note that the description of these effects does not preclude the existence of other effects. One embodiment of the present invention does not necessarily have all of these effects. Other effects will be apparent from and can be derived from the description of the specification, the drawings, the claims, and the like.

BRIEF DESCRIPTION OF THE DRAWINGS

FIGS. 17A, 17B1, and 17B2 illustrate structure examples of a display device.

DETAILED DESCRIPTION OF THE INVENTION

Figure 1:
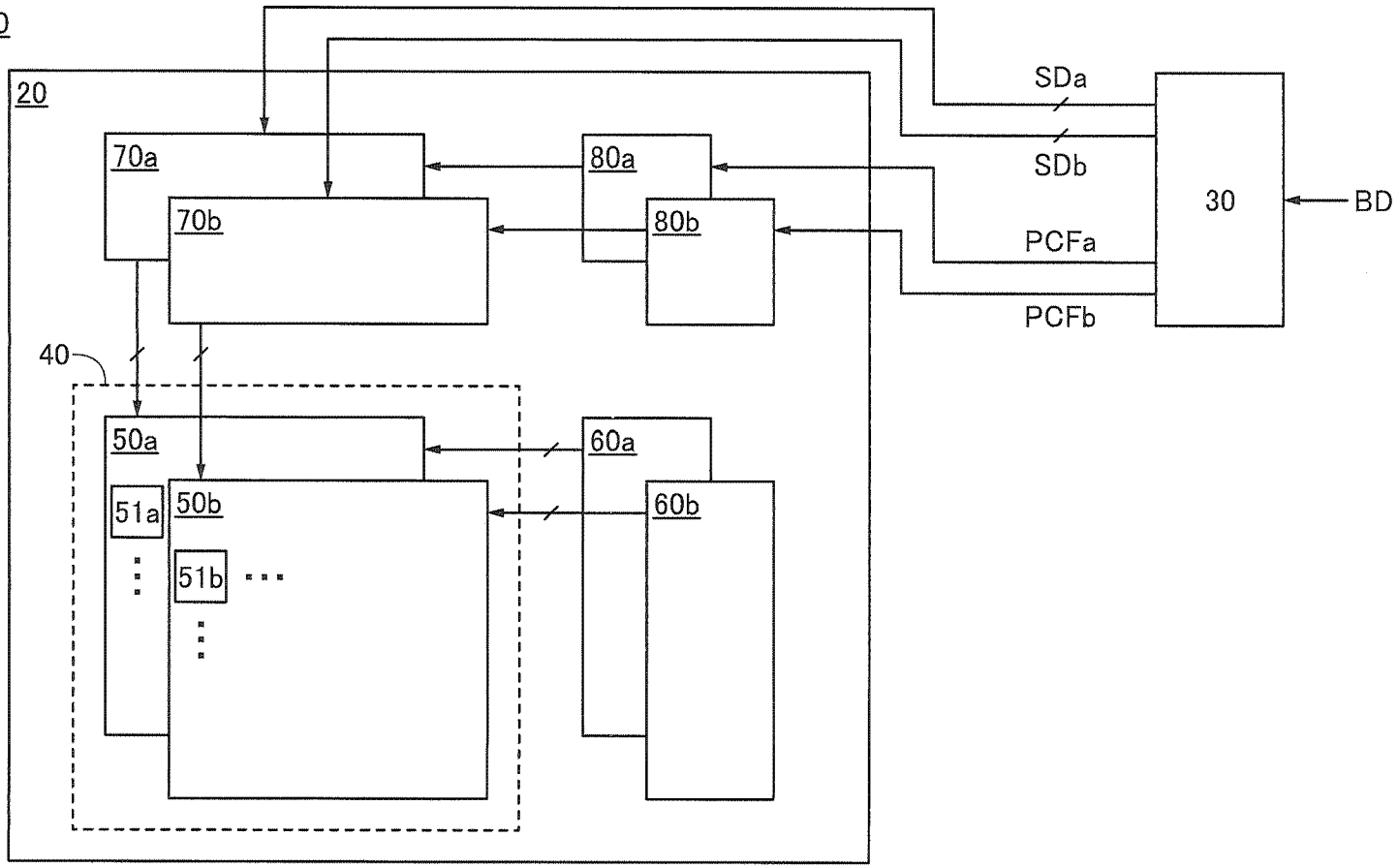
FIG. 1 illustrates a structure example of a display system.

Embodiments of the present invention will be described below in detail with reference to the accompanying drawings. Note that one embodiment of the present invention is not limited to the following description and it is easily understood by those skilled in the art that the mode and details can be variously changed without departing from the scope and spirit of the present invention. Therefore, the present invention should not be interpreted as being limited to the description of the embodiments below.

One embodiment of the present invention includes, in its category, devices such as a semiconductor device, a memory device, a display device, an imaging device, and a radio frequency (RF) tag. The display devices include, in its category, liquid crystal display devices, light-emitting devices having pixels each provided with a light-emitting element typified by an organic light-emitting element (OLED), electronic paper, digital micromirror devices (DMDs), plasma display panels (PDPs), field emission displays (FEDs), and the like.

In this specification and the like, an explicit description "X and Y are connected" means that X and Y are electrically connected, X and Y are functionally connected, and X and Y are directly connected. Accordingly, without being limited to a predetermined connection relationship, for example, a connection relationship shown in drawings or texts, another connection relationship is included in the drawings or the texts. Here, X and Y each denote an object (e.g., a device, an element, a circuit, a wiring, an electrode, a terminal, a conductive film, or a layer).

Examples of the case where X and Y are directly connected include the case where an element that allows an electrical connection between X and Y (e.g., a switch, a transistor, a capacitor, an inductor, a resistor, a diode, a display element, a light-emitting element, or a load) is not connected between X and Y, and the case where X and Y are connected without the element that allows the electrical connection between X and Y provided therebetween.

For example, in the case where X and Y are electrically connected, one or more elements that enable an electrical connection between X and Y (e.g., a switch, a transistor, a capacitor, an inductor, a resistor, a diode, a display element, a light-emitting element, or a load) can be connected between X and Y. Note that the switch is controlled to be turned on or off. That is, the switch is conducting or not conducting (is turned on or off) to determine whether current flows therethrough or not. Alternatively, the switch has a function of selecting and changing a current path. Note that the case where X and Y are electrically connected includes the case where X and Y are directly connected.

For example, in the case where X and Y are functionally connected, one or more circuits that enable a functional connection between X and Y (e.g., a logic circuit such as an inverter, a NAND circuit, or a NOR circuit; a signal converter circuit such as a D/A converter circuit, an A/D converter circuit, or a gamma correction circuit; a potential level converter circuit such as a power supply circuit (e.g., a step-up circuit or a step-down circuit) or a level shifter circuit for changing the potential level of a signal; a voltage source; a current source; a switching circuit; an amplifier circuit such as a circuit that can increase signal amplitude, the amount of current, or the like, an operational amplifier, a differential amplifier circuit, a source follower circuit, and a buffer circuit; a signal generation circuit; a memory circuit; or a control circuit) can be connected between X and Y. For example, even when another circuit is interposed between X and Y, X and Y are functionally connected if a signal output from X is transmitted to Y. Note that the case where X and Y are functionally connected includes the case where X and Y are directly connected and the case where X and Y are electrically connected.

Note that in this specification and the like, an explicit description "X and Y are electrically connected" means that X and Y are electrically connected (i.e., the case where X and Y are connected with another element or another circuit provided therebetween), X and Y are functionally connected (i.e., the case where X and Y are functionally connected with another circuit provided therebetween), and X and Y are directly connected (i.e., the case where X and Y are connected without another element or another circuit provided therebetween). That is, in this specification and the like, the explicit description "X and Y are electrically connected" is the same as the description "X and Y are connected."

In describing structures of the present invention with reference to the drawings, the same reference numerals are used in common for the same portions in different drawings in some cases.

Even when independent components are electrically connected to each other in the drawing, one component has functions of a plurality of components in some cases. For example, when part of a wiring also functions as an electrode, one conductive film functions as the wiring and the electrode. Thus, "electrical connection" in this specification includes in its category such a case where one conductive film has functions of a plurality of components.

Embodiment 1

In this embodiment, a display portion, a decoder, and a display system, each of which is one embodiment of the present invention, are described.

<Structure Example of Display System>

FIG. 1 illustrates a structure example of a display system 10. The display system 10 includes a display portion 20 and a decoder 30.

The display portion 20 includes a pixel portion 40, a plurality of driver circuits 60, a plurality of driver circuits 70, and a plurality of power control circuits 80. Here, an example in which the display portion 20 includes two driver circuits 60 (60*a* and 60*b*), two driver circuits 70 (70*a* and 70*b*), and two power control circuits 80 (80*a* and 80*b*) is described.

The pixel portion 40 has a function of displaying a video. The pixel portion 40 includes a plurality of pixel groups 50. Here, an example in which the pixel portion 40 includes two pixel groups 50 (50*a* and 50*b*) is described. The pixel group 50*a* includes a plurality of pixels 51*a*, and the pixel group 50*b* includes a plurality of pixels 51*b*.

The pixels 51*a* and 51*b* each include a display element and have a function of displaying a predetermined gray level. As an example of the display element, a liquid crystal display element, a light-emitting element, and the like can be given. The same kind of display elements or different kinds of display elements may be included in the pixels 51*a* and 51*b*. The plurality of pixels 51*a* and the plurality of pixels 51*b* display a predetermined gray level, whereby a predetermined video is displayed on the pixel portion 40.

The driver circuits 60 each have a function of supplying a signal for selecting a predetermined pixel (hereinafter, the signal is referred to as a selection signal) to the pixel group 50. Specifically, the driver circuit 60*a* has a function of supplying a selection signal to the predetermined pixel 51*a*, and the driver circuit 60*b* has a function of supplying a selection signal to the predetermined pixel 51*b*.

The driver circuits 70 each have a function of supplying a signal corresponding to a predetermined video (hereinafter, the signal is also referred to as a video signal) to the pixel group 50. Specifically, the driver circuit 70*a* has a function of supplying a video signal to the predetermined pixel 51*a*, and the driver circuit 70*b* has a function of supplying a video signal to the predetermined pixel 51*b*. When the video signal is supplied to the pixel supplied with the selection signal, the video signal is written to the pixel.

The power control circuits 80 each have a function of controlling power supply to the driver circuit 70. Specifically, the power control circuit 80*a* has a function of selecting whether power is supplied to the driver circuit 70*a* or not, and the power control circuit 80*b* has a function of selecting whether power is supplied to the driver circuit 70*b* or not. Note that the power control circuit 80*a* may have a function of controlling power supply to the driver circuit 60*a*, and the power control circuit 80*b* may have a function of controlling power supply to the driver circuit 60*b*.

Figure 2:
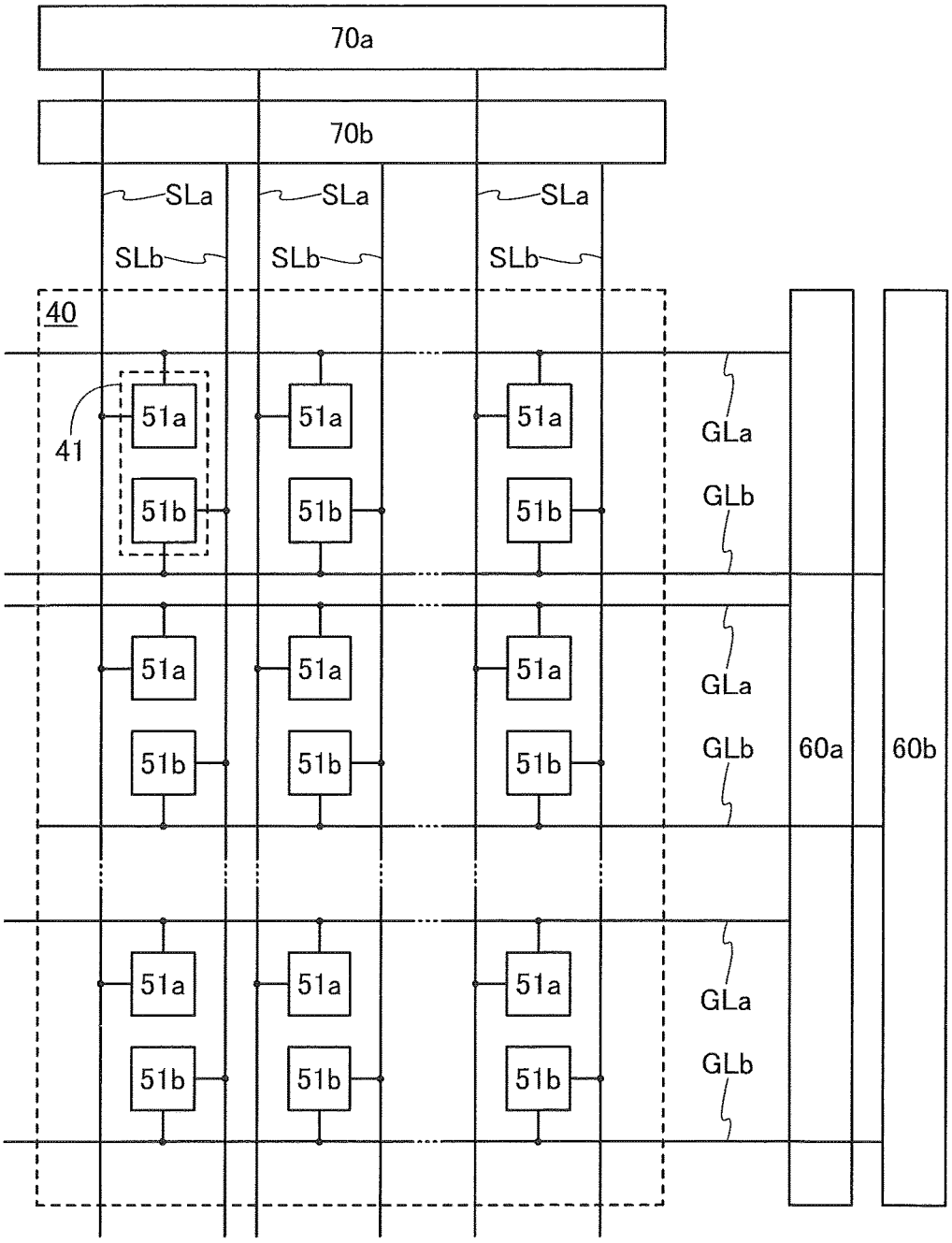
FIG. 2 illustrates a structure example of a display portion.

Here, both of the pixel 51*a* and the pixel 51*b* are provided in the pixel portion 40. FIG. 2 illustrates an example of the arrangement of the pixels 51*a* and the pixels 51*b*. In FIG. 2, the pixels 51*a* and 51*b* are alternately provided in a column direction (in the vertical direction), and a pixel unit 41 includes the pixels 51*a* and 51*b*. The selection signal is supplied from the driver circuit 60*a* to the pixel 51*a* through a wiring GLa, and a video signal is supplied from the driver circuit 70*a* to the pixel 51*a* through a wiring SLa. A selection signal is supplied from the driver circuit 60*b* to the pixel 51*b* through a wiring GLb, and a video signal is supplied from the driver circuit 70*b* to the pixel 51*b* through a wiring SLb. Note that the pixels 51*a* and 51*b* may each include a plurality of subpixels.

Figure 3A:
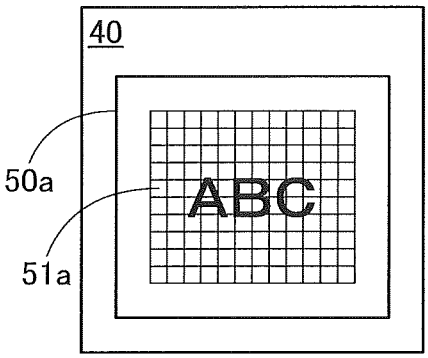
FIGS. 3A to 3C illustrate display examples on a pixel portion.
Figure 3B:
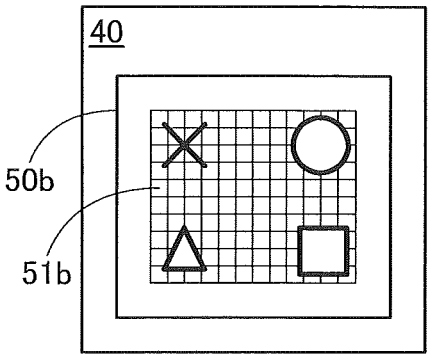
Figure 3C:
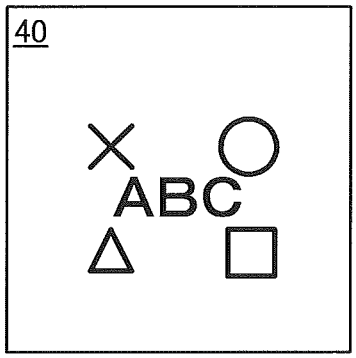

Different videos can be displayed on the pixel groups 50*a* and 50*b*. That is, two kinds of videos can be displayed on the pixel portion 40. For example, as illustrated in FIG. 3A, characters can be displayed using the plurality of pixels 51*a*, and as illustrated in FIG. 3B, figures can be displayed using the plurality of pixels 51*b*. The pixel groups 50*a* and 50*b* are provided in the same region (the pixel portion 40) in this case, and thus, as illustrated in FIG. 3C, a video in which the characters and the figures are superimposed is displayed on the pixel portion 40. As described above, in the display system 10, a video displayed on the pixel portion 40 is divided into a plurality of kinds, and the divided videos can be displayed with the different pixel groups 50.

Note that although an example in which the video displayed on the pixel portion 40 is divided into the character and the figure is illustrated in FIGS. 3A to 3C, there is no particular limitation on a method for dividing a video. For example, a video may be divided into a character and the other data or into a character, a figure, and an image. Alternatively, a video may be divided into a black-and-white image and a color image on the basis of the gray level, for example. A video may be divided into a still image and a moving image. The number of divisions of a video can be a given number of 2 or more.

The decoder 30 illustrated in FIG. 1 is a circuit that has a function of generating a video signal output to the display portion 20 in accordance with data BD input from the outside. Specifically, the decoder 30 has a function of generating data SD corresponding to a video signal supplied to the pixel 51 by decoding the data BD input as binary data.

Here, the decoder 30 of one embodiment of the present invention has a function of dividing data input from the outside and generating a plurality of video signals in accordance with the divided data. Specifically, the decoder 30 has a function of dividing the data BD into a plurality of kinds in a manner similar to that of the above video division and generating a plurality of data SD corresponding to the video signals in accordance with the divided data.

FIG. 1 illustrates a structure example in which data SDa and data SDb are generated in accordance with the data BD. In this case, for example, the decoder 30 determines whether data included in the data BD is data corresponding to a character (hereinafter, the data is referred to as character data) or data corresponding to data which is other than a character (data corresponding to a figure (hereinafter, the data is referred to as a figure data) or data corresponding to an image (hereinafter, the data is referred to as image data)), and thus can divide the data BD into the character data and the other data and generate the data SDa for displaying a character and the data SDb for displaying a video which is other than a character in accordance with the divided data. The data SDa is output to the pixel group 50*a* through the driver circuit 70*a*, and the data SDb is output to the pixel group 50*b* through the driver circuit 70*b*.

The decoder 30 of one embodiment of the present invention has a function of comparing the data SD generated by the decoder 30 with the latest data SD output from the decoder 30 to the display portion 20. Match of both the data means that there is no change in a video displayed with the pixel group 50. Mismatch of both the data means that a video displayed with the pixel group 50 needs to be changed. The decoder 30 has a function of generating a signal PCF corresponding to the comparison result. An example in which the signal PCF is set at a high level in the case where the comparison result shows "mismatch" and the signal PCF is set at a low level in the case the comparison result shows "match" is described below.

Specifically, when the data BD is input to the decoder 30, the decoder 30 generates the data SDa and SDb. The generated data SDa is compared with the latest data SDa output from the decoder 30 to the driver circuit 70*a*. In the case where the comparison result shows mismatch of both the data, the generated data SDa is output to the driver circuit 70*a*, and a signal PCFa (high level) is output to the power control circuit 80*a*. At this time, the power control circuit 80*a* supplies power to the driver circuit 70*a*. Thus, the driver circuit 70*a* is brought into an operation state, and thus the data SDa is supplied to the pixel group 50*a* through the driver circuit 70*a*. As a result, a video of a character is displayed on the pixel group 50*a*.

In contrast, in the case of match of both the data, the generated data SDa is not output to the driver circuit 70*a*. The signal PCFa (low level) is output to the power control circuit 80*a*. At this time, the power control circuit 80*a* does not supply power to the driver circuit 70*a*. Thus, the driver circuit 70*a* is in a non-operation state, a new video signal is not supplied from the driver circuit 70*a* to the pixel group 50*a*, and therefore, the video displayed with the pixel group 50*a* is not updated. In the case where there is no change in a video displayed with the pixel group 50*a* as described above, output of the data SDa from the decoder 30 to the driver circuit 70*a* and the operation of the driver circuit 70*a* can be stopped. This enables the power consumption of the display system 10 to be reduced.

Note that the pixel group 50*b*, the driver circuit 70*b*, and the power control circuit 80*b* can be operated in a manner similar to the above.

As described above, in the display system 10 of one embodiment of the present invention, the plurality of video signals are generated by division of the data BD, so that display operation can be controlled for each of the plurality of pixel groups 50 or for each of the plurality of driver circuits 70. Thus, even in the case where there is a change in a video displayed on the pixel portion 40, when there is no change in a video displayed with the specific pixel group 50, for example, the operation of the driver circuit 70 which supplies a video signal to the pixel group 50 can be stopped. Thus, a video signal can be supplied individually, and the operation state of the driver circuit 70 can be controlled individually for each of the plurality of pixel groups, leading to fine-grained operation with low power consumption.

Note that as described later, in the pixel 51, a transistor in which the channel formation region includes an oxide semiconductor (hereinafter, such a transistor is also referred to as an OS transistor) is preferably used. An oxide semiconductor has a larger energy gap than a semiconductor such as silicon and has low carrier density; therefore, the off-state current of an OS transistor is extremely small. Accordingly, when an OS transistor is used in the pixel 51, a video signal held in the pixel 51 can be retained for a long time as compared to the case where a transistor in which the channel formation region includes silicon (such a transistor is also referred to as a Si transistor) is used. Thus, even in the case where power supply to the driver circuit 70 is stopped and supply of a video signal from the driver circuit 70 to the pixel 51 is stopped for a long period, the display state of the pixel 51 can be kept accurately. The OS transistor and a pixel using the OS transistor are described in detail in Embodiments 2 to 4 and the like.

<Structure Example of Decoder>

Next, a specific structure example of the decoder 30 is described.

Figure 4:
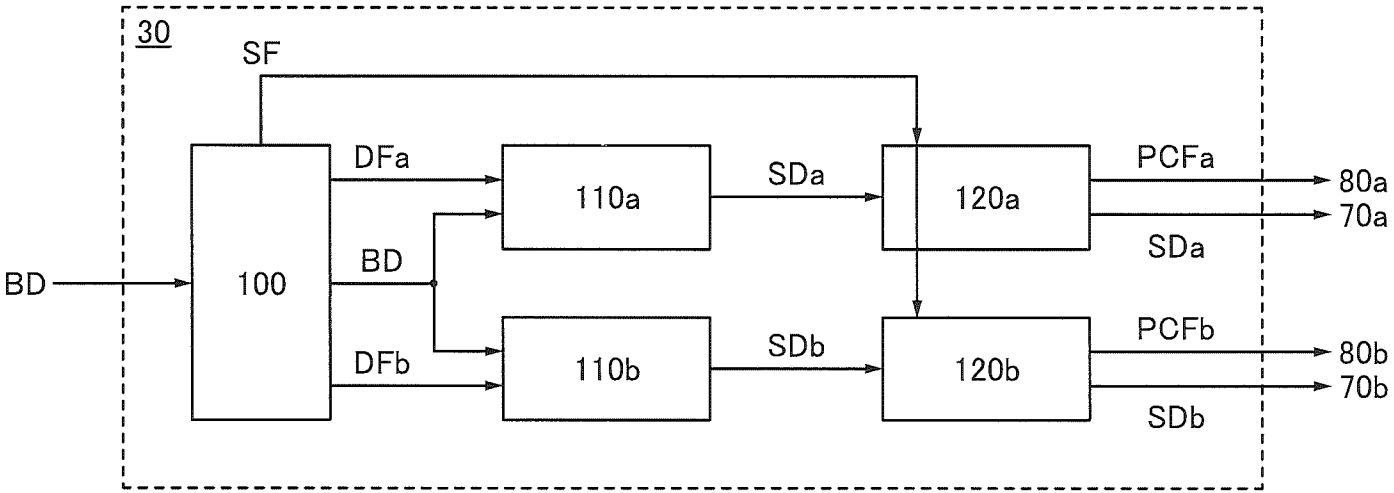
FIG. 4 illustrates a structure example of a decoder.

FIG. 4 illustrates a structure example of the decoder circuit 30. The decoder 30 includes a determination circuit 100, a plurality of signal generation circuits 110, and a plurality of difference detection circuits 120. FIG. 4 illustrates a structure example in which the decoder 30 includes two signal generation circuits 110 (110*a* and 110*b*) and two difference detection circuits 120 (120*a* and 120*b*). Here, as an example, the case in which the data BD includes the character data, the figure data, and the image data, and the decoder 30 generates the data SDa corresponding to the character data and the data SDb corresponding to the figure data or the image data is described.

The determination circuit 100 is a circuit having a function of outputting a signal corresponding to the kind of input data. Specifically, the determination circuit 100 has a function of determining whether data included in the data BD is the character data, or the figure data or the image data and outputting a signal DF corresponding to the determination result. Here, for example, in the case where data included in the data BD is the character data, a signal DFa is set at a high level and a signal DFb is set at a low level, and in the case where the data included in the data BD is the figure data or the image data, the signal DFa is set at a low level and the signal DFb is set at a high level.

When the determination circuit 100 determines that the data included in the data BD is the character data, the signal DFa (high level) is output from the determination circuit 100 to the signal generation circuit 110*a*, and the signal DFb (low level) is output from the determination circuit 100 to the signal generation circuit 110*b*. When the determination circuit 100 determines that the data included in the data BD is the figure data or the image data, the signal DFa (low level) is output from the determination circuit 100 to the signal generation circuit 110*a*, and the signal DFb (high level) is output from the determination circuit 100 to the signal generation circuit 110*b*. The data BD input to the determination circuit 100 is supplied to the signal generation circuits 110*a* and 110*b*.

The determination circuit 100 has a function of generating a signal SF. The signal SF is a signal output at a predetermined timing in accordance with the data BD. For example, the signal SF can be a signal set at a high level or a low level at a timing at which a header or a footer of the data BD is detected. The signal SF is output to the difference detection circuits 120*a* and 120*b* and used for controlling a timing of output of the data SDa and SDb.

The signal generation circuit 110 is a circuit having a function of generating a video signal in accordance with the data BD input from the determination circuit 100. The signal generation circuit 110 has a function of determining whether a video signal is generated or not in accordance with the signal DF input from the determination circuit 100.

Specifically, in the case where data included in the data BD is the character data, the high-level signal DFa is input to the signal generation circuit 110*a*. In this case, the signal generation circuit 110*a* generates the data SDa using the character data. In contrast, the low-level signal DFb is input to the signal generation circuit 110*b*. In this case, the signal generation circuit 110*b* does not generate the data SDb. The data SDa generated by the signal generation circuit 110*a* is output to the difference detection circuit 120*a*.

In the case where data included in the data BD is the figure data or the image data, the low-level signal DFa is input to the signal generation circuit 110*a*. In this case, the signal generation circuit 110*a* does not generate the data SDa. In contrast, the high-level signal DFb is input to the signal generation circuit 110*b*. In this case, the signal generation circuit 110*b* generates the data SDb using the figure data or the image data. The data SDb generated by the signal generation circuit 110*b* is output to the difference detection circuit 120*b*.

In this manner, the signal generation circuits 110*a* and 110*b* can generate different kinds of video signals in accordance with the data BD and the signal DF.

Note that in the case where the data BD is binary data, the data SDa is generated by conversion of the binary data into a text data in the signal generation circuit 110*a*. In the case where the data BD is compressed data, the data SDb is generated by decompression of the data BD in the signal generation circuit 110*b*.

The difference detection circuit 120 is a circuit having a function of comparing a video signal generated in the signal generation circuit 110 with the latest video signal output from the difference detection circuit 120 to the driver circuit 70 and determining whether both the video signals match or not. That is, the difference detection circuit 120 has a function of determining whether or not a video to be displayed using the data SD generated in the signal generation circuit 110 is the same as a video displayed with the pixel group 50. Thus, whether the video needs to be rewritten or not can be determined.

Specifically, the difference detection circuit 120*a* has a function of comparing the data SDa input from the signal generation circuit 110*a* to the difference detection circuit 120*a* with the data SDa output from the difference detection circuit 120*a* to the driver circuit 70*a* immediately before input of the data SDa to the difference detection circuit 120*a*, and determining whether the data match or not. The difference detection circuit 120*a* outputs the signal PCFa corresponding to the comparison result to the power control circuit 80*a*. The difference detection circuit 120*a* outputs the data SDa to the driver circuit 70*a* in the case where the comparison result shows that the data do not match, and stops output of the data SDa in the case where the comparison result shows that the data match.

Note that the difference detection circuit 120*b* can be operated in a manner similar to that of the difference detection circuit 120*a*.

As described above, the difference detection circuit 120 has a function of stopping output of the data SD to the driver circuit 70 in the case where the comparison result shows that the data match. Thus, the frequency of outputting a video signal from the difference detection circuit 120 to the display portion 20 can be reduced, leading to lower power consumption in the difference detection circuit 120. In the case where a video signal is not output from the difference detection circuit 120 to the display portion 20, a video displayed with the pixel group 50 is not updated.

In the case where the signal PCFa is a signal corresponding to "mismatch", power is supplied from the power control circuit 80*a* to the driver circuit 70*a*, and thus the driver circuit 70*a* is bought into an operation state. Then, the data SDa is supplied from the driver circuit 70*a* to the pixel group 50*a*. In contrast, in the case where the signal PCFa is a signal corresponding to "match", power supply from the power control circuit 80*a* to the driver circuit 70*a* is stopped, and thus the driver circuit 70*a* is in a non-operation state. At this time, a video signal is not supplied to the pixel group 50*a*, and thus a video displayed with the pixel group 50*a* is not updated. Thus, in the period during which a video is not rewritten, the operation of the driver circuit 70*a* can be stopped, leading to lower power consumption.

Note that the driver circuit 70*b* and the power control circuit 80*b* can be operated in manners similar to those of the driver circuit 70*a* and the power control circuit 80*a*.

The signal SF is input from the determination circuit 100 to the difference detection circuits 120*a* and 120*b*. In the case where the data SDa and the data SDb are output, the timing of output of these data is controlled with the signal SF. Specifically, the data SDa and the data SDb are output at the same time when the signal SF is changed to a high level or a low level. Thus, the timing at which the data SDa is output from the difference detection circuit 120*a* to the driver circuit 70*a* and the timing at which the data SDb is output from the difference detection circuit 120*b* to the driver circuit 70*b* can be synchronized.

[Structure Example of Determination Circuit]

Figure 5:
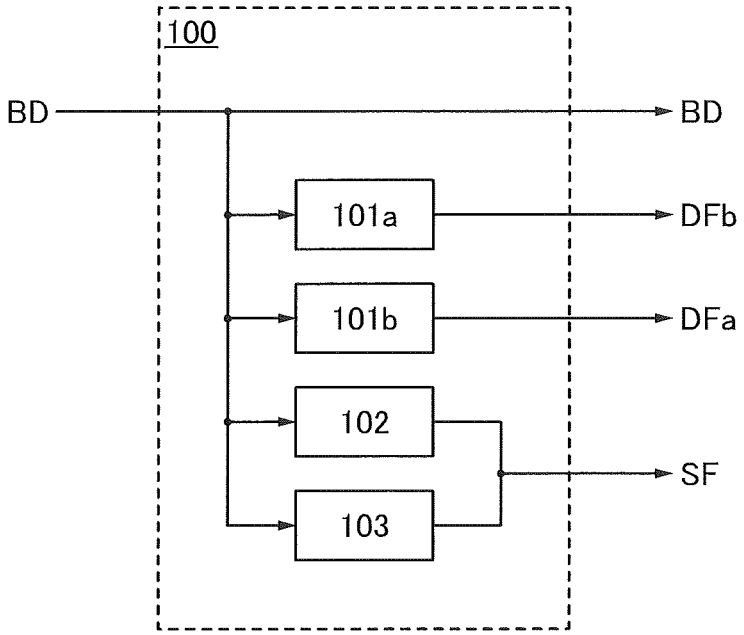
FIG. 5 illustrates a structure example of a determination circuit.

Next, a specific structure example of the determination circuit 100 is described. FIG. 5 illustrates a structure example of the determination circuit 100. The determination circuit 100 includes a plurality of data detection circuits 101, a header detection circuit 102, and a footer detection circuit 103. Here, the case where the determination circuit 100 includes two data detection circuits 101 (101*a* and 101*b*) is described.

The data BD input to the determination circuit 100 is input to the data detection circuit 101*a*, the data detection circuit 101*b*, the header detection circuit 102, and the footer detection circuit 103. Note that the data BD is also input to the plurality of signal generation circuits 110 (see FIG. 4).

The data detection circuit 101 has a function of detecting a specific kind of data included in the data BD. In the example described here, the data BD includes the character data, the figure data, and the image data, the character data is detected in the data detection circuit 101*a*, and the figure data or the image data is detected in the data detection circuit 101*b*.

The data detection circuit 101*a* has a function of detecting the character data and outputting the predetermined signal DFb. Specifically, when data describing a character and included in the data BD is input to the data detection circuit 101*a*, for example, a low-level signal is output to the signal generation circuit 110*b* as the signal DFb. At this time, generation of the data SDb in the signal generation circuit 110*b* is stopped. In contrast, when a signal input to the data detection circuit 101*a* is data describing data which is other than a character, for example, a high-level signal is output to the signal generation circuit 110*b* as the signal DFb. At this time, the data SDb is generated in the signal generation circuit 110*b*.

The data detection circuit 101*b* has a function of recognizing the figure data or the image data and outputting the predetermined signal DFa. Specifically, when data describing a figure or an image and included in the data BD is input to the data detection circuit 101*b*, for example, a low-level signal is output to the signal generation circuit 110*a* as the signal DFa. At this time, generation of the data SDa in the signal generation circuit 110*a* is stopped. In contrast, when a signal input to the data detection circuit 101*b* is data describing data which is other than a figure or an image, for example, a high-level signal is output to the signal generation circuit 110*a* as the signal DFa. At this time, the data SDa is generated in the signal generation circuit 110*a*.

The header detection circuit 102 has a function of recognizing a header and outputting the predetermined signal SF. Specifically, when data describing a header and included in the data BD is input to the header detection circuit 102, a high-level signal or a low-level signal is output as the signal SF. The footer detection circuit 103 has a function of recognizing a footer and outputting the predetermined signal SF. Specifically, when data describing a footer and included in the data BD is input to the footer detection circuit 103, a high-level signal or a low-level signal is output as the signal SF.

The signal SF generated in the header detection circuit 102 or the footer detection circuit 103 is output to the plurality of difference detection circuits 120. Each of the plurality of difference detection circuits 120 outputs the data SD to the driver circuit 70 when a high-level signal or a low-level signal is input as the signal SF. Thus, the timing of output of the data SD from the difference detection circuit 120 can be controlled.

Note that one of the header detection circuit 102 and the footer detection circuit 103 can be omitted. In this case, the signal SF is generated in accordance with one of the header and the footer included in the data BD.

With the above structure, the determination circuit 100 can generate the signal DF and the signal SF in accordance with the data BD.

[Structure Example of Signal Generation Circuit]

Figure 6A:
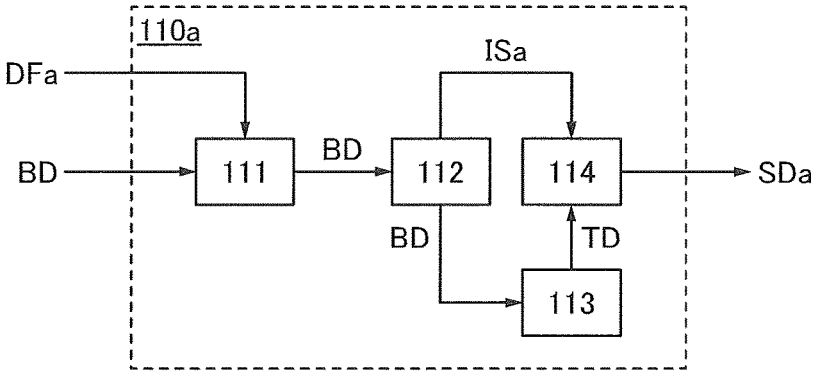
FIGS. 6A and 6B illustrate structure examples of signal generation circuits.
Figure 6B:
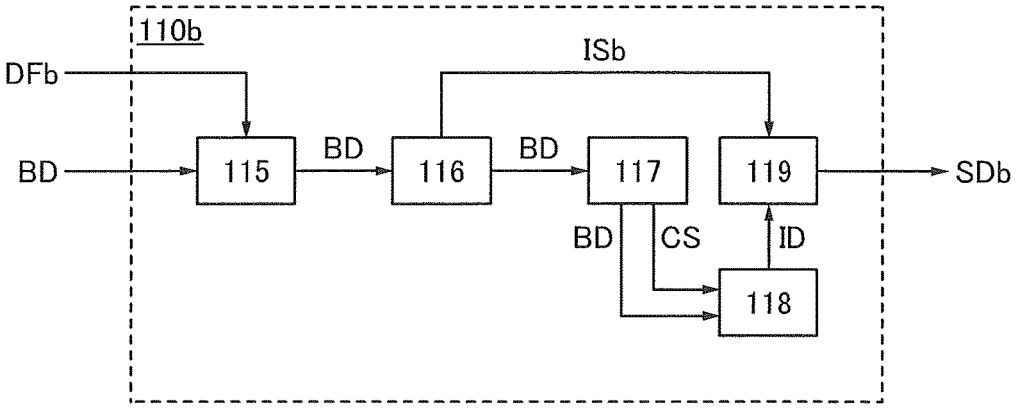

Next, specific structure examples of the signal generation circuit 110 is described. FIGS. 6A and 6B each illustrate a structure example of the signal generation circuit 110. FIG. 6A illustrates a structure example of the signal generation circuit 110*a* which generates a video signal in accordance with the character data, and FIG. 6B illustrates a structure example of the signal generation circuit 110*b* which generates a video signal in accordance with the figure data or the image data.

The signal generation circuit 110*a* illustrated in FIG. 6A includes an extraction circuit 111, a detection circuit 112, a conversion circuit 113, and a generation circuit 114.

The extraction circuit 111 has a function of extracting the character data from the data BD input from the determination circuit 100. Specifically, the extraction circuit 111 has a function of controlling whether or not the data BD is output to the detection circuit 112 in accordance with the signal DFa input from the determination circuit 100. In the case where the signal DFa indicates that the data BD is the character data, the extraction circuit 111 outputs the data BD to the detection circuit 112. In contrast, in the case where the signal DFa indicates that the data BD is data other than the character data, the extraction circuit 111 does not output the data BD to the detection circuit 112. Thus, the character data can be extracted from the data BD.

Note that the extraction circuit 111 can include a switch using a transistor, or the like. In this case, the transistor is preferably an OS transistor having low off-state current.

The detection circuit 112 has a function of detecting a variety of information from the data BD. Specifically, the detection circuit 112 has a function of detecting positional information, format information, or the like of a character from the data BD. Information detected in the detection circuit 112 is output to the generation circuit 114 as a signal Isa. Moreover, the data BD is output from the detection circuit 112 to the conversion circuit 113.

The conversion circuit 113 has a function of converting the data BD into data in a predetermined format. Specifically, the conversion circuit 113 has a function of converting the data BD input as binary data into a text data. The data converted into a text format is output to the generation circuit 114 as data TD. Note that the conversion into a text data can be performed using a memory circuit in which data for associating the binary data with the character is stored. The memory circuit can be provided inside or outside the conversion circuit 113.

The generation circuit 114 has a function of generating the data SDa corresponding to a video displayed with the pixel group 50*a* (see FIG. 1 and FIG. 3A). Specifically, the generation circuit 114 has a function of generating the data SDa for displaying a predetermined character on the pixel group 50*a* by adding, to the data Ill input from the conversion circuit 113, information (positional information, format information, or the like) included in the signal ISa input from the detection circuit 112. The generated data SDa is output to the difference detection circuit 120*a* (see FIG. 4).

The signal generation circuit 110*b* illustrated in FIG. 6B includes an extraction circuit 115, a detection circuit 116, a detection circuit 117, a conversion circuit 118, and a generation circuit 119.

The extraction circuit 115 has a function of extracting the figure data or the image data from the data BD input from the determination circuit 100. Specifically, the extraction circuit 115 has a function of controlling whether or not the data BD is output to the detection circuit 116 in accordance with the signal DFb input from the determination circuit 100. In the case where the signal DFb indicates that the data BD is the figure data or the image data, the extraction circuit 115 outputs the data BD to the detection circuit 116. In contrast, in the case where the signal DFb indicates that the data BD is data other than the figure data or the image data, the extraction circuit 115 does not output the data BD to the detection circuit 116. Thus, the figure data or the image data can be extracted from the data BD.

Note that the extraction circuit 115 can include a switch using a transistor, or the like. In this case, the transistor is preferably an OS transistor having low off-state current.

The detection circuit 116 has a function of detecting a variety of information from the data BD. Specifically, the detection circuit 116 has a function of detecting positional information or the like of an image from the data BD. Information detected in the detection circuit 116 is output to the generation circuit 119 as a signal Isb. Moreover, the data BD is output from the detection circuit 116 to the detection circuit 117.

The detection circuit 117 has a function of detecting information on the format of the data BD. Specifically, the detection circuit 117 has a function of detecting whether the data BD is compressed data or uncompressed data and detecting the compression format in the case where the data BD is compressed data. Information on compression of the data BD, which is detected in the detection circuit 117, is output to the conversion circuit 118 as a signal CS together with the data BD.

The conversion circuit 118 has a function of converting the data BD. Specifically, the conversion circuit 118 has a function of decompressing the data BD in the case where the data BD is compressed data. Whether decompression is performed in the conversion circuit 118 or not and the format of the decompression are determined in accordance with the signal CS. Note that it is possible to provide the conversion circuit 118 with a plurality of circuits having functions of performing decompression in the respective formats in order to deal with a plurality of compression formats. In this case, a circuit for performing compression is selected in accordance with the signal CS. The decompressed data is output to the generation circuit 119 as data ID.

The generation circuit 119 has a function of generating the data SDb corresponding to a video displayed with the pixel group 50*b* (see FIG. 1 and FIG. 3B). Specifically, the generation circuit 119 has a function of generating the data SDb for displaying a predetermined figure or a predetermined image on the pixel group 50*b* by adding information (positional information or the like) included in the signal ISb input from the detection circuit 116 to the data ID input from the conversion circuit 118. The generated data SDb is output to the difference detection circuit 120*b* (see FIG. 4).

With the above structure, the data SD can be generated in accordance with binary data.

[Structure Example of Difference Detection Circuit]

Figure 7:
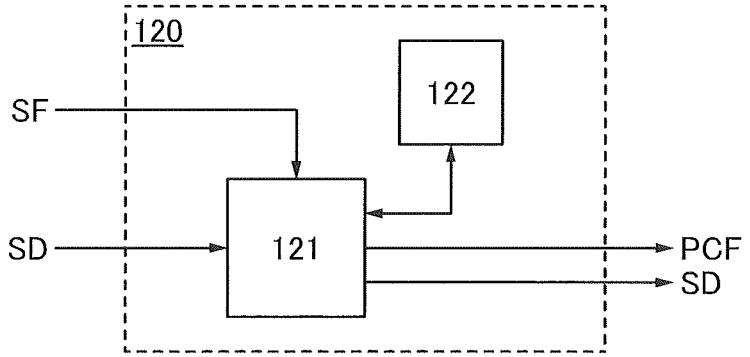
FIG. 7 illustrates a structure example of a difference detection circuit.

Next, a specific structure example of the difference detection circuit 120 is described. FIG. 7 illustrates a structure example of the difference detection circuit 120. Note that the structure of the difference detection circuit 120 illustrated in FIG. 7 can be applied to any of the difference detection circuits 120*a* and 120*b* in FIG. 4.

The difference detection circuit 120 includes a comparison circuit 121 and a memory circuit 122. The comparison circuit 121 can determine whether or not two data match by comparing both the data and output the determination result as the signal PCF. The comparison circuit 121 has a function of outputting the data SD in the case where the two data do not match as a result of the determination. Note that the comparison circuit 121 is connected to the memory circuit 122 and thus can perform transmission and reception of data to/from the memory circuit 122.

The memory circuit 122 has a function of storing data corresponding to a video displayed with the pixel group 50 (see FIG. 1 and FIGS. 3A and 3B). Specifically, the memory circuit 122 has a function of storing the latest data SD output from the comparison circuit 121 to the display portion 20. Thus, the comparison circuit 121 can compare the data SD input from the signal generation circuit 110 with the latest data SD output from the comparison circuit 121 to the display portion 20.

The comparison result is supplied to the power control circuit 80 (see FIG. 1) as the signal PCF. The power control circuit 80 controls power supply to the driver circuit 70 in accordance with the signal PCF.

The signal SF is input to the comparison circuit 121. The comparison circuit 121 has a function of controlling a timing at which the data SD is output from the comparison circuit 121 to the display portion 20 in accordance with the signal SF. Therefore, when the signal SF is set at a high level in FIG. 4, for example, the data SDa and the data SDb can be output from the difference detection circuit 120*a* and the difference detection circuit 120*b*, respectively. Thus, the timings of output of data from the plurality of difference detection circuits 120 to the display portion 20 can be synchronized.

With the above structure, the difference detection circuit 120 determines whether or not a video to be displayed using the data SD generated in the signal generation circuit 110 is the same as a video displayed with the pixel group 50 and thus can determine whether the video displayed with the pixel group 50 needs to be rewritten or not. Thus, whether a video signal needs to be output or not can be determined.

<Structure Example of Power Control Circuit>

Figure 8A:
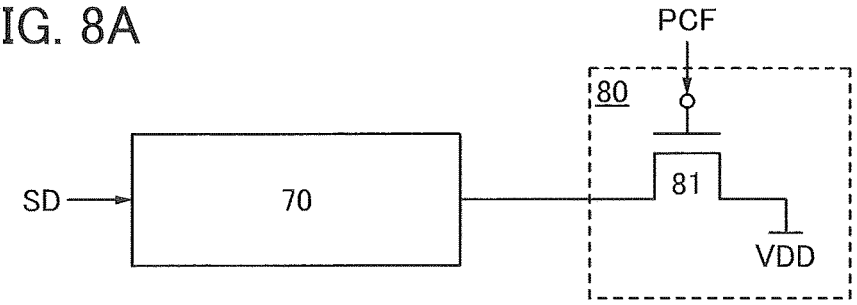
FIGS. 8A to 8C illustrate structure examples of a driver circuit and a power control circuit.

Next, a specific structure example of the power control circuit 80 illustrated in FIG. 1 is described. FIG. 8A illustrates a structure example of the power control circuit 80. Note that the structure of the power control circuit 80 illustrated in FIG. 8A can be applied to either of the power control circuits 80*a* and 80*b* in FIG. 1

The power control circuit 80 includes a transistor 81. A gate of the transistor 81 is connected to a terminal to which the signal PCF or a signal corresponding to the signal PCF is input, one of a source and a drain thereof is connected to the driver circuit 70, and the other of the source and the drain thereof is connected to a wiring to which a power supply potential (here, a high power supply potential VDD) is supplied. Note that although the transistor 81 may be either an n-channel transistor or a p-channel transistor, an n-channel transistor is used here.

Note that a source of a transistor in this specification and the like means a source region that is part of a semiconductor layer functioning as an active layer, a source electrode connected to the semiconductor layer, or the like. Similarly, a "drain" of a transistor means a drain region that is part of the semiconductor layer, a drain electrode connected to the semiconductor layer, or the like. A gate of a transistor means a gate electrode or the like.

The terms "source" and "drain" of a transistor interchange with each other depending on the conductivity type of the transistor or levels of potentials applied to the terminals. In general, in an n-channel transistor, a terminal to which a lower potential is applied is called a source, and a terminal to which a higher potential is applied is called a drain. In a p-channel transistor, a terminal to which a lower potential is applied is called a drain, and a terminal to which a higher potential is applied is called a source. In this specification, although the connection relationship of the transistor is described assuming that the source and the drain are fixed in some cases for convenience, actually, the names of the source and the drain interchange with each other depending on the relationship of the potentials.

In the case where the data SD generated in the decoder 30 and the latest data SD output from the decoder 30 to the display portion 20 are compared and both the data do not match, a high-level potential is supplied as the signal PCF. At this time, the transistor 81 is turned on, and thus the power supply potential VDD is supplied to the driver circuit 70. Thus, the driver circuit 70 is in an operation state, a video signal is supplied from the driver circuit 70 to the pixel group 50, and rewriting of a video is performed.

In contrast, in the case where the data SD generated in the decoder 30 and the latest data SD output from the decoder 30 to the display portion 20 are compared and both the data match, a low-level potential is supplied as the signal PCF. At this time, the transistor 81 is turned off, and thus supply of the power supply potential VDD to the driver circuit 70 is stopped. Thus, the driver circuit 70 is in a non-operation state, a video signal is not supplied from the driver circuit 70 to the pixel portion 40, and thus a video displayed on the pixel group 50 is not updated.

As described above, power supply to the driver circuit 70 can be controlled using the transistor 81. Note that although a high-level signal is supplied as the signal PCF in the case where the two data do not match in the above, a structure may be employed in which in the case where the two data do not match and the difference does not exceed a certain value, a low-level potential is supplied as the signal PCF.

Here, an OS transistor is preferably used as the transistor 81. In this case, the transistor 81 can have an extremely low off-state current in a period during which a low-level potential is supplied as a signal PCF. Accordingly, in a period during which the transistor 81 is in an off state, the leakage current to the driver circuit 70 can be made extremely low, so that the power consumption can be effectively reduced.

The off-state current of an OS transistor normalized on the channel width can be lower than or equal to $10\times10^{-21}$ A/mm (10 zA/mm) with a source-drain voltage of 10 V at room temperature (approximately 25° C.). It is preferable that the off-state current of the OS transistor used as the transistor 81 be lower than or equal to $1\times10^{-18}$ A, lower than or equal to $1\times10^{-21}$ A, or lower than or equal to $1\times10^{-24}$ A at room temperature (approximately 25° C.). Alternatively, the leakage current is preferably lower than or equal to $1\times10^{-15}$ A, lower than or equal to $1\times10^{-18}$ A, or lower than or equal to $1\times10^{-21}$ A at 85° C.

A channel formation region of an OS transistor is preferably formed using an oxide semiconductor containing at least one of indium (In) and zinc (Zn). Typical examples of such an oxide semiconductor include an In oxide, a Zn oxide, an In—Zn oxide, and an In-M-Zn oxide (M is Al, Ti, Ga, Y, Zr, La, Ce, Nd, or Hf). Reductions in impurities serving as electron donors, such as hydrogen, and in oxygen vacancies can make an oxide semiconductor almost i-type (intrinsic) or substantially i-type. Here, such an oxide semiconductor can be referred to as a highly purified oxide semiconductor. The carrier density of an oxide semiconductor can be, for example, lower than $8\times10^{15}$ $cm^{-3}$, preferably lower than $1\times10^{11}$ $cm^{-3}$, further preferably lower than $1\times10^{10}$ $cm^{-3}$ and higher than or equal to $1\times10^{-9}$ $cm^{-3}$.

An oxide semiconductor is a semiconductor which has a large energy gap and in which electrons are unlikely to be excited and the effective mass of a hole is large. Accordingly, an avalanche breakdown and the like are less likely to occur in an OS transistor than in a Si transistor. Since hot-carrier degradation or the like due to the avalanche breakdown is inhibited, the OS transistor has high drain withstand voltage and can be driven at high drain voltage. Accordingly, when the OS transistor is used as the transistor 81, a higher power supply potential can be used.

Note that a transistor other than the OS transistor may be used as the transistor 81. For example, the transistor 81 may be a transistor with a channel formation region formed in a part of a substrate that contains a single-crystal semiconductor other than an oxide semiconductor. Examples of this kind of substrate include a single-crystal silicon substrate and a single-crystal germanium substrate. In addition, the transistor 81 may be a transistor with a channel formation region formed in a film that contains a semiconductor material other than an oxide semiconductor. For example, a transistor in which an amorphous silicon film, a microcrystalline silicon film, a polycrystalline silicon film, a single-crystal silicon film, an amorphous germanium film, a microcrystalline germanium film, a polycrystalline germanium film, or a single-crystal germanium film is used for a semiconductor layer can be used.

Figure 8B:
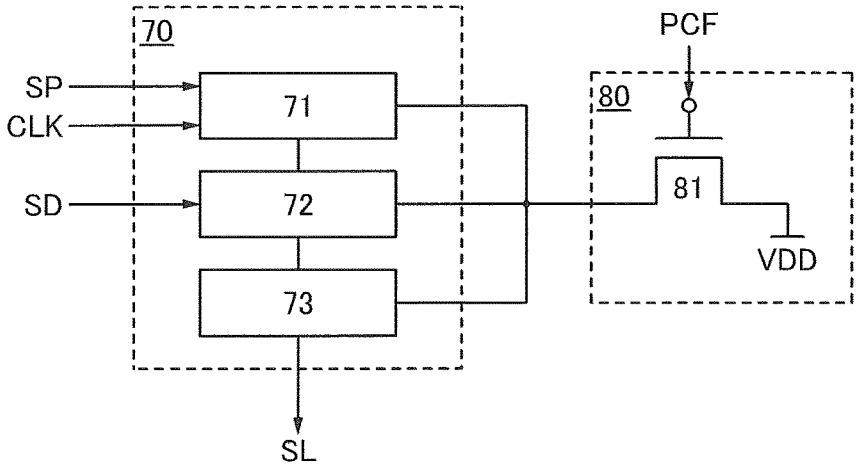

FIG. 8B illustrates a more specific structure example of the driver circuit 70 and the power control circuit 80. The driver circuit 70 includes a shift register 71, a latch circuit 72, and a buffer circuit 73. A start pulse SP, a clock signal CLK, and the like are input to the shift register 71, and the data SD is input to the latch circuit 72. The buffer circuit 73 can include a level shifter or the like having a function of amplifying a signal.

As illustrated in FIG. 8B, the transistor 81 is connected to the shift register 71, the latch circuit 72, and the buffer circuit 73, whereby power supply to the circuits can be controlled at the same time. Consequently, the area of the power control circuit 80 can be reduced.

Figure 8C:
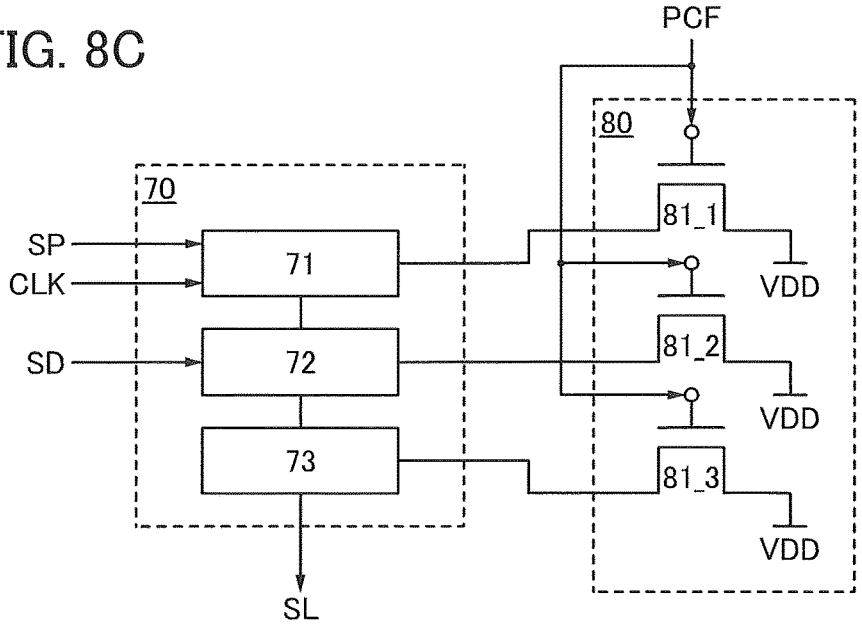

Alternatively, as illustrated in FIG. 8C, the shift register 71, the latch circuit 72, and the buffer circuit 73 may be connected to the corresponding transistors 81 (81_1 to 81_3). In this case, the power supply potentials of the circuits included in the driver circuit 70 can be individually set. In particular, in the case where the buffer circuit 73 includes a level shifter, the buffer circuit 73 needs to be supplied with a higher power supply potential than the other circuits in some cases. Therefore, it is preferable that the power supply potential supplied to the buffer circuit 73 be set at a higher level than the power supply potential supplied to the shift register 71 or the latch circuit 72 and that another transistor 81 be separately connected to the buffer circuit 73 from the transistor 81 connected to the other circuits. In this case, the shift register 71 and the latch circuit 72 may share one transistor 81.

Figure 9A:
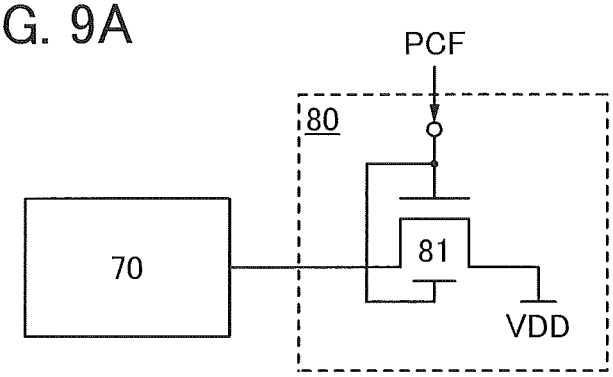
FIGS. 9A and 9B illustrate structure examples of a driver circuit and a power control circuit.
Figure 9B:
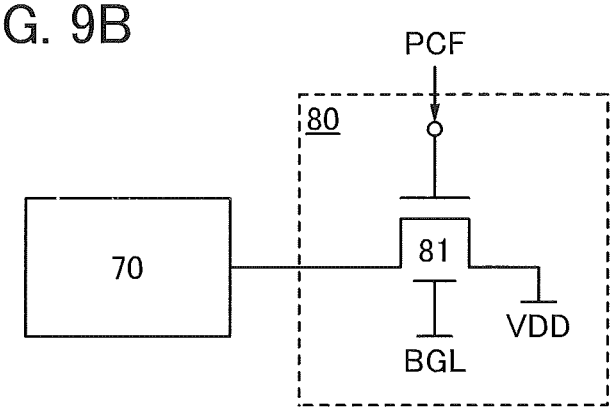

The transistor 81 may include a pair of gates. FIGS. 9A and 9B each illustrate a structure example in which the transistor 81 includes a pair of gate electrodes. Here, the transistor 81 is an OS transistor. Note that when a transistor includes a pair of gates, one of the pair of gates in the transistor is referred to as a first gate, a front gate, or simply a gate in some cases, and the other thereof is referred to as a second gate or a back gate in some cases.

The transistor 81 illustrated in FIG. 9A includes a back gate, and the back gate is connected to a front gate. In this case, the potential of the front gate is equal to the potential of the backgate.

The transistor 81 illustrated in FIG. 9B includes a back gate connected to a wiring BGL. The wiring BGL has a function of supplying a predetermined potential to the back gate. The threshold voltage of the transistor 81 can be controlled by controlling the potential of the wiring BGL. The potential supplied to the wiring BGL may be a fixed potential or a variation potential. In the case where a variation potential is supplied to the wiring BGL, for example, the threshold voltage of the transistor 81 may be changed by making the potential of the wiring BGL different between a period during which the transistor 81 is in an on state and a period during which the transistor 81 is in an off state. Note that in the case where the power control circuit 80 includes the plurality of transistors 81, the wiring BGL can be shared by some or all of the transistors 81.

Note that the power control circuit 80 may also control supply of the start pulse SP and the clock signal CLK to the driver circuit 70 in addition to the supply of the power supply potential.

Figure 10A:
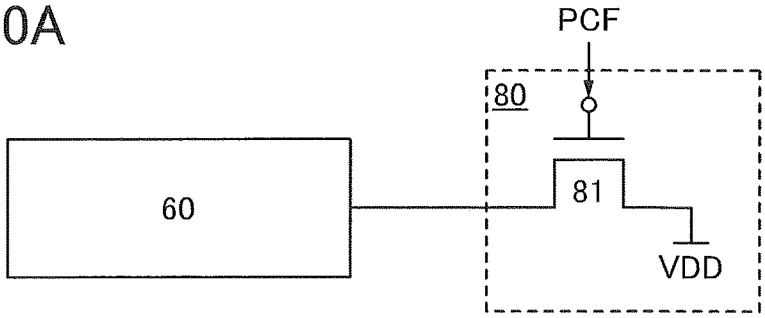
FIGS. 10A to 10C illustrate structure examples of a driver circuit and a power control circuit.

Although FIGS. 8A to 8C and FIGS. 9A and 9B each illustrates a structure example in which the power control circuit 80 controls power supply to the driver circuit 70, the power control circuit 80 may control power supply to the driver circuit 60 (see FIG. 1). FIG. 10A illustrates a structure example in the above case. Note that the operation of the power control circuit 80 is similar to that of the power control circuit 80 in FIG. 8A.

Figure 10B:
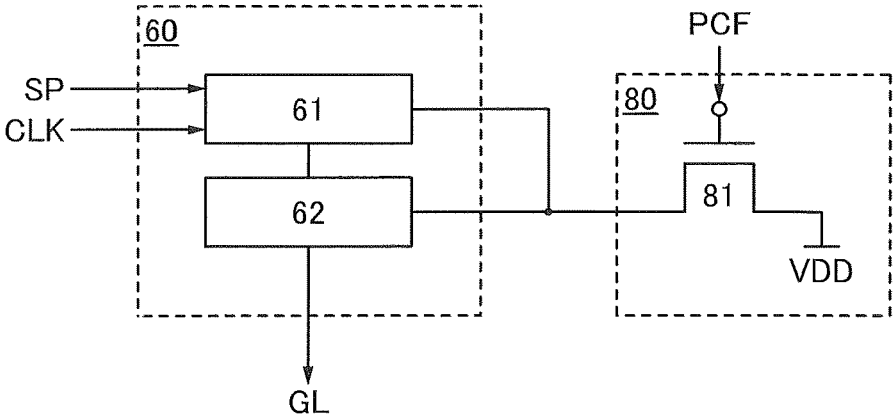

FIG. 10B illustrates a more specific structure example of the driver circuit 60. The driver circuit 60 includes a shift register 61 and a buffer circuit 62. The start pulse SP, the clock signal CLK, and the like are input to the shift register 61. The buffer circuit 62 can include a level shifter or the like having a function of amplifying a signal. As illustrated in FIG. 10B, the transistor 81 is connected to the shift register 61 and the buffer circuit 62, whereby power supply to the circuits can be controlled at the same time. Consequently, the area of the power control circuit 80 can be reduced.

Figure 10C:
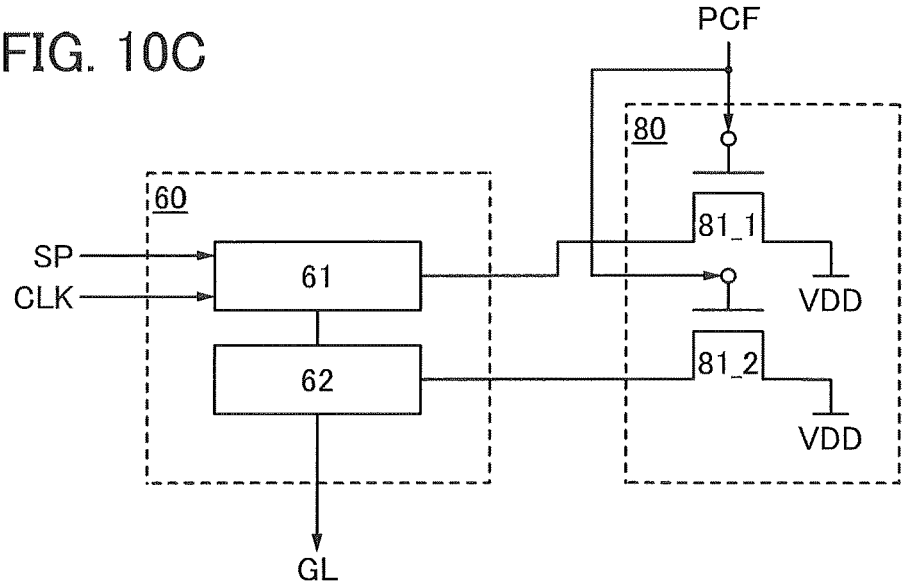

Alternatively, as illustrated in FIG. 10C, the shift register 61 and the buffer circuit 62 may be connected to the corresponding transistors 81 (81_1 and 81_2). In this case, the power supply potentials of the circuits included in the driver circuit 60 can be individually set.

With any of the above structures, power supply to the driver circuit can be controlled in accordance with the signal PCF.

<Operation Example of Decoder>

Next, a specific operation example of the decoder 30 illustrated in FIG. 4 is described with reference to a timing chart in FIG. 11. Here, as an example, the case in which a portable document format (PDF) file is input as the data BD and a video is displayed on the display portion 20 in accordance with the data BD is described. Furthermore, the case in which the data BD is divided into the character data, and the figure data or the image data to generate the data SDa for displaying a character and the data SDb for displaying a figure or an image is described.

Figure 11:
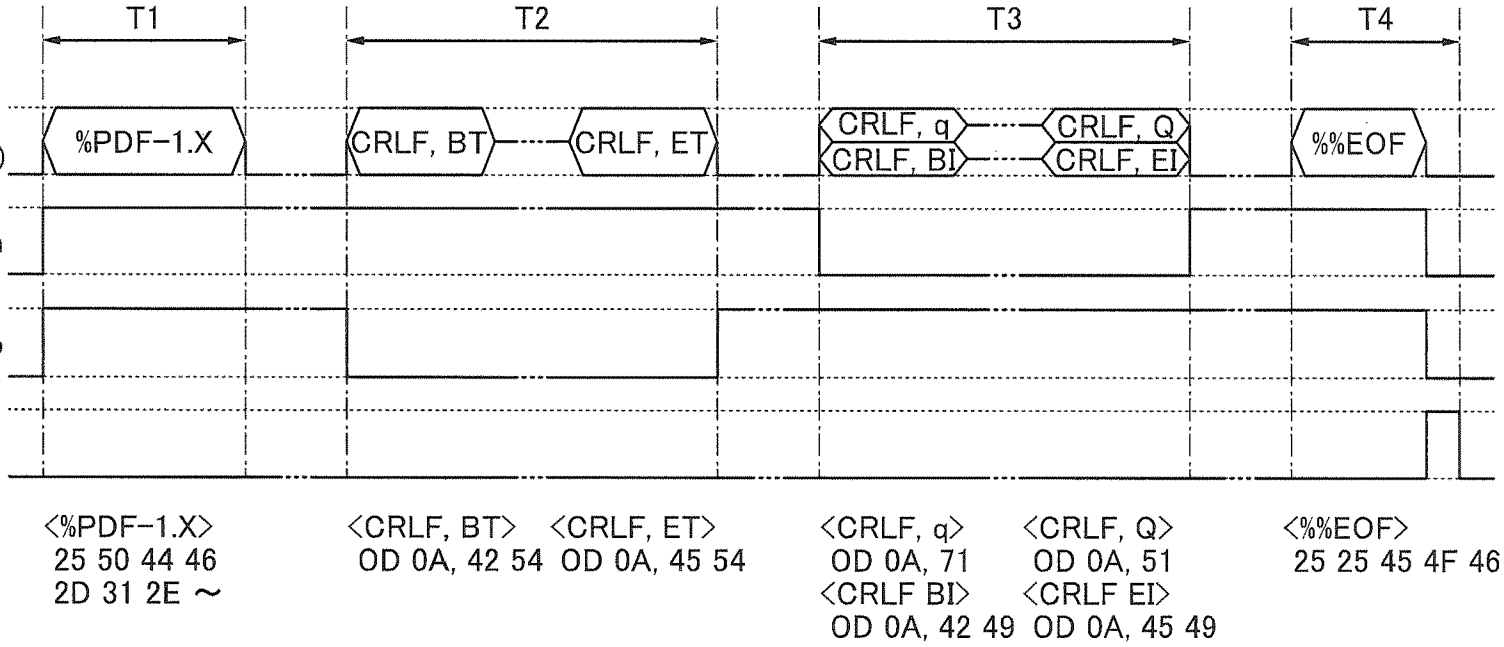
FIG. 11 is a timing diagram.

Note that in FIG. 11, a period T1 corresponds to a period during which the header of the data BD is read, a period T2 corresponds to a period during which the character data is extracted from the data BD, a period T3 corresponds to a period during which the figure data or the image data is extracted from the data BD, and a period T4 corresponds to a period during which the footer of the data BD is read.

First, in the period T1, data "% PDF-1.X" (description: 25 50 44 46 2D 31 2E~, and X depends on the PDF version) corresponding to the header of the data BD is input to the determination circuit 100. Thus, the data DB is recognized as PDF format. Note that in the period T1, the signal DFa and the signal DFb are set at a high level.

Next, detection of the data is performed in the determination circuit 100. Note that in the data in PDF format, the character data is described with syntax which begins with "BT" and ends with "ET", the figure data is described with syntax which begins with "q" and ends with "Q", and the image data is described with syntax which begins with "BI" and ends with "EI". Moreover, data corresponding to a new line is described with a code "CRLF". Hereinafter, the case in which the data DB is divided into the character data, and the figure data or the image data is described.

First, in the period T2, data "CRLF, BT (description: 0D 0A (CRLF), 42 54 (BT)) is input to the determination circuit 100. Thus, start of syntax describing the character data is recognized, and the signal DFb is set at a low level. In the signal generation circuit 110*a* to which the high-level signal DFa is input, the data SDa is generated in accordance with the data BD input to the determination circuit 100. In contrast, in the signal generation circuit 110*b* to which the low-level signal DFb is input, the data SDb is not generated.

After that, data "CRLF, ET" (description: 0D 0A (CRLF), 45 54 (ET)) is input to the determination circuit 100. Thus, end of the syntax describing the character data is recognized, and thus the signal DFb is set at a high level.

Next, in the period T3, data "CRLF, q" (description: 0D 0A (CRLF), 71 (q)) or data "CRLF, BI" (description: 0D 0A (CRLF), 42 49 (BI)) is input to the determination circuit 100. Thus, start of syntax describing the figure data or the image data is recognized, and the signal DFa is set at a low level. In the signal generation circuit 110*b* to which the high-level signal DFb is input, the data SDb is generated in accordance with the data BD input to the determination circuit 100. In contrast, in the signal generation circuit 110*a* to which the low-level signal DFa is input, the data SDa is not generated.

After that, data "CRLF, Q" (description: 0D 0A (CRLF), 51 (Q)) or data "CRLF, EI" (description: 0D 0A (CRLF), 45 49 (EI)) is input to the determination circuit 100. Thus, end of the syntax describing the figure data or the image data is recognized, and thus the signal DFa is set at a high level.

In this manner, the signal generation circuit 110*a* receives the character data and the signal generation circuit 110*b* selectively receives the figure data and the image data, so that the data SD can be generated.

Next, in the period T4, data "%% EOF" (description: 25 25 45 4F 46) corresponding to the footer of the data BD is input to the determination circuit 100. Thus, termination of the data DB is recognized. When the data "%% EOF" is input, the high-level signal SF is output from the determination circuit 100 to the difference detection circuits 120*a* and 120*b*.

In the case where the result of comparison between the data in each of the difference detection circuits 120*a* and 120*b* shows that the data do not match, the data SDa is output from the difference detection circuit 120*a* to the driver circuit 70*a*, and the data SDb is output from the difference detection circuit 120*b* to the driver circuit 70*b*. Here, the data SDa and the data SDb are output when the signal SF is set at a high level. That is, using the signal SF indicating recognition of the footer of the data BD as a trigger, the data can be output from the difference detection circuits 120*a* and 120*b* at the same time. Thus, even in the case where there is a difference between time required for generation of the data SDa and time required for generation of the data SDb, the timings at which the signals are output can be synchronized.

With the above operation, the data BD is divided into a plurality of kinds of data, video signals corresponding to the plurality of kinds of data are generated separately, and the video signals can be output to the display portion 20 at the same time.

<Modification Example of Display System>

Figure 12:
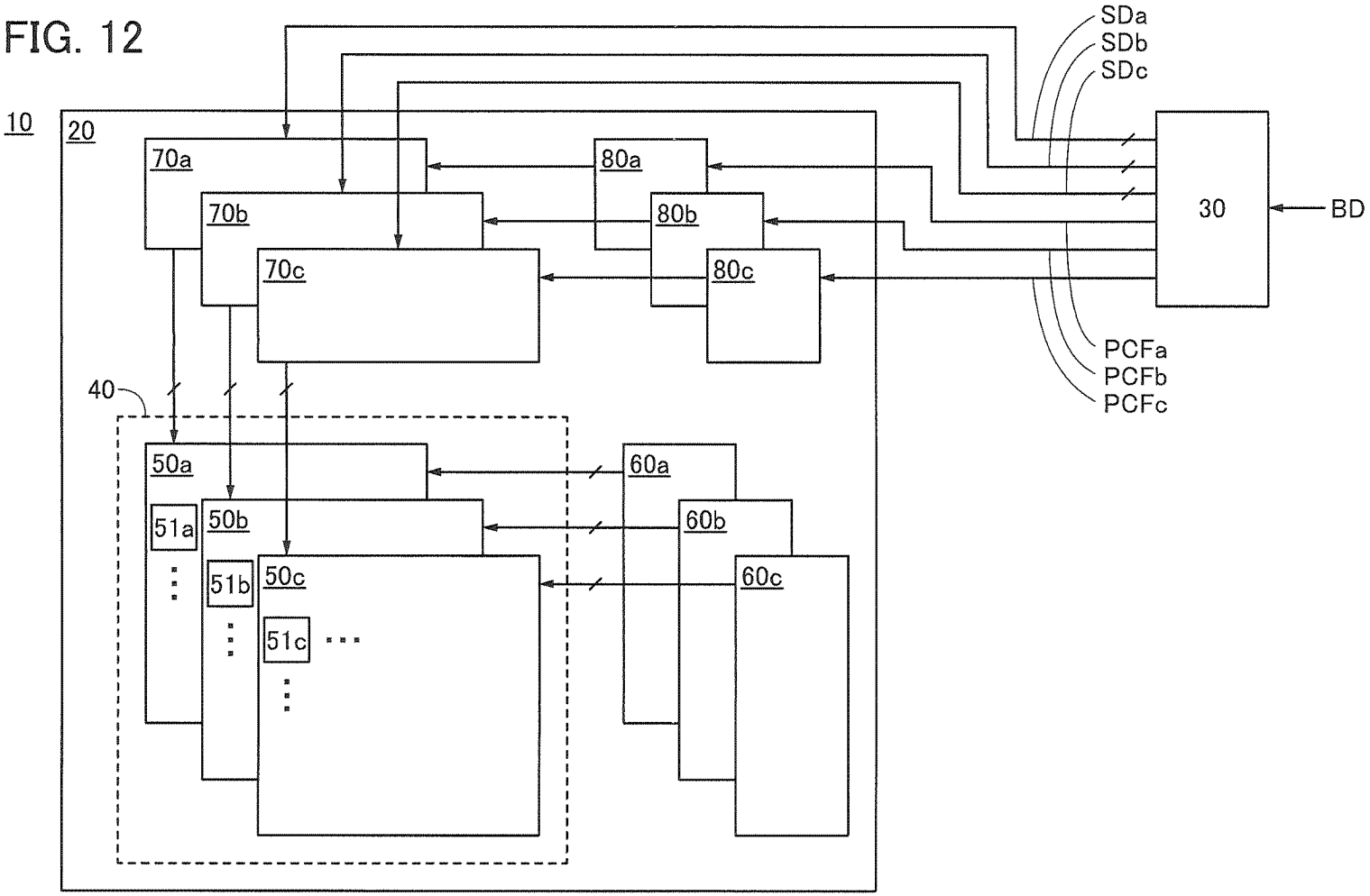
FIG. 12 illustrates a structure example of a display system.

Although the structure example in which the data DB is divided into two kinds of data, and videos corresponding to the data are displayed using the two pixel groups 50 is particularly described in detail in the above description, the number of divisions of the data DB is not limited to the above and may be three or more. FIG. 12 illustrates a structure example of the display system 10 capable of dividing the data DB into three kinds of data.

The display system 10 illustrated in FIG. 12 differs from that illustrated in FIG. 1 in that a pixel group 50*c* including a plurality of pixels 51*c*, a driver circuit 60*c*, a driver circuit 70*c*, and a power control circuit 80*c* are provided. Data SDc is input from the decoder 30 to the driver circuit 70*c*, and a signal PCFc is input from the decoder 30 to the power control circuit 80*c*. Note that the data SDc and the signal PCFc can be generated using a signal generation circuit 110*c* and a difference detection circuit 120*c* in the decoder 30 in FIG. 4.

In the display system 10 illustrated in FIG. 12, for example, the data DB is divided into three kinds of data, i.e., the character data, the figure data, and the image data, and videos corresponding to the data can be displayed with the corresponding pixel groups 50*a*, 50*b*, and 50*c*. Thus, control of output of a video signal, control of the operation state of the driver circuit 70, and the like can be performed for each of the three kinds of video signals, leading to finer-grained operation with low power consumption.

As described above, in one embodiment of the present invention, a plurality of kinds of video signals can be generated by division of input data, and the plurality of kinds of video signals can be supplied to the different pixel groups. Thus, for example, the plurality of kinds of video signals can be supplied individually, and the operation states of the plurality of driver circuits can be controlled individually, leading to fine-grained operation with low power consumption. Accordingly, it is possible to provide a decoder, a display portion, or a display system having low power consumption.

In addition, in one embodiment of the present invention, when the OS transistor is used in the circuit included in the display system, the display system having low power consumption can be provided.

This embodiment can be combined with any of the other embodiments as appropriate.

Embodiment 2

In this embodiment, a specific structure example and an operation example of a display device which can be used for the display portion 20 are described.

<Structure Example of Display Device>

For the display portion 20 illustrated in FIG. 1, a display device such as a liquid crystal display device or a light-emitting display device can be used. An example of a display device which can be used for the display portion 20 is described below.

Figure 13:
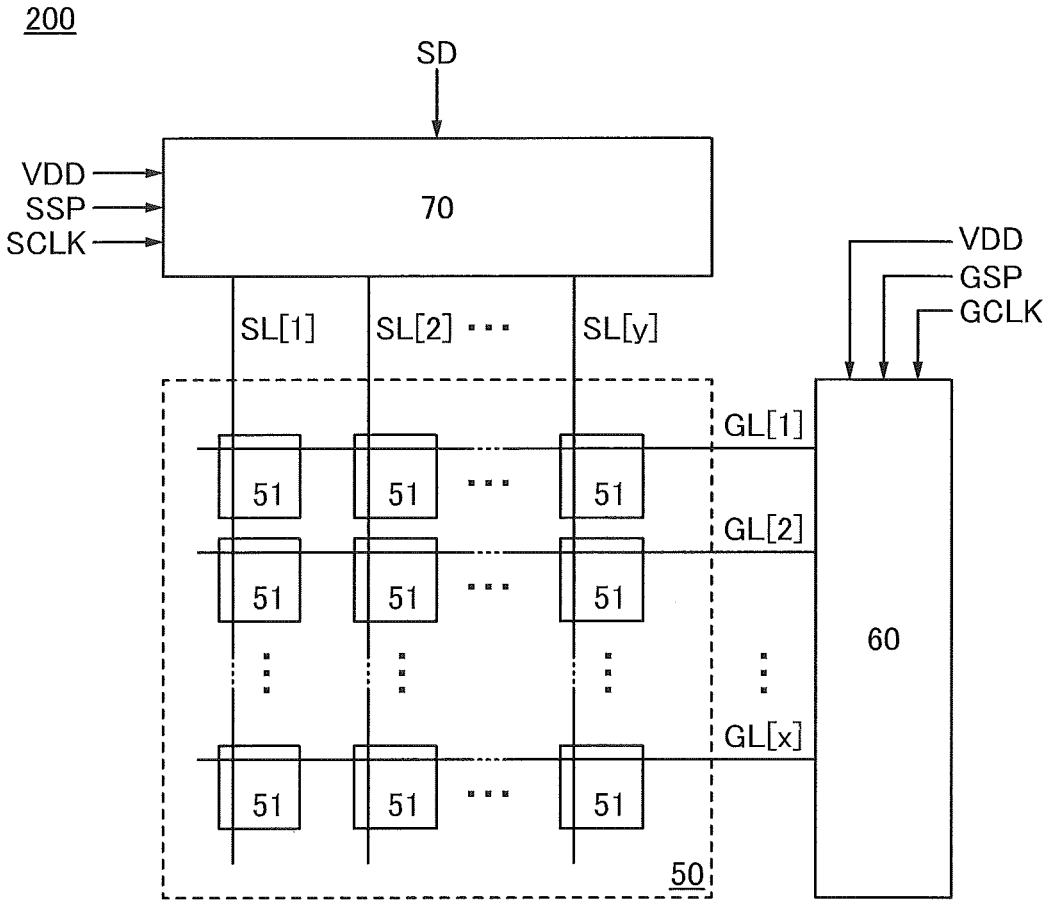
FIG. 13 illustrates a structure example of a display device.

FIG. 13 illustrates a structure example of a display device 200. The display device 200 includes the pixel group 50, the driver circuit 60, and the driver circuit 70. The pixel group 50 includes pixels 51 of x rows and y columns (x and y are natural numbers). The pixel group 50, the pixel 51, the driver circuit 60, and the driver circuit 70 can be used as the pixel group 50*a* or 50*b*, the pixel 51*a* or 51*b*, the driver circuit 60*a* or 60*b*, and the driver circuit 70*a* or 70*b* in FIG. 1, respectively.

The power supply potential VDD, a start pulse GSP, and a clock signal GCLK are input to the driver circuit 60. The data SD, the power supply potential VDD, a start pulse SSP, and a clock signal SCLK are input to the driver circuit 70.

When the signal PCF indicating that a video needs to be rewritten is input from the decoder 30 to the display portion 20 in FIG. 1, the driver circuits 60 and 70 are brought into an operation state by control of the power control circuit 80. Here, the power supply potential VDD, the start pulse GSP, and the clock signal GCLK are supplied to the driver circuit 60, and selection signals are supplied from the driver circuit 60 to the pixel group 50 through wirings GL. Moreover, the power supply potential VDD, the start pulse SSP, and the clock signal SCLK are supplied to the driver circuit 70, and the data SD is supplied from the driver circuit 70 to the pixel group 50 through wirings SL.

In contrast, when the signal PCF indicating that a video does not need to be rewritten is input from the decoder 30 to the display portion 20, the driver circuits 60 and 70 are in a resting state by control of the power control circuit 80. At this time, the supply of the power supply potential VDD, the start pulse GSP, and the clock signal GCLK to the driver circuit 60 is stopped, so that an operation of the driver circuit 60 is stopped. Accordingly, selection signals are not supplied to the pixel group 50. Moreover, the supply of the power supply potential VDD, the start pulse SSP, and the clock signal SCLK to the driver circuit 70 is stopped, so that an operation of the driver circuit 70 is stopped. Accordingly, the data SD is not supplied to the pixel group 50. Thus, the driver circuits 60 and 70 can be in a resting state in a period during which a video does not need to be rewritten, whereby power consumption can be reduced.

<Operation Example of Display Device>

Next, an operation example of the display device 200 is described. Here, an operation example of a display device 200*a* to which the data SDa is supplied in accordance with the signal PCFa shown in FIG. 1 and an operation example of a display device 200*b* to which the data SDb is supplied in accordance with the signal PCFb are described.

Figure 14:
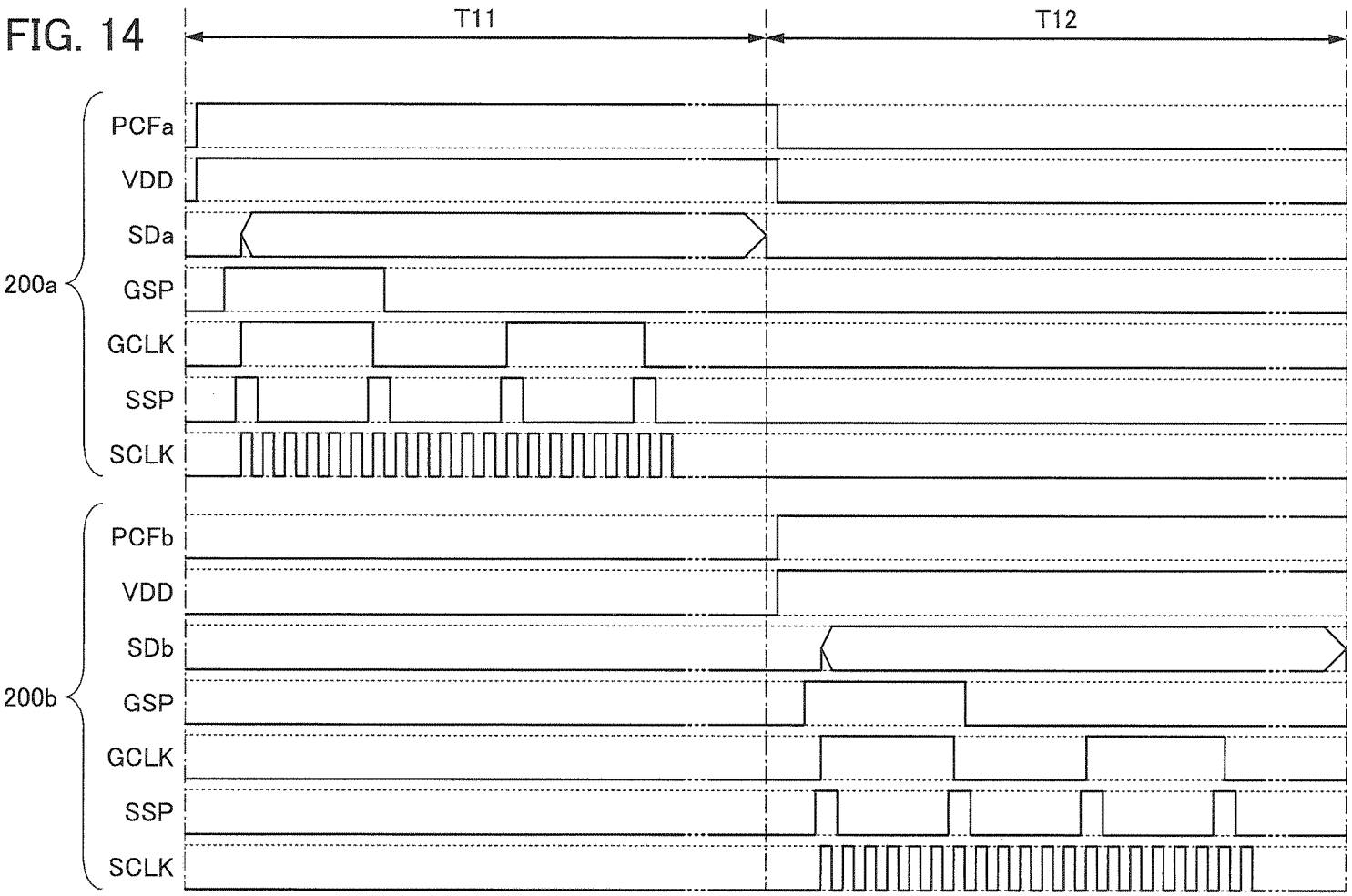
FIG. 14 is a timing diagram.

FIG. 14 is a timing chart showing operation of the display devices 200*a* and 200*b*. A period T11 is a period in which a video is rewritten in the display device 200*a* and a video is not rewritten in the display device 200*b*. A period T12 is a period in which a video is not rewritten in the display device 200*a* and a video is rewritten in the display device 200*b*.

First, in the period T11, the signal PCFa is set at a high level, and thus in the display device 200*a*, the power supply potential VDD is supplied to the driver circuits 60 and 70. The start pulse GSP and the clock signal GCLK are supplied to the driver circuit 60, so that pixels 51 in a certain row are selected by the driver circuit 60. The data SDa, the start pulse SSP, and the clock signal SCLK are supplied to the driver circuit 70, so that the data SDa is supplied to the pixels 51 selected by the driver circuit 60.

The signal PCFb is set at a low level, and thus in the display device 200*b*, supply of the power supply potential VDD to the driver circuits 60 and 70 is stopped. Furthermore, the supply of the start pulse GSP and the clock signal GCLK to the driver circuit 60 is stopped and the supply of the data SDb, the start pulse SSP, and the clock signal SCLK to the driver circuit 70 is stopped. Accordingly, the driver circuits 60 and 70 are in a resting state. At this time, the display state of the pixels 51 is not updated Next, in the period T12, the signal PCFa is set at a low level, and thus in the display device 200*a*, the supply of the power supply potential VDD to the driver circuits 60 and 70 is stopped. Furthermore, the supply of the start pulse GSP and the clock signal GCLK to the driver circuit 60 is stopped and the supply of the data SDa, the start pulse SSP, and the clock signal SCLK to the driver circuit 70 is stopped. Accordingly, the driver circuits 60 and 70 are in a resting state. At this time, the display state of the pixels 51 is not updated.

In contrast, the signal PCFb is set at a high level, and thus in the display device 200*b*, the power supply potential VDD is supplied to the driver circuits 60 and 70. The start pulse GSP and the clock signal GCLK are supplied to the driver circuit 60, so that pixels 51 in a certain row are selected by the driver circuit 60. The data SDb, the start pulse SSP, and the clock signal SCLK are supplied to the driver circuit 70, so that the data SDb is supplied to the pixels 51 selected by the driver circuit 60.

As described above, in the case where the pixel group where a video is not rewritten exists in the pixel portion 40 in FIG. 1, the driver circuit in the display device including the pixel group can be in a resting state, leading to lower power consumption.

Note that although an operation example in which stop of the supply of power and the signals is performed on both of the driver circuits 60 and 70 is shown in FIG. 14, the stop of the supply of power and the signals may be performed on one of the driver circuits 60 and 70.

The display device 200 can include various display elements. For example, an element including display media whose contrast, luminance, reflectivity, transmittance, or the like is changed by electrical or magnetic effect can be used as the display element. Examples of the display element include an electroluminescent (EL) element (e.g., an organic EL element, an inorganic EL element, or an EL element including organic and inorganic materials), an LED (e.g., a white LED, a red LED, a green LED, and a blue LED), a transistor which emits light when current flows, an electron emitter, a liquid crystal element, electronic ink, an electrophoretic element, a grating light valve (GLV), a digital micromirror device (DMD), a digital micro shutter (DMS), MIRASOL (registered trademark), an interferometric modulator (IMOD) element, a microelectromechanical systems (MEMS) display element, an electrowetting element, a piezoelectric ceramic display, and a display element including a carbon nanotube. Alternatively, quantum dots may be used as the display element.

Examples of display devices having EL elements include an EL display. Display devices having electron emitters include a field emission display (FED), an SED-type flat panel display (SED: surface-conduction electron-emitter display), and the like. Examples of display devices including quantum dots include a quantum dot display. Examples of display devices including liquid crystal elements are a liquid crystal display (e.g., a transmissive liquid crystal display, a transflective liquid crystal display, a reflective liquid crystal display, a direct-view liquid crystal display, and a projection liquid crystal display). Examples of a display device including electronic ink, electronic liquid powder (registered trademark), or electrophoretic elements include electronic paper. The display device may be a plasma display panel (PDP) or a retinal projector.

In the case of a transflective liquid crystal display or a reflective liquid crystal display, some of or all of pixel electrodes function as reflective electrodes. For example, some or all of pixel electrodes are formed to contain aluminum, silver, or the like. In such a case, a memory circuit such as an SRAM can be provided under the reflective electrodes. In that case, power consumption can be reduced.

Note that in the case of using an LED, graphene or graphite may be provided under an electrode or a nitride semiconductor of the LED. Graphene or graphite may be a multilayer film in which a plurality of layers are stacked. As described above, provision of graphene or graphite enables easy formation of a nitride semiconductor film thereover, such as an n-type GaN semiconductor layer including crystals. Furthermore, a p-type GaN semiconductor layer including crystals or the like can be provided thereover, and thus the LED can be formed. Note that an AlN layer may be provided between the n-type GaN semiconductor layer including crystals and graphene or graphite. The GaN semiconductor layers included in the LED may be formed by MOCVD. Note that when the graphene is provided, the GaN semiconductor layers included in the LED can also be formed by a sputtering method.

Configuration examples of a pixel in which a liquid crystal element is provided as a display element and a pixel in which an EL element is provided as a display element are described.

<Structure Example 1 of Pixel>

Figure 15A:
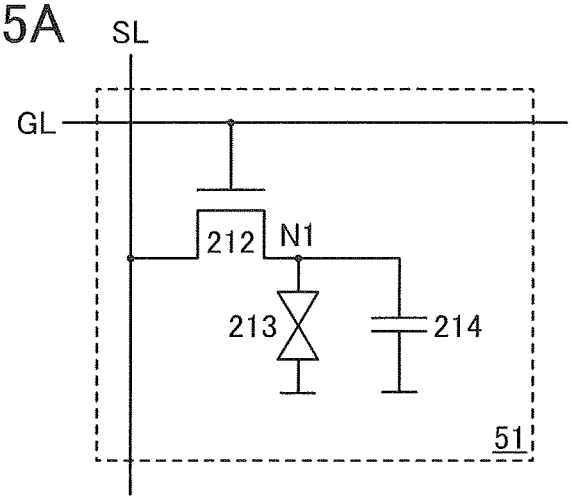
FIGS. 15A to 15C illustrate structure examples of a pixel.

FIG. 15A illustrates a structure example of the pixel 51. The pixel 51 includes a transistor 212, a liquid crystal element 213, and a capacitor 214.

A gate of the transistor 212 is connected to the wiring GL and one of a source and a drain of the transistor 212 is connected to one of electrodes of the liquid crystal element 213 and one of electrodes of the capacitor 214. The other of the source and the drain of the transistor 212 is connected to the wiring SL. The other electrode of the liquid crystal element 213 and the other electrode of the capacitor 214 are each connected to a terminal to which a predetermined potential is supplied. A node which is connected to one of the source and the drain of the transistor 212, one of the electrodes of the liquid crystal element 213, and one of the electrodes of the capacitor 214 is a node N1.

The potential of the other of the electrodes of the liquid crystal element 213 may be a common potential among the plurality of pixels 51 or may be the same potential as the other electrode of the capacitor 214. The potential of the other electrode of the liquid crystal element 213 may differ between the pixels 51. The capacitor 214 has a function as a storage capacitor for holding a potential of the node N1.

Although the transistor 212 is an n-channel transistor here, the transistor 212 may be a p-channel transistor. The capacitor 214 can be omitted. Note that the pixel 51 may further include an element such as a transistor, a diode, a resistor, a capacitor, or an inductor, as needed.

Furthermore, the transistor 212 controls supply of the potential of the wiring SL to the node N1. Specifically, the potential of the wiring GL is controlled to turn on the transistor 212, whereby the potential of the wiring SL is supplied to the node N1 and is written to the pixel 51. Then, the potential of the wiring GL is controlled to turn off the transistor 212, whereby the potential of the node N1 is held.

The liquid crystal element 213 includes a pair of electrodes and a liquid crystal layer containing a liquid crystal material to which the a voltage between the pair of electrodes is applied. The alignment of the liquid crystal molecules included in the liquid crystal element 213 changes in accordance with the value of the voltage applied between the pair of electrodes, and thus the transmittance of the liquid crystal layer is changed. Therefore, when the potential supplied from the wiring SL to the node N1 is controlled, the gray level of the pixel 51 can be controlled.

Figure 15B:
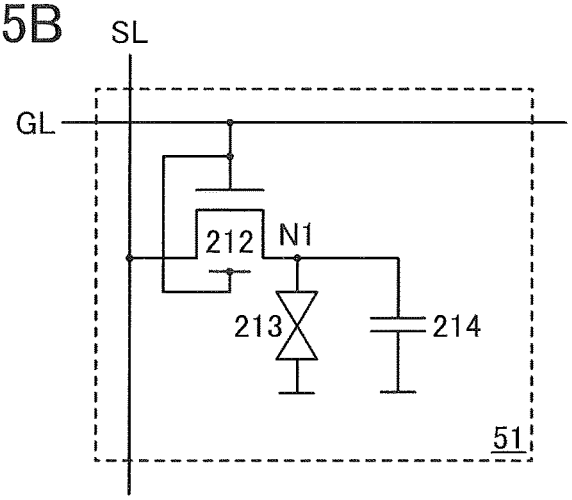
Figure 15C:
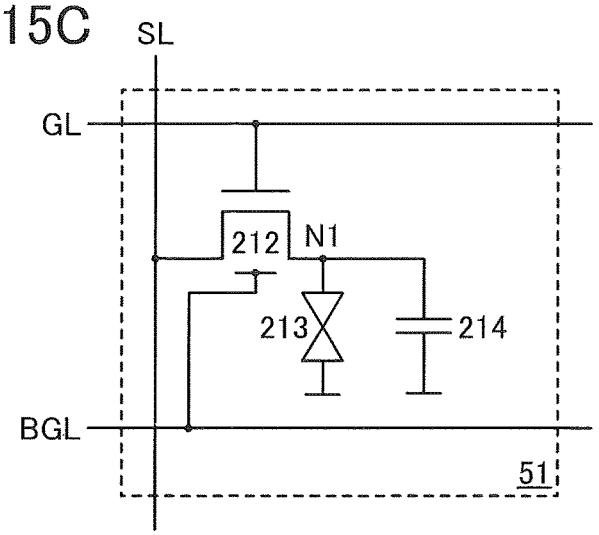

The transistor 212 may include a pair of gates. FIGS. 15B and 15C illustrate structures of the transistor 212 including a pair of gates.

The transistor 212 illustrated in FIG. 15B includes a back gate, and the back gate is connected to a front gate. In this case, the potential of the front gate is equal to the potential of the back gate.

The back gate of the transistor 212 illustrated in FIG. 15C is connected to a wiring BGL. The wiring BGL has a function of supplying a predetermined potential to the back gate. The threshold voltage of the transistor 212 can be controlled by controlling the potential of the wiring BGL. Note that the wiring BGL can be connected to the driver circuit 60 (see FIG. 13), and the potential of the wiring BGL can be controlled by the driver circuit 60. The wiring BGL is shared by the pixels 51 in one row.

Next, an operation example of the pixel 51 illustrated in FIGS. 15A to 15C is described.

First, in a first frame period, a predetermined potential is supplied from the driver circuit 60 to the wiring GL[1], whereby the pixels 51 in the first row are selected. The transistors 212 in the selected pixels 51 are turned on.

The potential corresponding to a gray level to be displayed on the pixel 51 is supplied from the driver circuit 70 to each of the wirings SL[1] to SL[y]. Then, the potential of each of the wirings SL[1] to SL[y] is supplied to the node N1 through the transistor 212. Thus, the transmittance of the liquid crystal element 213 is controlled, whereby the gray level of each of the pixels 51 is controlled.

Then, a predetermined potential is supplied from the driver circuit 60 to the wiring GL[1], whereby the pixels 51 in the first row are deselected. Accordingly, in the pixels 51 in the first row, the transistors 212 are turned off and thus the potentials of the nodes N1 are stored. Thus, rewriting of the pixels 51 in the first row is completed.

In a similar manner, the wirings GL[2] to GL[x] are sequentially selected, and the operations similar to the above are repeated. Thus, an image of the first frame can be displayed on the pixel group 50.

The selection of the wirings GL may be performed by either progressive scan or interlaced scan. The supply of the data SD from the driver circuit 70 to the wirings SL[1] to SL[y] may be performed by dot sequential driving in which the data SD are sequentially supplied to the wirings SL[1] to SL[y], or line sequential driving in which the data SD are concurrently supplied to the wirings SL[1] to SL[y]. Alternatively, a driving method in which the data SD are sequentially supplied to every plural wirings SL may be employed.

Next, in a second frame period, an image is displayed by an operation similar to that of the first frame period. Thus, the image displayed with the pixel group 50 is rewritten. Note that the image rewriting is performed at a rate high enough to prevent a change in an image due to the rewriting from being recognized by a viewer of the pixel portion 510. For example, image rewriting is performed at a frequency of higher than or equal to 60 times per second. Accordingly, a smooth moving image can be displayed on the pixel group 50.

On the other hand, for example, in the case of displaying a still image or a moving image which does not change or changes within a predetermined range on the pixel group 50, rewriting is preferably omitted. In this way, power consumption associated with image rewriting can be reduced. In this case, for example, the frequency of the image rewriting is more than or equal to once per day and less than 0.1 times per second, preferably more than or equal to once per hour and less than once per second, and further preferably more than or equal to once per 30 seconds and less than once per second.

In a period in which image rewriting is not performed, the supply of a power supply potential and a signal to the driver circuit 60 and the driver circuit 70 can be stopped. Thus, power consumption of the driver circuits 60 and 70 can be reduced.

When the frequency of image rewriting is reduced, flickers in displaying an image can be reduced. Accordingly, eye strain of an observer of the pixel group 50 can be reduced.

When the frequency of image rewriting is reduced, the potential of the node N1 is preferably stored for a long time. For this reason, an OS transistor with low off-state current is preferably used as the transistor 212. Thus, when an OS transistor is used as the transistor 212, the potential of the node N1 can be held for an extremely long time, and the display state of a video can be maintained even when the frequency of video rewriting is reduced.

Note that to maintain a display state is to keep the amount of change in display state within a given range. This given range can be set as appropriate, and is preferably set so that a user viewing displayed images can recognize the displayed images as the same image.

A transistor whose channel formation region is formed in a film including a semiconductor other than an oxide semiconductor can also be used as the transistor 212. Examples of a semiconductor other than an oxide semiconductor include silicon, germanium, silicon germanium, silicon carbide, gallium arsenide, aluminum gallium arsenide, indium phosphide, gallium nitride, and an organic semiconductor. Each of the above semiconductors other than an oxide semiconductor may be a single crystal semiconductor or a non-single-crystal semiconductor such as an amorphous semiconductor, a microcrystalline semiconductor, or a polycrystalline semiconductor.

<Structure Example 2 of Pixel>

Figure 16A:
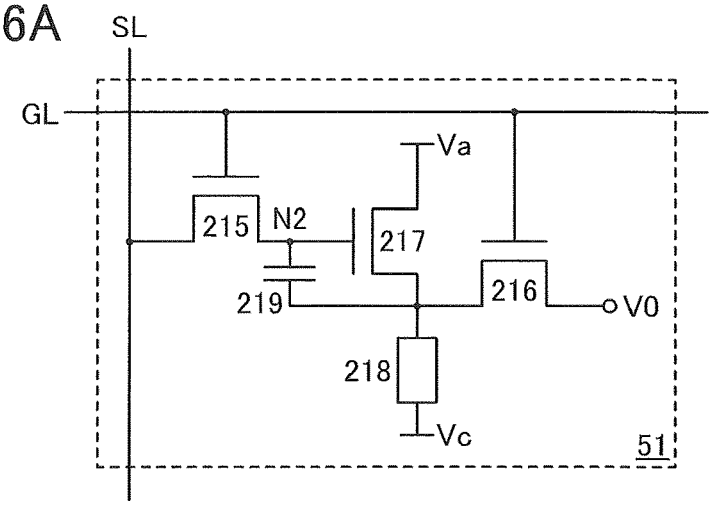
FIGS. 16A to 16C illustrate structure examples of a pixel.

FIG. 16A shows another structure example of the pixel 51. The pixel 51 illustrated in FIG. 16A includes transistors 215 to 217, a light-emitting element 218, and a capacitor 219. Note that the transistor 216 can be omitted.

A gate of the transistor 215 is connected to the wiring GL. One of a source and a drain of the transistor 215 is connected to a gate of the transistor 217 and one of electrodes of the capacitor 219. The other of the source and the drain of the transistor 215 is connected to the wiring SL. One of the source and the drain of the transistor 217 is connected to the other electrode of the capacitor 219, one of electrodes of the light-emitting element 218, and one of a source and a drain of the transistor 216. The other of the source and the drain of the transistor 216 is connected to a wiring to which a potential Va is supplied. The other electrode of the light-emitting element 218 is connected to a wiring to which a potential Vc is supplied. Agate of the transistor 216 is connected to the wiring GL, and the other of the source and the drain thereof is connected to a wiring to which a potential V0 is supplied. Here, a node which is connected to one of the source and the drain of the transistor 215, the gate of the transistor 217, and the one electrode of the capacitor 219 is referred to as a node N2.

Note that the transistors 215 to 217 are n-channel transistors here; however, each of the transistors 215 to 217 may be an n-channel transistor or a p-channel transistor. A semiconductor material which is similar to that of the transistor 212 can be used for the transistors 215 to 217. Note that the semiconductor materials of the transistors 215 to 217 may be the same or different from each other. For example, a Si transistor may be used as the transistor 215, and an OS transistor may be used for the transistor 217. Alternatively, an OS transistor may be used as the transistor 215, and a Si transistor may be used as the transistor 217. When an OS transistor is used as the transistor 215, the transistor 215 enables the potential of the node N2 to be retained for an extremely long time.

The capacitor 214 can be omitted. Note that the pixel 51 may further include an element such as a transistor, a diode, a resistor, a capacitor, or an inductor, as needed.

As the light-emitting element 218, an organic EL element, an inorganic EL element, or the like can be used. One of the potential Va and the potential Vb can be a high power supply potential, and the other can be a low power supply potential. The capacitor 219 functions as a storage capacitor for holding the potential of the node N2.

Furthermore, the transistor 215 controls supply of a potential of the wiring SL to the node N2. Specifically, the potential of the wiring GL is controlled to turn on the transistor 215, whereby the potential of the wiring SL is supplied to the node N2 and is written to the pixel 51. Then, the potential of the wiring GL is controlled to turn off the transistor 215, whereby the potential of the node N2 is held.

The amount of current flowing between the source and the drain of the transistor 217 is controlled in accordance with the potential of the node N2. The light-emitting element 218 emits light with a luminance corresponding to the amount of flowing current. Accordingly, the gray level of the pixel 51 can be controlled.

The operation of the driver circuits 60 and 70 in writing of the pixel 51 is similar to the operation of the pixel 51 shown in FIGS. 15A to 15C.

Figure 16B:
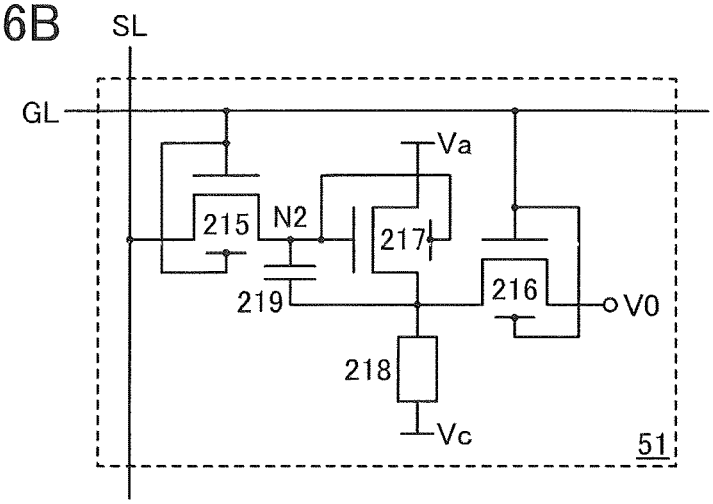
Figure 16C:
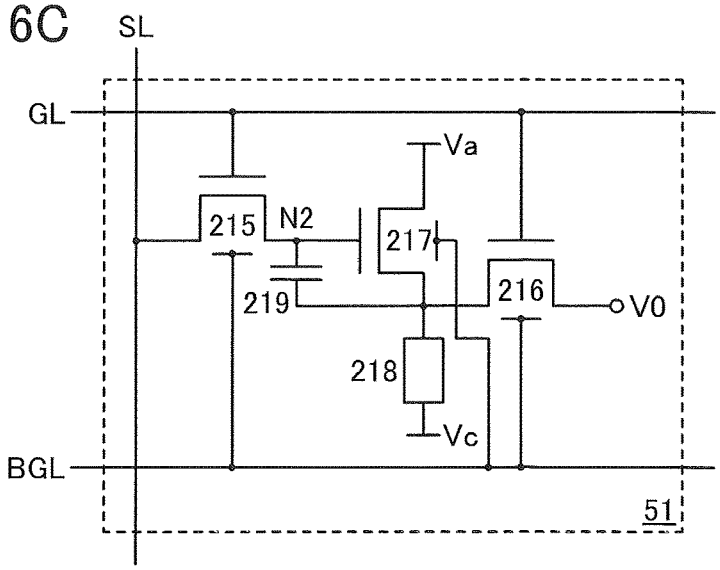

As illustrated in FIG. 16B, the transistors 215 to 217 may each include a back gate. In each of the transistors 215 to 217 illustrated in FIG. 16B, the gate is connected to the back gate. Thus, the potential of the gate is equal to the potential of the back gate. As illustrated in FIG. 16C, the back gates of the transistors 215 to 217 may be connected to the wiring BGL to which a predetermined potential is supplied.

As described above, in one embodiment of the present invention, the supply of power and a signal to the driver circuit can be stopped in a period where video rewriting is unnecessary. Thus, the power consumption of the display device 200 can be reduced.

Note that the display portion 20 illustrated in FIG. 1 may include both a liquid crystal display device and a light-emitting display device. Specifically, one of the pixels 51*a* and 51*b* may be any of the pixels 51 illustrated in FIGS. 15A to 15C, and the other may be any of the pixels 51 illustrated in FIGS. 16A to 16C. Thus, a video can be displayed using a liquid crystal element and a light-emitting element. A display device using both a liquid crystal element and a light-emitting element is also described in Embodiment 3.

This embodiment can be combined with any of the other embodiments as appropriate.

Embodiment 3

In this embodiment, another structure example of a display device which can be used for the display portion 20 is described. Specifically, a display device which has the structure illustrated in FIG. 2, includes both a reflective liquid crystal element and a light-emitting element, and can perform display in both a transmissive mode and a reflective mode is described.

In the case where the display system described in the above embodiment is used for a teaching material such as a textbook, a notebook, or the like, a character displayed on the display portion 20 is likely to be changed more frequently than a figure or an image. Higher-definition color display is likely to be required for display of a figure or an image than that required for display of a character (e.g. monochrome display). Therefore, it is preferable to use a reflective liquid crystal element described below for the pixel 51*a* which is used for displaying a character (see FIG. 1, FIG. 2, and FIG. 3A) and to use a light-emitting element described below for the pixel 51*b* which is used for displaying a figure or an image (see FIG. 1, FIG. 2, and FIG. 3B). Thus, character display which is changed frequently can be performed using a reflective liquid crystal element which does not need a backlight and has low power consumption, and figure display or image display can be performed using a light-emitting element which can perform high-definition color display. Accordingly, high-definition display with low power consumption can be performed.

Figure 17A:
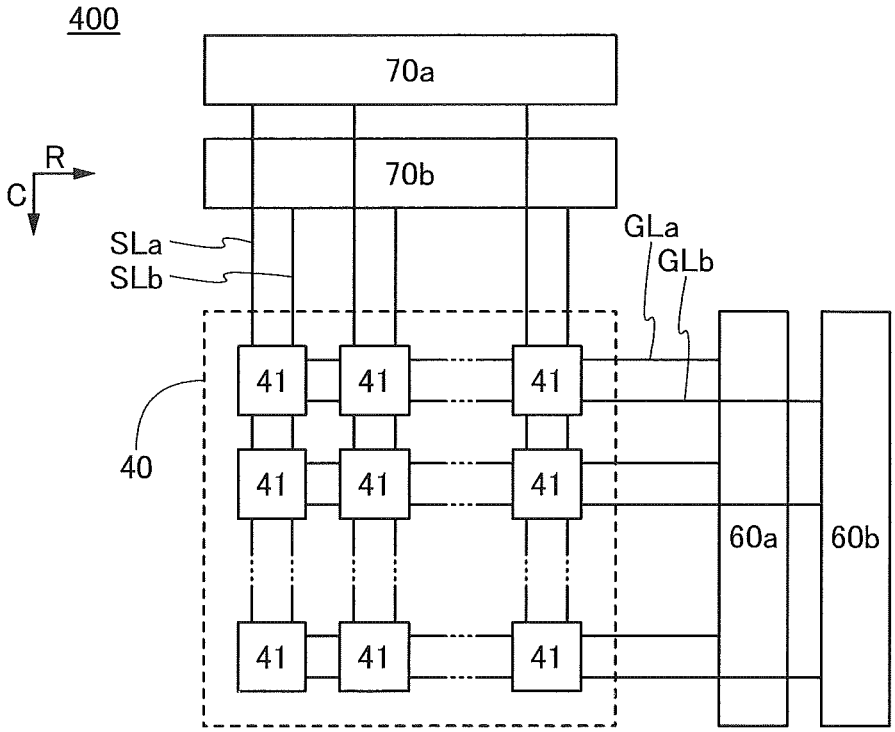
Figure 17A:
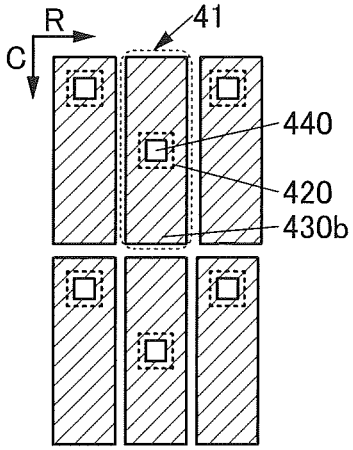
Figure 17A:
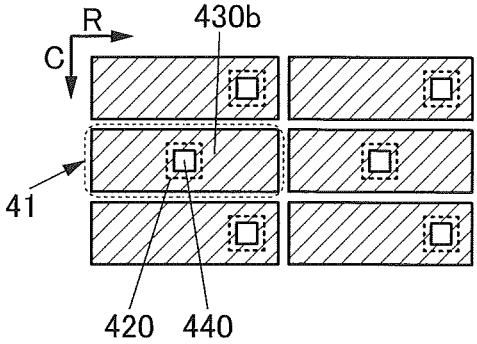

FIG. 17A is a block diagram illustrating an example of the structure of a display device 400. The display device 400 includes a plurality of pixel units 41 arranged in a matrix in the pixel portion 40. Furthermore, the display device 400 includes the driver circuits 60*a* and 60*b* and the driver circuits 70*a* and 70*b*. The display device 400 also includes a plurality of wirings GLa connected to the driver circuit 60*a* and the plurality of pixel units 41 arranged in a direction R, and a plurality of wirings GLb connected to the driver circuit 60*b* and the plurality of pixel units 41 arranged in the direction R. In addition, the display device 400 includes a plurality of wirings SLa connected to the driver circuit 70*a* and the plurality of pixel units 41 arranged in a direction C, and a plurality of wirings SLb connected to the driver circuit 70*b* and the plurality of pixel units 41 arranged in the direction C.

The pixel unit 41 includes a reflective liquid crystal element and a light-emitting element. In the pixel unit 41, the liquid crystal element and the light-emitting element partly overlap with each other.

FIG. 17B1 illustrates a structure example of a conductive layer 430*b* included in the pixel unit 41. The conductive layer 430*b* serves as a reflective electrode of the liquid crystal element in the pixel unit 41. The conductive layer 430*b* has an opening 440.

In FIG. 17B1, the light-emitting element 420 in a region overlapping with the conductive layer 430*b* is denoted by a dashed line. The light-emitting element 420 overlaps with the opening 440 included in the conductive layer 430*b*. Thus, light from the light-emitting element 420 is emitted to a display surface side through the opening 440.

In FIG. 17B1, the pixel units 41 adjacent in the direction R correspond to different emission colors. As illustrated in FIG. 17B1, the openings 440 are preferably provided in different positions in the conductive layers 430*b* so as not to be aligned in the two pixels adjacent to each other in the direction R. This allows the two light-emitting elements 420 to be apart from each other, thereby preventing light emitted from the light-emitting element 420 from entering a coloring layer in the adjacent pixel unit 41 (such a phenomenon is also referred to as "crosstalk"). Furthermore, since the two adjacent light-emitting elements 420 can be arranged apart from each other, a high-resolution display device can be obtained even when EL layers of the light-emitting elements 420 are separately formed with a shadow mask or the like.

Alternatively, arrangement illustrated in FIG. 17B2 may be employed.

If the ratio of the total area of the opening 440 to the total area except for the opening is too large, display performed using a liquid crystal element is dark. If the ratio of the total area of the opening 440 to the total area except for the opening is too small, display performed using the light-emitting element 420 is dark.

If the area of the opening 440 in the conductive layer 430*b* serving as a reflective electrode is too small, light emitted from the light-emitting element 420 is not efficiently extracted.

The shape of the opening 440 can be, for example, polygonal, quadrangular, elliptical, circular, or cross-shaped. Alternatively, the opening 440 may have a stripe shape, a slit shape, or a checkered pattern. The opening 440 may be provided close to the adjacent pixel. Preferably, the opening 440 is provided close to another pixel emitting light of the same color, in which case crosstalk can be suppressed.

<Structure Example of Circuit>

Figure 18:
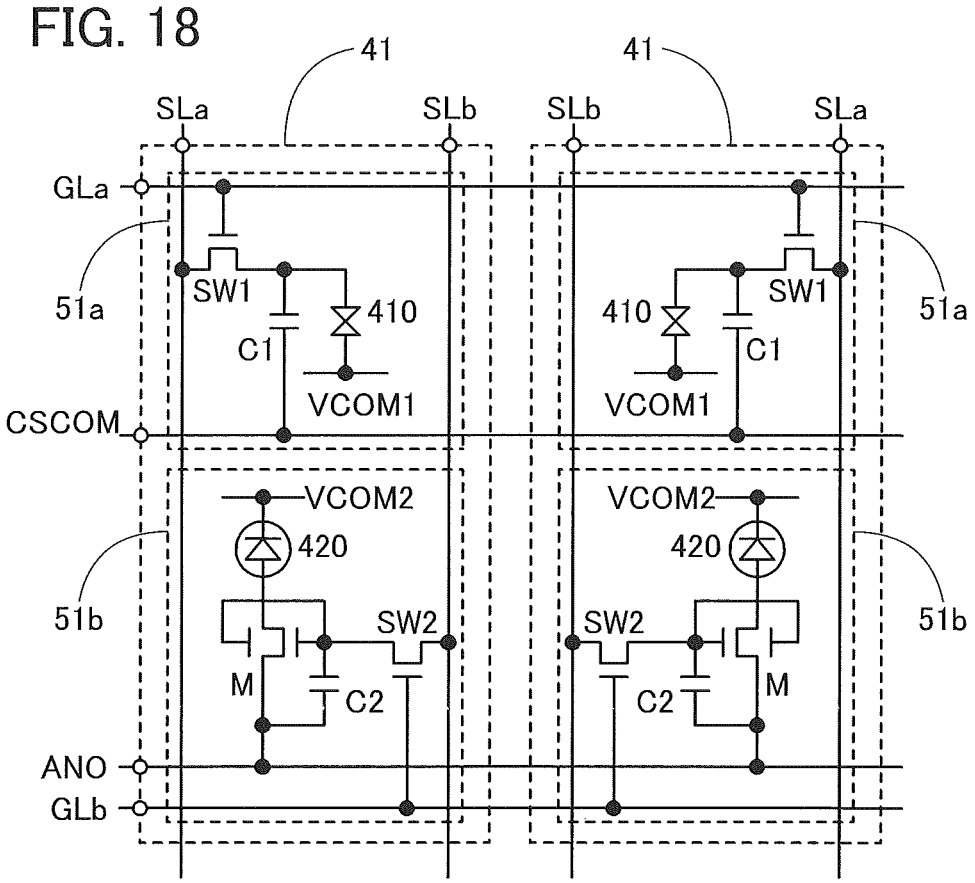
FIG. 18 illustrates a structure example of a pixel.

FIG. 18 is a circuit diagram illustrating a structure example of the pixel unit 41. FIG. 18 shows two adjacent pixel units 41. The pixel units 41 each include the pixel 51*a* and the pixel 51*b*.

The pixel 51*a* includes a switch SW1, a capacitor C1, and a liquid crystal element 410. The pixel 51*b* includes a switch SW2, a transistor M, a capacitor C2, and the light-emitting element 420. The pixel 51*a* is connected to the wiring SLa, the wiring GLa, and a wiring CSCOM. The pixel 51*b* is connected to the wiring GLb, the wiring SLb, and a wiring ANO. Note that in FIG. 18, a wiring VCOM1 connected to the liquid crystal element 410 and a wiring VCOM2 connected to the light-emitting element 420 are illustrated. FIG. 18 illustrates an example in which a transistor is used as each of the switches SW1 and SW2.

A gate of the transistor SW1 is connected to the wiring GLa. One of a source and a drain of the transistor SW1 is connected to the wiring SLa, and the other of the source and the drain is connected to one electrode of the capacitor C1 and one electrode of the liquid crystal element 410. The other electrode of the capacitor C1 is connected to the wiring CSCOM. The other electrode of the liquid crystal element 410 is connected to the wiring VCOM1.

A gate of the transistor SW2 is connected to the wiring GLb. One of a source and a drain of the transistor SW2 is connected to the wiring SLb, and the other of the source and the drain is connected to one electrode of the capacitor C2 and a gate of the transistor M. The other electrode of the capacitor C2 is connected to one of a source and a drain of the transistor M and the wiring ANO. The other of the source and the drain of the transistor M is connected to one electrode of the light-emitting element 420. Furthermore, the other electrode of the light-emitting element 420 is connected to the wiring VCOM2.

FIG. 18 illustrates an example in which the transistor M includes a pair of gates which are connected to each other. This structure can increase the amount of current flowing through the transistor M.

A predetermined potential can be supplied to each of the wirings VCOM1 and CSCOM. A potential which can generate a potential difference capable of making the light-emitting element 420 emit light can be supplied to each of the wirings VCOM2 and ANO.

In the pixel unit 41 illustrated in FIG. 18, for example, in the case where display in the reflective mode is performed, a video can be displayed by driving the pixel 51*a* with the signals supplied to the wirings GLa and SLa and utilizing the optical modulation of the liquid crystal element 410. In the case where display is performed in the transmissive mode, a video can be displayed by driving the pixel 51*b* with the signals supplied to the wirings GLb and SLb and making the light-emitting element 420 emit light. In the case where driving is performed in both of the modes, the pixels 51*a* and 51*b* can be driven with the signals supplied to the wirings GLa, GLb, SLa, and SLb.

Figure 19A:
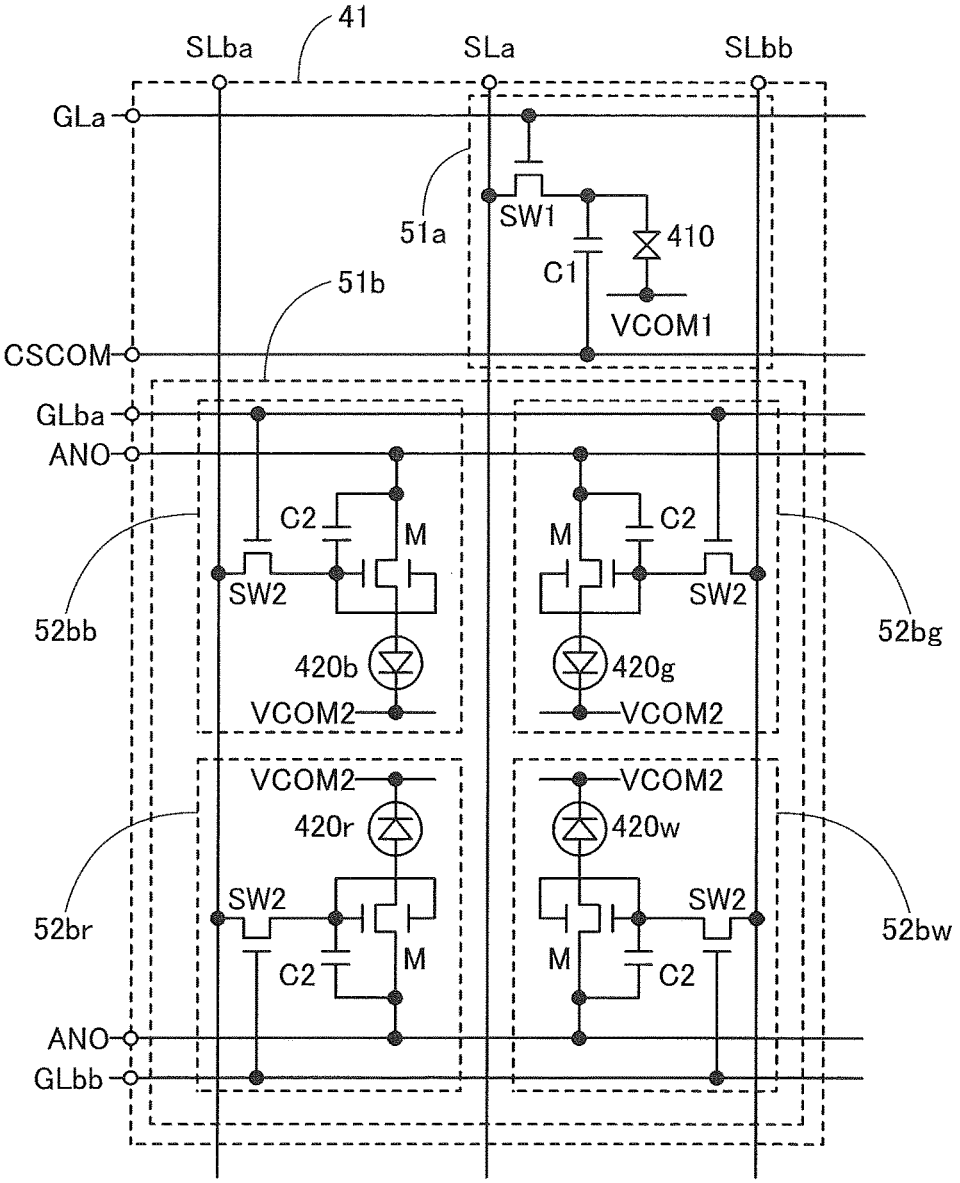
FIGS. 19A and 19B illustrate a structure example of a pixel.

Although FIG. 18 illustrates an example in which one liquid crystal element 410 and one light-emitting element 420 are provided in one pixel unit 41, one embodiment of the present invention is not limited thereto. For example, as illustrated in FIG. 19A, the pixel 51*b* may include a plurality of subpixels 52*b* (52*br*, 52*bg*, 52*bb*, and 52*bw*). The subpixels 52*br*, 52*bg*, 52*bb*, and 52*bw* includes light-emitting elements 420*r*, 420*g*, 420*b*, and 420*w*, respectively. The pixel unit 41 in FIG. 19A is capable of full color display by one pixel unit, which is different from the pixel unit in FIG. 18.

In FIG. 19A, the pixel 51*b* is connected to wirings GLba, GLbb, SLba, and SLbb.

In the example illustrated in FIG. 19A, for example, light-emitting elements which exhibit red (R), green (G), blue (B), and white (W) can be used as the four light-emitting elements 420. Furthermore, as the liquid crystal element 410, a reflective liquid crystal element which exhibits white can be used. Thus, in the case of performing display in the reflective mode, white display with high reflectivity can be performed. In the case of performing display in the transmissive mode, images can be displayed with a higher color rendering property at low power consumption.

Figure 19B:
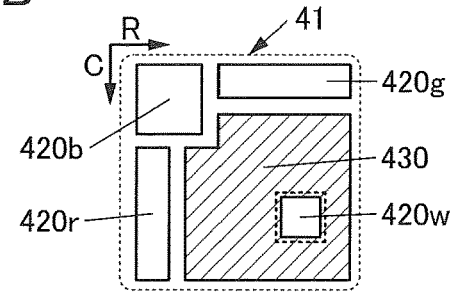

FIG. 19B illustrates a structure example of the pixel unit 41. The pixel unit 41 includes the light-emitting element 420*w* overlapping with an opening of a conductive layer 430; and the light-emitting element 420*r*, the light-emitting element 420*g*, and the light-emitting element 420*b* which are provided around the conductive layer 430. It is preferable that the light-emitting elements 420*r*, 420*g*, and 420*b* have almost the same light-emitting area.

In FIG. 18 and FIG. 19A, when the data SDa and the data SDb described in the above embodiments are supplied to the pixel 51*a* and the pixel 51*b*, respectively, a character can be displayed using the pixel 51*a*, and a figure or an image can be displayed using the pixel 51*b*. Thus, a video including a character and a figure or an image can be displayed on the pixel portion 40.

<Structure Example of Display Device>

Figure 20:
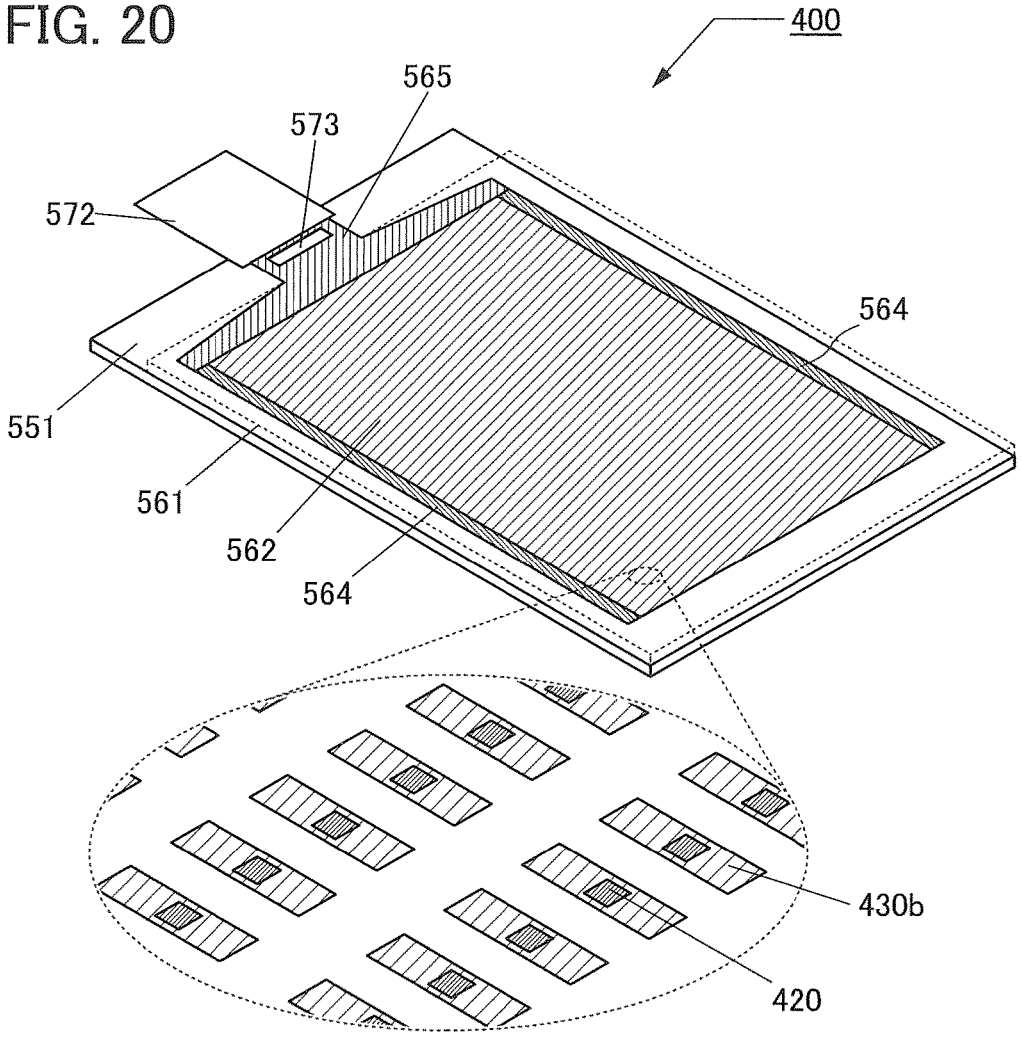
FIG. 20 illustrates a structure example of a display device.

FIG. 20 is a schematic perspective view illustrating the display device 400 of one embodiment of the present invention. In the display device 400, a substrate 551 and a substrate 561 are attached to each other. In FIG. 20, the substrate 561 is denoted by a dashed line.

The display device 400 includes a display portion 562, circuits 564, a wiring 565, and the like. The substrate 551 is provided with the circuit 564, the wiring 565, a conductive layer 430*b* which serves as a pixel electrode, and the like. In FIG. 20, an IC 573 and an FPC 572 are mounted on the substrate 551. Thus, the structure illustrated in FIG. 20 can be referred to as a display module including the display device 400, the FPC 572, and the IC 573.

As each of the circuits 564, for example, a circuit serving as the driver circuit 70 can be used.

The wiring 565 has a function of supplying a signal or electric power to the display portion 562 or the circuit 564. The signal or electric power is input to the wiring 565 from the outside through the FPC 572 or from the IC 573.

FIG. 20 shows an example in which the IC 573 is provided on the substrate 551 by a chip on glass (COG) method or the like. As the IC 573, an IC functioning as the driver circuit 60 or 70, or the like can be used. Note that it is possible that the IC 573 is not provided when, for example, the display device 400 includes circuits serving as the driver circuit 60 or 70 and when the circuits serving as the driver circuit 60 or 70 are provided outside and a signal for driving the display panel 400 is input through the FPC 572. Alternatively, the IC 573 may be mounted on the FPC 572 by a chip on film (COF) method or the like.

FIG. 20 also shows an enlarged view of part of the display portion 562. The conductive layers 430*b* included in a plurality of display elements are arranged in a matrix in the display portion 562. The conductive layer 430*b* has a function of reflecting visible light and serves as a reflective electrode of the liquid crystal element 410 described later.

As illustrated in FIG. 20, the conductive layer 430*b* has an opening. The light-emitting element 420 is provided on the substrate 551 side of the conductor layer 430*b*. Light is emitted from the light-emitting element 420 to the substrate 561 side through the opening in the conductive layer 430*b*.

Figure 21:
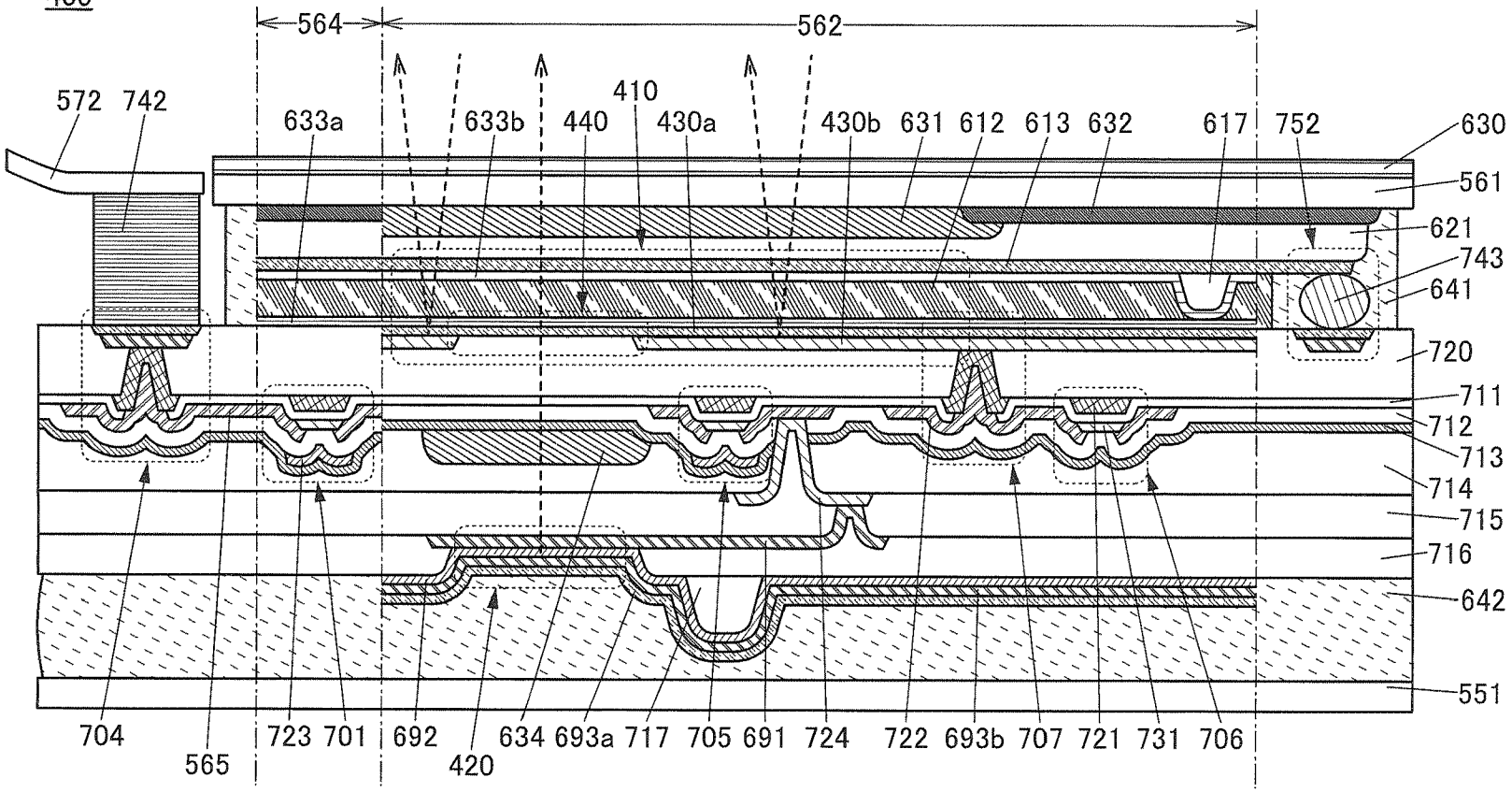
FIG. 21 illustrates a structure example of a display device.

FIG. 21 shows an example of cross sections of part of a region including the FPC 572, part of a region including the circuit 564, and part of a region including the display portion 562 of the display device illustrated in FIG. 20.

The display device 400 includes an insulating layer 720 between the substrates 551 and 561. The display panel also includes the light-emitting element 420, a transistor 701, a transistor 705, a transistor 706, a coloring layer 634, and the like between the substrate 551 and the insulating layer 720. Furthermore, the display device 400 includes the liquid crystal element 410, the coloring layer 631 and the like between the insulating layer 720 and the substrate 561. The substrate 561 and the insulating layer 720 are bonded with the adhesive layer 641. The substrate 551 and the insulating layer 720 are bonded with an adhesive layer 642.

The transistor 706 is connected to the liquid crystal element 410 and the transistor 705 is connected to the light-emitting element 420. Since the transistors 705 and 706 are formed on a surface of the insulating layer 720 which is on the substrate 551 side, the transistors 705 and 706 can be formed through the same process.

The coloring layer 631, a light-blocking layer 632, an insulating layer 621, and a conductive layer 613 serving as a common electrode of the liquid crystal element 410, an alignment film 633*b*, an insulating layer 617, and the like are provided over the substrate 561. The insulating layer 617 serves as a spacer for holding a cell gap of the liquid crystal element 410.

Insulating layers such as an insulating layer 711, an insulating layer 712, an insulating layer 713, an insulating layer 714, an insulating layer 715, an insulating layer 716, and the like are provided on the substrate 551 side of the insulating layer 720. Part of the insulating layer 711 functions as a gate insulating layer of each transistor. The insulating layer 712, the insulating layer 713, and the insulating layer 714 are provided to cover each transistor. The insulating layer 716 is provided to cover the insulating layer 714. The insulating layers 714 and 716 each function as a planarization layer. Note that an example where the three insulating layers, the insulating layers 712, 713, and 714, are provided to cover the transistors and the like is described here; however, one embodiment of the present invention is not limited to this example, and four or more insulating layers, a single insulating layer, or two insulating layers may be provided. The insulating layer 714 functioning as a planarization layer is not necessarily provided when not needed.

The transistors 701, 705, and 706 each include a conductive layer 721 part of which functions as a gate, conductive layers 722 part of which functions as a source and a drain, and a semiconductor layer 731. Here, a plurality of layers obtained by processing the same conductive film are shown with the same hatching pattern.

The liquid crystal element 410 is a reflective liquid crystal element. The liquid crystal element 410 has a stacked structure of a conductive layer 430*a*, liquid crystal 612, and a conductive layer 613. A conductive layer 430*b* which reflects visible light is provided in contact with the surface of the conductive layer 430*a* that faces the substrate 551. The conductive layer 430*b* includes an opening 440. The conductive layers 430*a* and 613 contain a material transmitting visible light. In addition, an alignment film 633*a* is provided between the liquid crystal 612 and the conductive layer 430*a* and an alignment film 633*b* is provided between the liquid crystal 612 and the conductive layer 613. A polarizing plate 630 is provided on an outer surface of the substrate 561.

In the liquid crystal element 410, the conductive layer 430*b* has a function of reflecting visible light, and the conductive layer 613 has a function of transmitting visible light. Light entering from the substrate 561 side is polarized by the polarizing plate 630, passes through the conductive layer 613 and the liquid crystal 612, and is reflected by the conductive layer 430*b*. Then, the light passes through the liquid crystal 612 and the conductive layer 613 again and reaches the polarizing plate 630. In this case, alignment of the liquid crystal is controlled with a voltage that is applied between the conductive layer 430*b* and the conductive layer 613, and thus optical modulation of light can be controlled. That is, the intensity of light emitted through the polarizing plate 630 can be controlled. Light other than one in a particular wavelength region of the light is absorbed by the coloring layer 631, and thus, emitted light is red light, for example.

The light-emitting element 420 is a bottom-emission light-emitting element. The light-emitting element 420 has a structure in which a conductive layer 691, an EL layer 692, and a conductive layer 693*b* are stacked in this order from the insulating layer 720 side. In addition, a conductive layer 693*a* is provided to cover the conductive layer 693*b*. The conductive layer 693*b* contains a material reflecting visible light, and the conductive layers 691 and 693*a* contain a material transmitting visible light. Light is emitted from the light-emitting element 420 to the substrate 561 side through the coloring layer 634, the insulating layer 720, the opening 440, the conductive layer 613, and the like.

Here, as illustrated in FIG. 21, the conductive layer 430*a* transmitting visible light is preferably provided for the opening 440. Accordingly, the liquid crystal 612 is aligned in a region overlapping with the opening 440 as well as in the other regions, in which case an alignment defect of the liquid crystal is prevented from being generated in the boundary portion of these regions and undesired light leakage can be suppressed.

As the polarizing plate 630 provided on an outer surface of the substrate 561, a linear polarizing plate or a circularly polarizing plate can be used. An example of a circularly polarizing plate is a stack including a linear polarizing plate and a quarter-wave retardation plate. Such a structure can reduce reflection of external light. The cell gap, alignment, drive voltage, and the like of the liquid crystal element used as the liquid crystal element 410 are controlled depending on the kind of the polarizing plate so that desirable contrast is obtained.

An insulating layer 717 is provided on the insulating layer 716 covering an end portion of the conductive layer 691. The insulating layer 717 has a function as a spacer for preventing the insulating layer 720 and the substrate 551 from getting closer more than necessary. In addition, in the case where the EL layer 692 or the conductive layer 693*a* is formed using a blocking mask (metal mask), the insulating layer 717 may have a function of preventing the blocking mask from being in contact with a surface on which the EL layer 692 or the conductive layer 693*a* is formed. Note that the insulating layer 717 is not necessarily provided.

One of a source and a drain of the transistor 705 is connected to the conductive layer 691 of the light-emitting element 420 through a conductive layer 724.

One of a source and a drain of the transistor 706 is connected to the conductive layer 430*b* through a connection portion 707. The conductive layers 430*b* and 430*a* are in contact with and connected to each other. Here, in the connection portion 707, the conductive layers provided on both surfaces of the insulating layer 720 are connected to each other through openings in the insulating layer 720.

The connection portion 704 is provided in a region where the substrates 551 and 561 do not overlap with each other. The connection portion 704 has a structure similar to that of the connection portion 707. On the top surface of the connection portion 704, a conductive layer obtained by processing the same conductive film as the conductive layer 430*a* is exposed. Thus, the connection portion 704 and the FPC 572 can be connected to each other through the connection layer 742.

A connection portion 752 is provided in part of a region where the adhesive layer 641 is provided. In the connection portion 752, the conductive layer obtained by processing the same conductive film as the conductive layer 430*a* is connected to part of the conductive layer 613 with a connector 743. Accordingly, a signal or a potential input from the FPC 572 connected to the substrate 551 side can be supplied to the conductive layer 613 formed on the substrate 561 side through the connection portion 752.

As the connector 743, a conductive particle can be used, for example. As the conductive particle, a particle of an organic resin, silica, or the like coated with a metal material can be used. It is preferable to use nickel or gold as the metal material because contact resistance can be decreased. It is also preferable to use a particle coated with layers of two or more kinds of metal materials, such as a particle coated with nickel and further with gold. As the connector 743, a material capable of elastic deformation or plastic deformation is preferably used. As illustrated in FIG. 21, the connector 743 which is the conductive particle has a shape that is vertically crushed in some cases. With the crushed shape, the contact area between the connector 743 and a conductive layer electrically connected to the connector 743 can be increased, thereby reducing contact resistance and suppressing the generation of problems such as disconnection.

The connector 743 is preferably provided so as to be covered with the adhesive layer 641. For example, the connectors 743 are dispersed in the adhesive layer 641 before curing of the adhesive layer 641.

FIG. 21 illustrates an example of the circuit 564 in which the transistor 701 is provided.

The structure in which the semiconductor layer 731 where a channel is formed is provided between a pair of gates is used as an example of the transistors 701 and 705 in FIG. 21. One gate is formed by the conductive layer 721 and the other gate is formed by a conductive layer 723 overlapping with the semiconductor layer 731 with the insulating layer 712 provided therebetween. Such a structure enables control of threshold voltages of transistors. In that case, the two gate electrodes may be connected to each other and supplied with the same signal to operate the transistors. Such transistors can have higher field-effect mobility and thus have higher on-state current than other transistors. Consequently, a circuit capable of high-speed operation can be obtained. Furthermore, the area occupied by a circuit portion can be reduced. The use of the transistor having high on-state current can reduce signal delay in wirings and can reduce display unevenness even in a display device in which the number of wirings is increased because of increase in size or definition.

Note that the transistor included in the circuit 564 and the transistor included in the display portion 562 may have the same structure. A plurality of transistors included in the circuit 564 may have the same structure or different structures. A plurality of transistors included in the display portion 562 may have the same structure or different structures.

A material through which impurities such as water or hydrogen do not easily diffuse is preferably used for at least one of the insulating layers 712 and 713 which cover the transistors. That is, the insulating layer 712 or the insulating layer 713 can function as a barrier film. Such a structure can effectively suppress diffusion of the impurities into the transistors from the outside, and a highly reliable display device can be provided.

The insulating layer 621 is provided on the substrate 561 side to cover the coloring layer 631 and the light-blocking layer 632. The insulating layer 621 may have a function of a planarization layer. The insulating layer 621 enables the conductive layer 613 to have an almost flat surface, resulting in a uniform alignment state of the liquid crystal 612.

An example of the method for manufacturing the display device 400 is described. For example, the conductive layer 430*a*, the conductive layer 430*b*, and the insulating layer 720 are formed in order over a support substrate provided with a separation layer, and the transistor 705, the transistor 706, the light-emitting element 420, and the like are formed. Then, the substrate 551 and the support substrate are bonded with the adhesive layer 642. After that, separation is performed at the interface between the separation layer and each of the insulating layer 720 and the conductive layer 430*a*, whereby the support substrate and the separation layer are removed. Separately, the coloring layer 631, the light-blocking layer 632, the conductive layer 613, and the like are formed over the substrate 561 in advance. Then, the liquid crystal 612 is dropped onto the substrate 551 or 561 and the substrates 551 and 561 are bonded with the adhesive layer 641, whereby the display device 400 can be manufactured.

A material for the separation layer can be selected such that separation at the interface with the insulating layer 720 and the conductive layer 430*a* occurs. In particular, it is preferable that a stacked layer of a layer including a high-melting-point metal material, such as tungsten, and a layer including an oxide of the metal material be used as the separation layer, and a stacked layer of a plurality of layers, such as a silicon nitride layer, a silicon oxynitride layer, and a silicon nitride oxide layer be used as the insulating layer 720 over the separation layer. The use of the high-melting-point metal material for the separation layer can increase the formation temperature of a layer formed in a later step, which reduces impurity concentration and achieves a highly reliable display device.

As the conductive layer 430*a*, an oxide or a nitride such as a metal oxide, a metal nitride, or an oxide such as an oxide semiconductor whose resistance is reduced is preferably used. In the case of using an oxide semiconductor, a material in which at least one of the concentrations of hydrogen, boron, phosphorus, nitrogen, and other impurities and the number of oxygen vacancies is made to be higher than those in a semiconductor layer of a transistor is used for the conductive layer 430*a*.

The above components will be described below.

[Substrate]

A material having a flat surface can be used as the substrate included in the display device. The substrate on the side from which light from the display element is extracted is formed using a material transmitting the light. For example, a material such as glass, quartz, ceramics, sapphire, or an organic resin can be used.

The weight and thickness of the display device can be decreased by using a thin substrate. A flexible display device can be obtained by using a substrate that is thin enough to have flexibility.

Since the substrate through which light emission is not extracted does not need to have a light-transmitting property, a metal substrate or the like can be used in addition to the above-mentioned substrates. A metal material, which has high thermal conductivity, is preferable because it can easily conduct heat to the whole substrate and accordingly can prevent a local temperature rise in the display device. To obtain flexibility and bendability, the thickness of a metal substrate is preferably greater than or equal to 10 μm and less than or equal to 200 μm, further preferably greater than or equal to 20 μm and less than or equal to 50 μm.

Although there is no particular limitation on a material of a metal substrate, it is favorable to use, for example, a metal such as aluminum, copper, and nickel, an aluminum alloy, or an alloy such as stainless steel.

It is preferable to use a substrate subjected to insulation treatment, e.g., a metal substrate whose surface is oxidized or provided with an insulating film. An insulating film may be formed by, for example, a coating method such as a spin-coating method and a dipping method, an electrodeposition method, an evaporation method, or a sputtering method. An oxide film may be limited over the substrate surface by an anodic oxidation method, exposing to or heating in an oxygen atmosphere, or the like.

Examples of the material that has flexibility and transmits visible light include glass that is thin enough to have flexibility, polyester resins such as polyethylene terephthalate (PET) and polyethylene naphthalate (PEN), a polyacrylonitrile resin, a polyimide resin, a polymethyl methacrylate resin, a polycarbonate (PC) resin, a polyethersulfone (PES) resin, a polyamide resin, a cycloolefin resin, a polystyrene resin, a polyamide imide resin, a polyvinyl chloride resin, and a polytetrafluoroethylene (PTFE). It is particularly preferable to use a material with a low thermal expansion coefficient, for example, a material with a thermal expansion coefficient lower than or equal to $30\times10^{-6}$/K, such as a polyamide imide resin, a polyimide resin, or PET. A substrate in which a glass fiber is impregnated with an organic resin or a substrate whose thermal expansion coefficient is reduced by mixing an inorganic filler with an organic resin can also be used. A substrate using such a material is lightweight, and thus a display device using this substrate can also be lightweight.

In the case where a fibrous body is included in the above material, a high-strength fiber of an organic compound or an inorganic compound is used as the fibrous body. The high-strength fiber is specifically a fiber with a high tensile elastic modulus or a fiber with a high Young's modulus. Typical examples thereof include a polyvinyl alcohol based fiber, a polyester based fiber, a polyamide based fiber, a polyethylene based fiber, an aramid based fiber, a polyparaphenylene benzobisoxazole fiber, a glass fiber, and a carbon fiber. As the glass fiber, glass fiber using E glass, S glass, D glass, Q glass, or the like can be used. These fibers may be used in a state of a woven or nonwoven fabric, and a structure body in which this fibrous body is impregnated with a resin and the resin is cured may be used as the flexible substrate. The structure body including the fibrous body and the resin is preferably used as the flexible substrate, in which case the reliability against bending or breaking due to local pressure can be increased.

Alternatively, glass, metal, or the like that is thin enough to have flexibility can be used as the substrate. Alternatively, a composite material where glass and a resin material are attached to each other with an adhesive layer may be used.

A hard coat layer (e.g., a silicon nitride layer and an aluminum oxide layer) by which a surface of a display device is protected from damage, a layer (e.g., an aramid resin layer) that can disperse pressure, or the like may be stacked over the flexible substrate. Furthermore, to suppress a decrease in the lifetime of the display element due to moisture and the like, an insulating film with low water permeability may be stacked over the flexible substrate. For example, an inorganic insulating material such as silicon nitride, silicon oxynitride, silicon nitride oxide, aluminum oxide, or aluminum nitride can be used.

The substrate may be formed by stacking a plurality of layers. When a glass layer is used, a barrier property against water and oxygen can be improved and thus a highly reliable display device can be provided.

[Transistor]

The transistor includes a conductive layer serving as the gate electrode, the semiconductor layer, a conductive layer serving as the source electrode, a conductive layer serving as the drain electrode, and an insulating layer serving as the gate insulating layer. In the above, a bottom-gate transistor is used.

Note that there is no particular limitation on the structure of the transistor included in the display device of one embodiment of the present invention. For example, a planar transistor, a staggered transistor, or an inverted staggered transistor may be used. A top-gate transistor or a bottom-gate transistor may be used. Gate electrodes may be provided above and below a channel.

There is no particular limitation on the crystallinity of a semiconductor material used for the transistors, and an amorphous semiconductor or a semiconductor having crystallinity (a microcrystalline semiconductor, a polycrystalline semiconductor, a single-crystal semiconductor, or a semiconductor partly including crystal regions) may be used. It is preferable that a semiconductor having crystallinity be used, in which case deterioration of the transistor characteristics can be suppressed.

As a semiconductor material used for the transistor, an element of Group 14 (e.g., silicon or germanium), a compound semiconductor, or an oxide semiconductor can be used, for example. Typically, a semiconductor containing silicon, a semiconductor containing gallium arsenide, an oxide semiconductor containing indium, or the like can be used.

In particular, an oxide semiconductor having a wider band gap than silicon is preferably used. A semiconductor material having a wider band gap and a lower carrier density than silicon is preferably used because the off-state leakage current of the transistor can be reduced.

In a transistor with an oxide semiconductor whose band gap is larger than the band gap of silicon, charges stored in a capacitor that is connected in series to the transistor can be held for a long time, owing to the low off-state current of the transistor. Accordingly, when such a transistor is used for a pixel, operation of a driver circuit can be stopped while a gray scale of an image displayed in each display region is maintained. As a result, a display device with extremely low power consumption can be obtained.

The semiconductor layer preferably includes, for example, a film represented by an In-M-Zn-based oxide that contains at least indium, zinc, and M (a metal such as aluminum, titanium, gallium, germanium, yttrium, zirconium, lanthanum, cerium, tin, neodymium, or hafnium). In order to reduce variations in electrical characteristics of the transistor including the oxide semiconductor, the oxide semiconductor preferably contains a stabilizer in addition to indium, zinc, and M.

Examples of the stabilizer, including metals that can be used as M, are gallium, tin, hafnium, aluminum, and zirconium. As another stabilizer, lanthanoid such as lanthanum, cerium, praseodymium, neodymium, samarium, europium, gadolinium, terbium, dysprosium, holmium, erbium, thulium, ytterbium, or lutetium can be given.

As an oxide semiconductor included in the semiconductor layer, any of the following can be used, for example: an In—Ga—Zn-based oxide, an In—Al—Zn-based oxide, an In—Sn—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, and an In—Hf—Al—Zn-based oxide.

Note that here, an "In—Ga—Zn-based oxide" means an oxide containing In, Ga, and Zn as its main components, and there is no limitation on the ratio of In:Ga:Zn. The In—Ga—Zn-based oxide may contain another metal element in addition to In, Ga, and Zn.

The semiconductor layer and the conductive layer may include the same metal elements contained in the above oxides. The use of the same metal elements for the semiconductor layer and the conductive layer can reduce the manufacturing cost. For example, when metal oxide targets with the same metal composition are used, the manufacturing cost can be reduced, and the same etching gas or the same etchant can be used in processing the semiconductor layer and the conductive layer. Note that even when the semiconductor layer and the conductive layer include the same metal elements, they have different compositions in some cases. For example, a metal element in a film is released during the manufacturing process of the transistor and the capacitor, which might result in different metal compositions.

The energy gap of the oxide semiconductor contained in the semiconductor layer is preferably 2 eV or more, further preferably 2.5 eV or more, and still further preferably 3 eV or more. With the use of an oxide semiconductor having such a wide energy gap, the off-state current of the transistor can be reduced.

In the case where the oxide semiconductor contained in the semiconductor layer contains an In-M-Zn oxide, it is preferable that the atomic ratio of metal elements of a sputtering target used for forming a film of the In-M-Zn oxide satisfy In≥M and Zn≥M. As the atomic ratio of metal elements of such a sputtering target, In:M:Zn=1:1:1, In:M:Zn=1:1:1.2, In:M:Zn=3:1:2, In:M:Zn=4:2:4.1 and the like are preferable. Note that the atomic ratio of metal elements in the formed semiconductor layer varies from the above atomic ratio of metal elements of the sputtering target within a range of ±40% as an error.

An oxide semiconductor film with low carrier density is used as the semiconductor layer. For example, the semiconductor layer is an oxide semiconductor film whose carrier density is lower than or equal to $1\times10^{17}/cm^3$, preferably lower than or equal to $1\times10^{15}/cm^3$, further preferably lower than or equal to $1\times10^{13}/cm^3$, still further preferably lower than or equal to $1\times10^{11}/cm^3$, even further preferably lower than $1\times10^{10}/cm^3$, and higher than or equal to $1\times10^{-9}/cm^3$. Such an oxide semiconductor is referred to as a highly purified intrinsic or substantially highly purified intrinsic oxide semiconductor. The oxide semiconductor has a low impurity concentration and a low density of defect states and can thus be referred to as an oxide semiconductor having stable characteristics.

Note that, without limitation to those described above, a material with an appropriate composition may be used depending on required semiconductor characteristics and electrical characteristics (e.g., field-effect mobility and threshold voltage) of a transistor. To obtain the required semiconductor characteristics of the transistor; it is preferable that the carrier density, the impurity concentration, the defect density, the atomic ratio between a metal element and oxygen, the interatomic distance, the density, and the like of the semiconductor layer be set to appropriate values.

When silicon or carbon that is one of elements belonging to Group 14 is contained in the oxide semiconductor contained in the semiconductor layer, oxygen vacancies are increased in the semiconductor layer, and the semiconductor layer becomes n-type. Thus, the concentration of silicon or carbon (measured by secondary ion mass spectrometry) in the semiconductor layer is lower than or equal to $2\times10^{18}$ atoms/$cm^3$, preferably lower than or equal to $2\times10^{17}$ atoms/$cm^3$.

Alkali metal and alkaline earth metal might generate carriers when bonded to an oxide semiconductor, in which case the off-state current of the transistor might be increased. Therefore, the concentration of alkali metal or alkaline earth metal of the semiconductor layer, which is measured by secondary ion mass spectrometry, is lower than or equal to $1\times10^{18}$ atoms/$cm^3$, preferably lower than or equal to $2\times10^{16}$ atoms/$cm^3$.

When nitrogen is contained in the oxide semiconductor contained in the semiconductor layer, electrons serving as carriers are generated and the carrier density increases, so that the semiconductor layer easily becomes n-type. Thus, a transistor including an oxide semiconductor which contains nitrogen is likely to be normally on. Hence, the concentration of nitrogen which is measured by secondary ion mass spectrometry is preferably set to lower than or equal to $5\times10^{18}$ atoms/$cm^3$.

The semiconductor layer may have a non-single-crystal structure, for example. The non-single-crystal structure includes a polycrystalline structure, a microcrystalline structure, or an amorphous structure, for example. Among the non-single-crystal structures, an amorphous structure has the highest density of defect states.

An oxide semiconductor film having an amorphous structure has disordered atomic arrangement and no crystalline component, for example. Alternatively, an oxide film having an amorphous structure has, for example, an absolutely amorphous structure and no crystal part.

Note that the semiconductor layer may be a mixed film including two or more of the following: a region having an amorphous structure, a region having a microcrystalline structure, a region having a polycrystalline structure, and a region having a single-crystal structure. The mixed film has, for example, a single-layer structure or a stacked-layer structure including two or more of the above-described regions in some cases.

Alternatively, silicon is preferably used as a semiconductor in which a channel of a transistor is formed. Although amorphous silicon may be used as silicon, silicon having crystallinity is particularly preferable. For example, microcrystalline silicon, polycrystalline silicon, single-crystal silicon, or the like is preferably used. In particular, polycrystalline silicon can be formed at a lower temperature than single-crystal silicon and has higher field effect mobility and higher reliability than amorphous silicon. When such a polycrystalline semiconductor is used for a pixel, the aperture ratio of the pixel can be improved. Even in the case where the display portion with extremely high definition is provided, a gate driver circuit and a source driver circuit can be formed over a substrate over which the pixels are formed, and the number of components of an electronic device can be reduced.

The bottom-gate transistor described in this embodiment is preferable because the number of manufacturing steps can be reduced. When amorphous silicon, which can be formed at a lower temperature than polycrystalline silicon, is used for the semiconductor layer, materials with low heat resistance can be used for a wiring, an electrode, or a substrate below the semiconductor layer, resulting in wider choice of materials. For example, an extremely large glass substrate can be favorably used. Meanwhile, the top-gate transistor is preferable because an impurity region is easily formed in a self-aligned manner and variation in characteristics can be reduced. In that case, the use of polycrystalline silicon, single-crystal silicon, or the like is particularly preferable.

[Conductive Layer]

As materials for a gate, a source, and a drain of a transistor, and a wiring or an electrode included in a display device, any of metals such as aluminum, titanium, chromium, nickel, copper, yttrium, zirconium, molybdenum, silver, tantalum, and tungsten, or an alloy containing any of these metals as its main component can be used. A single-layer structure or multi-layer structure including a film containing any of these materials can be used. For example, the following structures can be given: a single-layer structure of an aluminum film containing silicon, a two-layer structure in which an aluminum film is stacked over a titanium film, a two-layer structure in which an aluminum film is stacked over a tungsten film, a two-layer structure in which a copper film is stacked over a copper-magnesium-aluminum alloy film, a two-layer structure in which a copper film is stacked over a titanium film, a two-layer structure in which a copper film is stacked over a tungsten film, a three-layer structure in which a titanium film or a titanium nitride film, an aluminum film or a copper film, and a titanium film or a titanium nitride film are stacked in this order, and a three-layer structure in which a molybdenum film or a molybdenum nitride film, an aluminum film or a copper film, and a molybdenum film or a molybdenum nitride film are stacked in this order. Note that an oxide such as indium oxide, tin oxide, or zinc oxide may be used. Copper containing manganese is preferably used because controllability of a shape by etching is increased.

As a light-transmitting conductive material, a conductive oxide such as indium oxide, indium tin oxide, indium zinc oxide, zinc oxide, or zinc oxide to which gallium is added, or graphene can be used. Alternatively, a metal material such as gold, silver, platinum, magnesium, nickel, tungsten, chromium, molybdenum, iron, cobalt, copper, palladium, or titanium, or an alloy material containing any of these metal materials can be used. Alternatively, a nitride of the metal material (e.g., titanium nitride) or the like may be used. In the case of using the metal material or the alloy material (or the nitride thereof), the thickness is set small enough to be able to transmit light. Alternatively, a stack of any of the above materials can be used as the conductive layer. For example, a stacked film of indium tin oxide and an alloy of silver and magnesium is preferably used because the conductivity can be increased. They can also be used for conductive layers such as a variety of wirings and electrodes included in a display device, and a conductive layer (e.g., a conductive layer functioning as a pixel electrode or a common electrode) included in a display element.

[Insulating Layer]

Examples of an insulating material that can be used for the insulating layers include a resin such as acrylic or epoxy resin, a resin having a siloxane bond such as silicone, and an inorganic insulating material such as silicon oxide, silicon oxynitride, silicon nitride oxide, silicon nitride, or aluminum oxide.

The light-emitting element is preferably provided between a pair of insulating films with low water permeability, in which case impurities such as water can be prevented from entering the light-emitting element. Thus, a decrease in device reliability can be prevented.

As an insulating film with low water permeability, a film containing nitrogen and silicon (e.g., a silicon nitride film or a silicon nitride oxide film), a film containing nitrogen and aluminum (e.g., an aluminum nitride film), or the like can be used. Alternatively, a silicon oxide film, a silicon oxynitride film, an aluminum oxide film, or the like can be used.

For example, the water vapor transmittance of the insulating film with low water permeability is lower than or equal to 1 [g/m$^2$·day], preferably lower than or equal to $1\times10^{-6}$ [g/m$^2$·day], further preferably lower than or equal to $1\times10^{-7}$ [g/m$^2$·day], and still further preferably lower than or equal to $1\times10^{-8}$ [g/m$^2$·day].

[Liquid Crystal Element]

The liquid crystal element can employ, for example, a vertical alignment (VA) mode. Examples of the vertical alignment mode include a multi-domain vertical alignment (MVA) mode, a patterned vertical alignment (PVA) mode, and an advanced super view (ASV) mode.

The liquid crystal element can employ a variety of modes. For example, a liquid crystal element using, instead of a VA mode, a twisted nematic (TN) mode, an in-plane switching (IPS) mode, a fringe field switching (FFS) mode, an axially symmetric aligned micro-cell (ASM) mode, an optically compensated birefringence (OCB) mode, a ferroelectric liquid crystal (FLC) mode, an antiferroelectric liquid crystal (AFLC) mode, or the like can be used.

The liquid crystal element controls transmission or non-transmission of light utilizing an optical modulation action of liquid crystal. Note that optical modulation action of liquid crystal is controlled by an electric field applied to the liquid crystal (including a horizontal electric field, a vertical electric field, or an oblique electric field). As the liquid crystal used for the liquid crystal element, thermotropic liquid crystal, low-molecular liquid crystal, high-molecular liquid crystal, polymer dispersed liquid crystal (PDLC), ferroelectric liquid crystal, anti-ferroelectric liquid crystal, or the like can be used. These liquid crystal materials exhibit a cholesteric phase, a smectic phase, a cubic phase, a chiral nematic phase, an isotropic phase, or the like depending on conditions.

As the liquid crystal material, either of a positive liquid crystal and a negative liquid crystal may be used, and an appropriate liquid crystal material can be used depending on the mode or design to be used.

In addition, to control the alignment of the liquid crystal, an alignment film can be provided. Alternatively, when a horizontal electric field mode is employed, a liquid crystal exhibiting a blue phase for which an alignment film is unnecessary may be used. A blue phase is one of liquid crystal phases, which is generated just before a cholesteric phase changes into an isotropic phase while the temperature of cholesteric liquid crystal is increased. Since the blue phase appears only in a narrow temperature range, a liquid crystal composition in which several weight percent or more of a chiral material is mixed is used for the liquid crystal layer in order to improve the temperature range. The liquid crystal composition which includes liquid crystal exhibiting a blue phase and a chiral material has a short response time and optical isotropy. In addition, the liquid crystal composition which includes liquid crystal exhibiting a blue phase and a chiral material does not need alignment treatment and has a small viewing angle dependence. An alignment film does not need to be provided and rubbing treatment is thus not necessary; accordingly, electrostatic discharge damage caused by the rubbing treatment can be prevented and defects and damage of the liquid crystal display device in the manufacturing process can be reduced.

As the liquid crystal element, a transmissive liquid crystal element, a reflective liquid crystal element, a semi-transmissive liquid crystal element, or the like can be used. In one embodiment of the present invention, in particular, the reflective liquid crystal element is preferably used.

In the case where the transmissive or semi-transmissive liquid crystal element is used, two polarizing plates are provided so that a pair of substrates is sandwiched therebetween. A backlight is provided outside one of the polarizing plates. As the backlight, a direct-below backlight or an edge-light backlight may be used. The direct-below backlight including a light-emitting diode (LED) is preferably used because local dimming is easily performed to improve contrast. The edge-light type backlight is preferably used because the thickness of a module including the backlight can be reduced.

In the case where the reflective liquid crystal element is used, the polarizing plate is provided on the display surface side. Separately, a light diffusion plate is preferably provided on the display surface to improve visibility.

In the case where the reflective or the semi-transmissive liquid crystal element is used, a front light may be provided outside the polarizing plate. As the front light, an edge-light front light is preferably used. A front light including an LED is preferably used because power consumption can be reduced.

[Light-Emitting Element]

As the light-emitting element, a self-luminous element can be used, and an element whose luminance is controlled by current or voltage is included in the category of the light-emitting element. For example, an LED, an organic EL element, an inorganic EL element, or the like can be used.

The light-emitting element has a top emission structure, a bottom emission structure, a dual emission structure, or the like. A conductive film that transmits visible light is used as the electrode through which light is extracted. A conductive film that reflects visible light is preferably used as the electrode through which light is not extracted. In one embodiment of the present invention, in particular, a bottom-emission light-emitting element is preferably used.

The EL layer includes at least a light-emitting layer. In addition to the light-emitting layer, the EL layer may further include one or more layers containing any of a substance with a high hole-injection property, a substance with a high hole-transport property, a hole-blocking material, a substance with a high electron-transport property, a substance with a high electron-injection property, a substance with a bipolar property (a substance with a high electron- and hole-transport property), and the like.

Either a low molecular compound or a high molecular compound can be used for the EL layer, and an inorganic compound may also be used. The layers included in the EL layer can be formed by any of the following methods: an evaporation method (including a vacuum evaporation method), a transfer method, a printing method, an inkjet method, a coating method, and the like.

When a voltage higher than the threshold voltage of the light-emitting element is applied between the anode and the cathode, holes are injected to the EL layer from the anode side and electrons are injected to the EL layer from the cathode side. The injected electrons and holes are recombined in the EL layer, so that a light-emitting substance contained in the EL layer emits light.

In the case where a light-emitting element emitting white light is used as the light-emitting element, the EL layer preferably contains two or more kinds of light-emitting substances. For example, light-emitting substances are selected so that two or more light-emitting substances emit complementary colors to obtain white light emission. Specifically, it is preferable to contain two or more light-emitting substances selected from light-emitting substances emitting light of red (R), green (G), blue (B), yellow (Y), orange (O), and the like and light-emitting substances emitting light containing two or more of spectral components of R, G, and B. The light-emitting element preferably emits light with a spectrum having two or more peaks in the wavelength range of a visible light region (e.g., greater than or equal to 350 nm and less than or equal to 750 nm). An emission spectrum of a material emitting light having a peak in the wavelength range of a yellow light preferably includes spectral components also in the wavelength range of a green light and a red light.

A light-emitting layer containing a light-emitting material emitting light of one color and a light-emitting layer containing a light-emitting material emitting light of another color are preferably stacked in the EL layer. For example, the plurality of light-emitting layers in the EL layer may be stacked in contact with each other or may be stacked with a region not including any light-emitting material therebetween. For example, between a fluorescent layer and a phosphorescent layer, a region containing the same material as one in the fluorescent layer or phosphorescent layer (for example, a host material or an assist material) and no light-emitting material may be provided. This facilitates the manufacture of the light-emitting element and reduces the drive voltage.

The light-emitting element may be a single element including one EL layer or a tandem element in which a plurality of EL layers are stacked with a charge generation layer therebetween.

The conductive film that transmits visible light can be formed using, for example, indium oxide, indium tin oxide, indium zinc oxide, zinc oxide, or zinc oxide to which gallium is added. Alternatively, a film of a metal material such as gold, silver, platinum, magnesium, nickel, tungsten, chromium, molybdenum, iron, cobalt, copper, palladium, or titanium; an alloy containing any of these metal materials; or a nitride of any of these metal materials (e.g., titanium nitride) can be used when formed thin so as to have a light-transmitting property. Alternatively, a stack of any of the above materials can be used as the conductive layer. For example, a stacked film of indium tin oxide and an alloy of silver and magnesium is preferably used, in which case conductivity can be increased. Further alternatively, graphene or the like may be used.

For the conductive film that reflects visible light, for example, a metal material, such as aluminum, gold, platinum, silver, nickel, tungsten, chromium, molybdenum, iron, cobalt, copper, or palladium or an alloy including any of these metal materials can be used. Lanthanum, neodymium, germanium, or the like may be added to the metal material or the alloy. Alternatively, an alloy containing aluminum (an aluminum alloy) such as an alloy of aluminum and titanium, an alloy of aluminum and nickel, or an alloy of aluminum and neodymium may be used. Alternatively, an alloy containing silver such as an alloy of silver and copper, an alloy of silver and palladium, or an alloy of silver and magnesium may be used. An alloy of silver and copper is preferable because of its high heat resistance. Furthermore, when a metal film or a metal oxide film is stacked in contact with an aluminum film or an aluminum alloy film, oxidation can be suppressed. Examples of a material for the metal film or the metal oxide film include titanium and titanium oxide. Alternatively, the conductive film having a property of transmitting visible light and a film containing any of the above metal materials may be stacked. For example, a stack of silver and indium tin oxide, a stack of an alloy of silver and magnesium and indium tin oxide, or the like can be used.

The electrodes may be formed separately by an evaporation method or a sputtering method. Alternatively, a discharging method such as an inkjet method, a printing method such as a screen printing method, or a plating method may be used.

Note that the aforementioned light-emitting layer and layers containing a substance with a high hole-injection property, a substance with a high hole-transport property, a substance with a high electron-transport property, a substance with a high electron-injection property, and a substance with a bipolar property may include an inorganic compound such as a quantum dot or a high molecular compound (e.g., an oligomer, a dendrimer, and a polymer). For example, used for the light-emitting layer, the quantum dot can serve as a light-emitting material.

The quantum dot may be a colloidal quantum dot, an alloyed quantum dot, a core-shell quantum dot, a core quantum dot, or the like. The quantum dot containing elements belonging to Groups 12 and 16, elements belonging to Groups 13 and 15, or elements belonging to Groups 14 and 16, may be used. Alternatively, the quantum dot containing an element such as cadmium, selenium, zinc, sulfur, phosphorus, indium, tellurium, lead, gallium, arsenic, or aluminum may be used.

[Adhesive Layer]

As the adhesive layer, a variety of curable adhesives such as a reactive curable adhesive, a thermosetting adhesive, an anaerobic adhesive, and a photocurable adhesive such as an ultraviolet curable adhesive can be used. Examples of these adhesives include an epoxy resin, an acrylic resin, a silicone resin, a phenol resin, a polyimide resin, an imide resin, a polyvinyl chloride (PVC) resin, a polyvinyl butyral (PVB) resin, and an ethylene vinyl acetate (EVA) resin. In particular, a material with low moisture permeability, such as an epoxy resin, is preferred. Alternatively, a two-component-mixture-type resin may be used. Further alternatively, an adhesive sheet or the like may be used.

Furthermore, the resin may include a drying agent. For example, a substance that adsorbs moisture by chemical adsorption, such as oxide of an alkaline earth metal (e.g., calcium oxide or barium oxide), can be used. Alternatively, a substance that adsorbs moisture by physical adsorption, such as zeolite or silica gel, may be used. The drying agent is preferably included because it can prevent impurities such as moisture from entering the element, thereby improving the reliability of the display device.

In addition, it is preferable to mix a filler with a high refractive index or light-scattering member into the resin, in which case light extraction efficiency can be enhanced. For example, titanium oxide, barium oxide, zeolite, zirconium, or the like can be used.

[Connection Layer]

As the connection layers, an anisotropic conductive film (ACF), an anisotropic conductive paste (ACP), or the like can be used.

[Coloring Layer]

Examples of a material that can be used for the coloring layers include a metal material, a resin material, and a resin material containing a pigment or dye.

[Light-Blocking Layer]

Examples of a material that can be used for the light-blocking layer include carbon black, titanium black, a metal, a metal oxide, and a composite oxide containing a solid solution of a plurality of metal oxides. The light-blocking layer may be a film containing a resin material or a thin film of an inorganic material such as a metal. Stacked films containing the material of the coloring layer can also be used for the light-blocking layer. For example, a stacked-layer structure of a film containing a material of a coloring layer which transmits light of a certain color and a film containing a material of a coloring layer which transmits light of another color can be employed. It is preferable that the coloring layer and the light-blocking layer be formed using the same material because the same manufacturing apparatus can be used and the process can be simplified.

The above is the description of the components.

[Manufacturing Method Example]

Next, a manufacturing method example of a display device using a flexible substrate is described.

Here, layers each including a display element, a circuit, a wiring, an electrode, optical members such as a coloring layer and a light-blocking layer, an insulating layer, and the like, are collectively referred to as an element layer. The element layer includes, for example, a display element, and may additionally include a wiring electrically connected to the display element or an element such as a transistor used in a pixel or a circuit.

In addition, here, a flexible member which supports the element layer at a stage at which the display element is completed (the manufacturing process is finished) is referred to as a substrate. For example, a substrate includes an extremely thin film with a thickness greater than or equal to 10 nm and less than or equal to 300 μm and the like.

As a method for forming an element layer over a flexible substrate provided with an insulating surface, typically, there are two methods shown below. One of them is to directly form an element layer over the substrate. The other method is to form an element layer over a support substrate that is different from the substrate and then to separate the element layer from the support substrate to be transferred to the substrate. Although not described in detail here, in addition to the above two methods, there is a method in which the element layer is formed over a substrate which does not have flexibility and the substrate is thinned by polishing or the like to have flexibility.

In the case where a material' of the substrate can withstand heating temperature in a process for forming the element layer, it is preferable that the element layer be formed directly over the substrate, in which case a manufacturing process can be simplified. At this time, the element layer is preferably formed in a state where the substrate is fixed to a support substrate, in which case transfer thereof in an apparatus and between apparatuses can be easy.

In the case of employing the method in which the element layer is formed over the support substrate and then transferred to the substrate, first, a separation layer and an insulating layer are stacked over the support substrate, and then the element layer is formed over the insulating layer. Next, the element layer is separated from the support substrate and then transferred to the substrate. At this time, selected is a material with which separation at an interface between the support substrate and the separation layer, at an interface between the separation layer and the insulating layer, or in the separation layer occurs. With the method, it is preferable that a material having high heat resistance be used for the support substrate or the separation layer, in which case the upper limit of the temperature applied when the element layer is formed can be increased, and an element layer including a higher reliable element can be formed.

For example, it is preferable that a stack of a layer containing a high-melting-point metal material, such as tungsten, and a layer containing an oxide of the metal material be used as the separation layer, and a stack of a plurality of layers, such as a silicon oxide layer, a silicon nitride layer, a silicon oxynitride layer, and a silicon nitride oxide layer be used as the insulating layer over the separation layer. Note that in this specification, oxynitride contains more oxygen than nitrogen, and nitride oxide contains more nitrogen than oxygen.

As the method for separating the support substrate from the element layer, applying mechanical force, etching the separation layer, and making a liquid permeate the separation interface are given as examples. Alternatively, separation may be performed by heating or cooling the support substrate by utilizing a difference in thermal expansion coefficient of two layers which form the separation interface.

The separation layer is not necessarily provided in the case where the separation can be performed at an interface between the support substrate and the insulating layer.

For example, glass and an organic resin such as polyimide can be used as the support substrate and the insulating layer, respectively. In that case, a separation trigger may be formed by, for example, locally heating part of the organic resin with laser light or the like, or by physically cutting part of or making a hole through the organic resin with a sharp tool, so that separation may be performed at an interface between the glass and the organic resin.

Alternatively, a heat generation layer may be provided between the support substrate and the insulating layer formed of an organic resin, and separation may be performed at an interface between the heat generation layer and the insulating layer by heating the heat generation layer. As the heat generation layer, any of a variety of materials such as a material which generates heat by feeding current, a material which generates heat by absorbing light, and a material which generates heat by applying a magnetic field can be used. For example, for the heat generation layer, a material selected from a semiconductor, a metal, and an insulator can be used.

In the above-described methods, the insulating layer formed of an organic resin can be used as a substrate after the separation.

The above is the description of a manufacturing method of a flexible display device.

This embodiment can be combined with any of the other embodiments as appropriate.

Embodiment 4

In this embodiment, structure examples of an OS transistor that can be used for the display system or the like described in the above embodiment are described.

<Structure Example of Transistor>

Figure 22A:
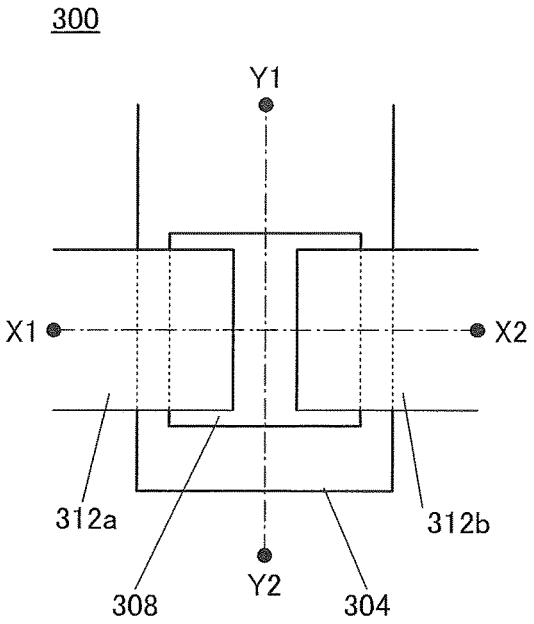
FIGS. 22A to 22D illustrate a structure example of a transistor.

FIG. 22A is a top view of a transistor 300. FIG. 22C is a cross-sectional view taken along line X1-X2 in FIG. 22A. FIG. 22D is a cross-sectional view taken along line Y1-Y2 in FIG. 22A. Note that in FIG. 22A, some components of the transistor 300 (e.g., an insulating film serving as a gate insulating film) are not illustrated to avoid complexity. In some cases, the direction of the line X1-X2 is referred to as a channel length direction and the direction of the line Y1-Y2 is referred to as a channel width direction. As in FIG. 22A, some components might not be illustrated in some top views of transistors described below.

The transistor 300 includes the conductive film 304 functioning as a gate electrode over the substrate 302, the insulating film 306 over the substrate 302 and the conductive film 304, the insulating film 307 over the insulating film 306, the oxide semiconductor film 308 over the insulating film 307, and the conductive films 312*a* and 312*b* functioning as source and drain electrodes connected to the oxide semiconductor film 308. Over the transistor 300, specifically, over the conductive films 312*a* and 312*b* and the oxide semiconductor film 308, the insulating films 314, 316, and 318 are provided. The insulating films 314, 316, and 318 function as protective insulating films for the transistor 300.

The oxide semiconductor film 308 includes a first oxide semiconductor film 308*a* on the conductive film 304 side and a second oxide semiconductor film 308*b* over the first oxide semiconductor film 308*a*. The conductive film 304 serves as a gate electrode. Furthermore, the insulating films 306 and 307 function as gate insulating films of the transistor 300.

An In-M oxide (M is Ti, Ga, Sn, Y, Zr, La, Ce, Nd, or Hf) or an In-M-Zn oxide can be used for the oxide semiconductor film 308. It is particularly preferable to use an In-M-Zn oxide for the oxide semiconductor film 308.

The first oxide semiconductor film 308*a* includes a first region in which the atomic proportion of In is larger than the atomic proportion of M. The second oxide semiconductor film 308*b* includes a second region in which the atomic proportion of In is smaller than that in the first oxide semiconductor film 308*a*. The second region includes a portion thinner than the first region.

The first oxide semiconductor film 308*a* including the first region in which the atomic proportion of In is larger than that of M can increase the field-effect mobility (also simply referred to as mobility or μFE) of the transistor 300. Specifically, the field-effect mobility of the transistor 300 can exceed 10 $cm^2/Vs$.

For example, the use of the transistor with high field-effect mobility for a gate driver that generates a gate signal (specifically, a demultiplexer connected to an output terminal of a shift register included in a gate driver) allows a semiconductor device or a display device to have a narrow frame.

On the other hand, the first oxide semiconductor film 308*a* including the first region in which the atomic proportion of In is larger than that of M makes it easier to change electrical characteristics of the transistor 300 in light irradiation in some cases. However, in the semiconductor device of one embodiment of the present invention, the second oxide semiconductor film 308*b* is formed over the first oxide semiconductor film 308*a*. In addition, the thickness of the channel region in the second oxide semiconductor film 308*b* is smaller than the thickness of the first oxide semiconductor film 308*a*.

Furthermore, the second oxide semiconductor film 308*b* includes the second region in which the atomic proportion of In is smaller than that in the first oxide semiconductor film 308*a* and thus has larger Eg than the first oxide semiconductor film 308*a*. For this reason, the oxide semiconductor film 308 that is a layered structure of the first oxide semiconductor film 308*a* and the second oxide semiconductor film 308*b* has high resistance to a negative bias stress test with light irradiation.

The amount of light absorbed by the oxide semiconductor film 308 with the above structure can be reduced during light irradiation. As a result, the change in electrical characteristics of the transistor 300 due to light irradiation can be reduced. In the semiconductor device of one embodiment of the present invention, the insulating film 314 or the insulating film 316 includes excess oxygen. This structure can further reduce the change in electrical characteristics of the transistor 300 due to light irradiation.

Here, the oxide semiconductor film 308 is described in detail with reference to FIG. 22B.

Figure 22B:
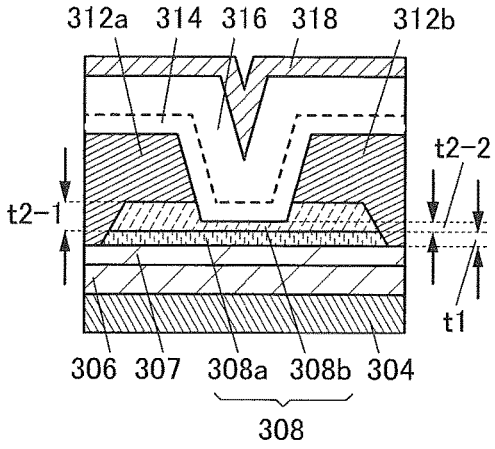
Figure 22C:
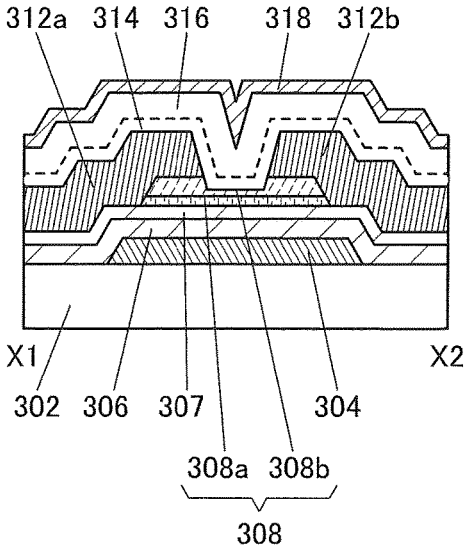
Figure 22D:
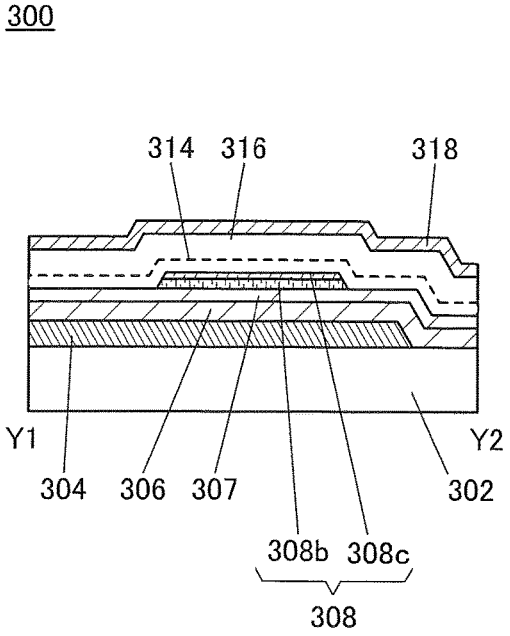

FIG. 22B is a cross-sectional enlarged view of the oxide semiconductor film 308 and the vicinity thereof in the transistor 300 illustrated in FIG. 22C.

In FIG. 22B, t1, t2-1, and t2-2 denote a thickness of the first oxide semiconductor film 308*a*, one thickness of the second oxide semiconductor film 308*b*, and the other thickness of the second oxide semiconductor film 308*b*, respectively. The second oxide semiconductor film 308*b* over the first oxide semiconductor film 308*a* prevents the first oxide semiconductor film 308*a* from being exposed to an etching gas, an etchant, or the like when the conductive films 312*a* and 312*b* are formed. This is why the first oxide semiconductor film 308*a* is not or is hardly reduced in thickness. In contrast, in the second oxide semiconductor film 308*b*, a portion not overlapping with the conductive films 312*a* and 312*b* is etched by formation of the conductive films 312*a* and 312*b*, so that a depression is formed in the etched region. In other words, a thickness of the second oxide semiconductor film 308*b* in a region overlapping with the conductive films 312*a* and 312*b* is t2-1, and a thickness of the second oxide semiconductor film 308*b* in a region not overlapping with the conductive films 312*a* and 312*b* is t2-2.

As for the relationships between the thicknesses of the first oxide semiconductor film 308*a* and the second oxide semiconductor film 308*b*, t2-1>t1>t2-2 is preferable. A transistor with the thickness relationships can have high field-effect mobility and less variation in threshold voltage in light irradiation.

When oxygen vacancy is formed in the oxide semiconductor film 308 included in the transistor 300, electrons serving as carriers are generated; as a result, the transistor 300 tends to be normally-on. Therefore, for stable transistor characteristics, it is important to reduce oxygen vacancy in the oxide semiconductor film 308, particularly oxygen vacancy in the first oxide semiconductor film 308*a*. In the structure of the transistor of one embodiment of the present invention, excess oxygen is introduced into an insulating film over the oxide semiconductor film 308, here, the insulating film 314 and/or the insulating film 316 over the oxide semiconductor film 308, whereby oxygen is moved from the insulating film 314 and/or the insulating film 316 to the oxide semiconductor film 308 to fill oxygen vacancy in the oxide semiconductor film 308, particularly in the first oxide semiconductor film 308*a*.

Note that it is preferable that the insulating films 314 and 316 each include a region (oxygen excess region) including oxygen in excess of that in the stoichiometric composition. In other words, the insulating films 314 and 316 are insulating films capable of releasing oxygen. Note that the oxygen excess region is formed in the insulating films 314 and 316 in such a manner that oxygen is introduced into the insulating films 314 and 316 after the deposition, for example. As a method for introducing oxygen, an ion implantation method, an ion doping method, a plasma immersion ion implantation method, plasma treatment, or the like may be employed.

In order to fill oxygen vacancy in the first oxide semiconductor film 308*a*, the thickness of the portion including the channel region and the vicinity of the channel region in the second oxide semiconductor film 308*b* is preferably small, and t2-2<t1 is preferably satisfied. For example, the thickness of the portion including the channel region and the vicinity of the channel region in the second oxide semiconductor film 308*b* is preferably more than or equal to 1 nm and less than or equal to 20 nm, further preferably more than or equal to 3 non and less than or equal to 10 nm.

<Modification Example of Transistor>

Figure 23A:
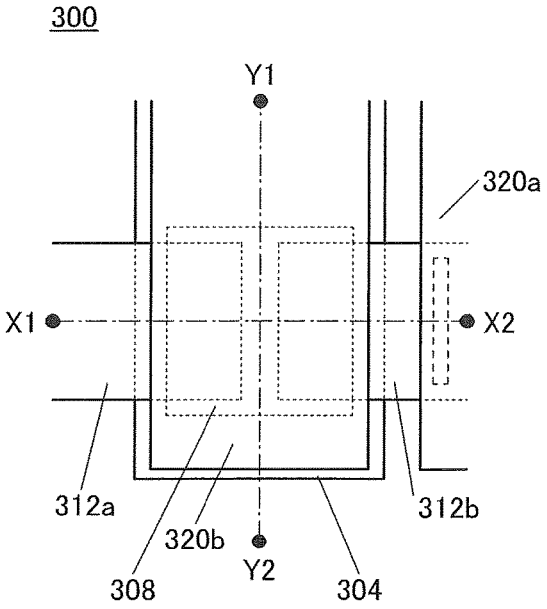
FIGS. 23A to 23C illustrate a structure example of a transistor.
Figure 23B:
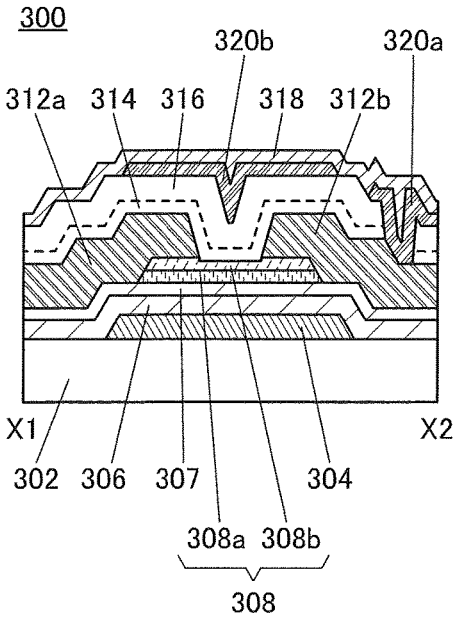
Figure 23C:
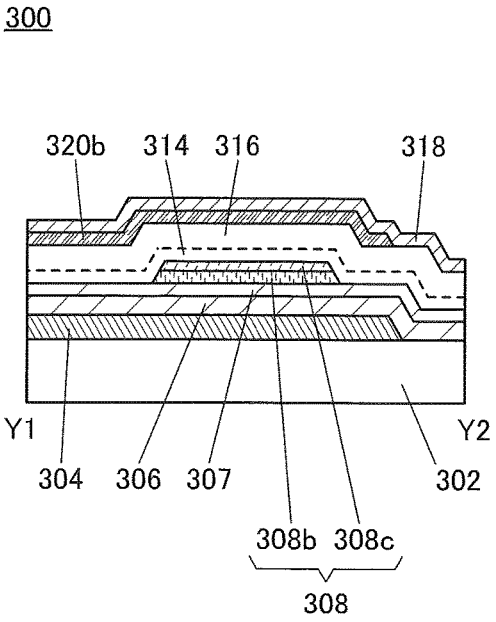

FIGS. 23A to 23C illustrate a modification example of the transistor 300. FIG. 23A is a top view of the transistor 300. FIG. 23B is a cross-sectional view taken along line X1-X2 in FIG. 23A. FIG. 23C is a cross-sectional view taken along line Y1-Y2 in FIG. 23A.

The transistor 300 includes the conductive film 304 over the substrate 302, which serves as a first gate electrode; the insulating film 306 over the substrate 302 and the conductive film 304; the insulating film 307 over the insulating film 306; the oxide semiconductor film 308 over the insulating film 307; the conductive film 312*a* which is electrically connected to the oxide semiconductor film 308 and serves as a source electrode; the conductive film 312*b* which is electrically connected to the oxide semiconductor film 308 and serves as a drain electrode; the insulating films 314 and 316 over the oxide semiconductor film 308 and the conductive films 312*a* and 312*b*; a conductive film 320*a* which is provided over the insulating film 316 and electrically connected to the conductive film 312*b*; a conductive film 320*b* over the insulating film 316; and the insulating film 318 over the insulating film 316 and the conductive films 320*a* and 320*b*.

The conductive film 320*b* can be used for a second gate electrode of the transistor 300. In the case where the transistor 300 is used in the display portion of the input/output device, the conductive film 320*a* can be used as an electrode of a display element, or the like.

The conductive film 320*a* serving as a conductive film and the conductive film 320*b* serving as the second gate electrode each include a metal element included in the oxide semiconductor film 308. For example, the conductive film 320*b* serving as the second gate electrode and the oxide semiconductor film 308 contain the same metal element; thus, the manufacturing cost can be reduced.

For example, in the case where the conductive film 320*a* serving as a conductive film and the conductive film 320*b* serving as a second gate electrode are each In-M-Zn oxide, the atomic ratio of metal elements in a sputtering target used for forming the In-M-Zn oxide preferably satisfies In≥M. The atomic ratio between metal elements in such a sputtering target is, for example, In:M:Zn=2:1:3, In:M:Zn=3:1:2, or In:M:Zn=4:2:4.1.

The conductive film 320*a* serving as a conductive film and the conductive film 320*b* serving as a second gate electrode can each have a single-layer structure or a stacked-layer structure of two or more layers. Note that in the case where the conductive film 320*a* and the conductive film 320*b* each have a stacked-layer structure, the composition of the sputtering target is not limited to that described above.

In a step of forming the conductive films 320*a* and 320*b*, the conductive films 320*a* and 320*b* serve as a protective film for suppressing release of oxygen from the insulating films 314 and 316. The conductive films 320*a* and 320*b* serve as semiconductors before a step of forming the insulating film 318 and serve as conductors after the step of forming the insulating film 318.

Oxygen vacancies are formed in the conductive films 320*a* and 320*b*, and hydrogen is added from the insulating film 318 to the oxygen vacancies, whereby donor states are formed in the vicinity of the conduction band. As a result, the conductivity of each of the conductive films 320*a* and 320*b* is increased, so that the conductive films 320*a* and 320*b* become conductors. The conductive films 320*a* and 320*b* having become conductors can each be referred to as an oxide conductor. Oxide semiconductors generally transmit visible light because of their large energy gap. An oxide conductor is an oxide semiconductor having a donor level in the vicinity of the conduction band. Therefore, the influence of absorption due to the donor level is small in an oxide conductor, and an oxide conductor has a visible light transmitting property comparable to that of an oxide semiconductor.

This embodiment can be combined with any of the other embodiments as appropriate.

Embodiment 5

In this embodiment, a structure example of a display module using any of the display devices described in the above embodiments is described.

Figure 24:
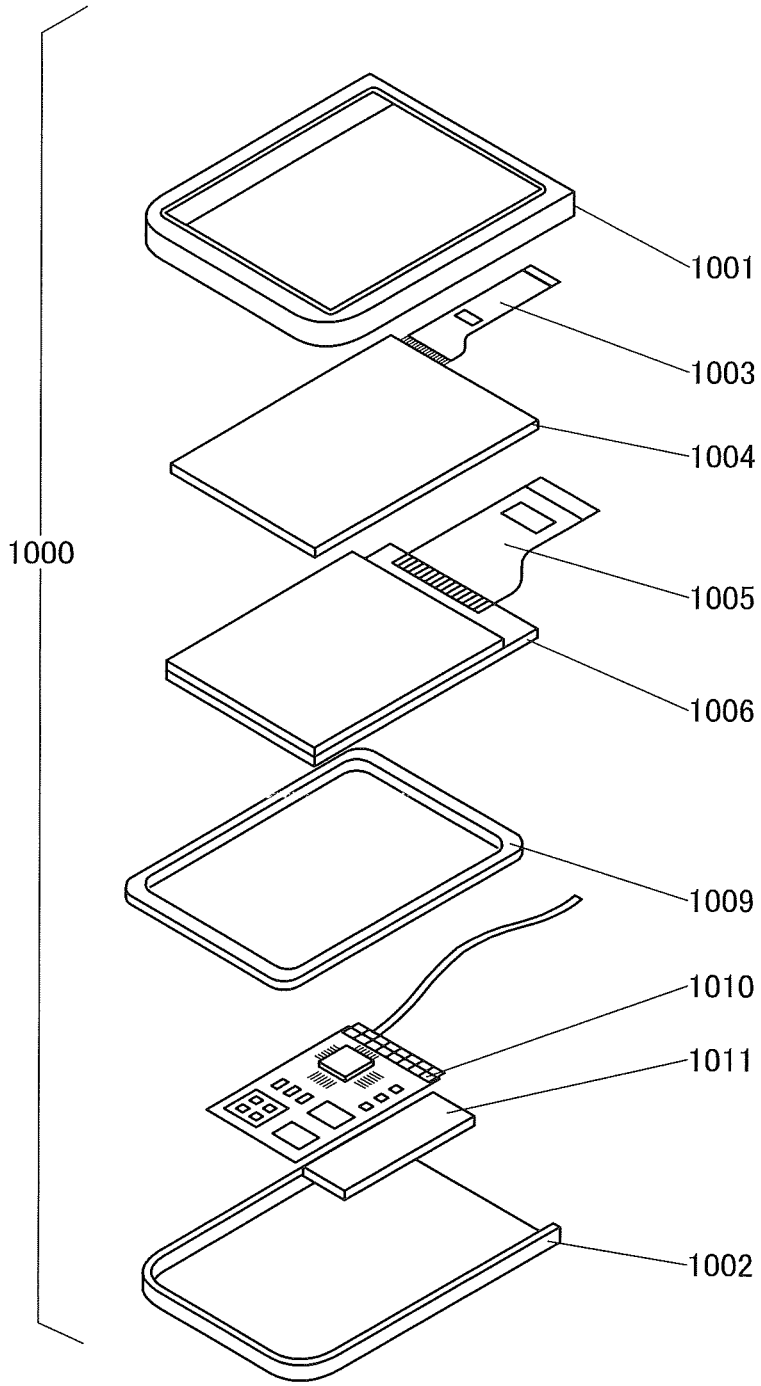
FIG. 24 illustrates a structural example of a display module.

In a display module 1000 in FIG. 24, a touch panel 1004 connected to an FPC 1003, a display device 1006 connected to an FPC 1005, a frame 1009, a printed circuit board 1010, and a battery 1011 are provided between an upper cover 1001 and a lower cover 1002.

A display device manufactured by using one embodiment of the present invention can be used as the display device 1006.

The shapes and sizes of the upper cover 1001 and the lower cover 1002 can be changed as appropriate in accordance with the sizes of the touch panel 1004 and the display device 1006.

The touch panel 1004 can be a resistive touch panel or a capacitive touch panel and may be formed to overlap with the display device 1006. Instead of providing the touch panel 1004, the display device 1006 can have a touch panel function.

The frame 1009 protects the display device 1006 and also functions as an electromagnetic shield for blocking electromagnetic waves generated by the operation of the printed circuit board 1010. The frame 1009 may function as a radiator plate.

The printed circuit board 1010 is provided with a power supply circuit and a signal processing circuit for outputting a video signal and a clock signal. As a power source for supplying power to the power supply circuit, an external commercial power source or a power source using the battery 1011 provided separately may be used. The battery 1011 can be omitted in the case of using a commercial power source.

The display module 1000 may be additionally provided with a member such as a polarizing plate, a retardation plate, or a prism sheet.

This embodiment can be combined with any of the other embodiments as appropriate.

Embodiment 6

In this embodiment, electronic devices for which the display device of one embodiment of the present invention can be used and a communication system using any of the electronic devices are described.

<Example of Electronic Device>

The display device of one embodiment of the present invention can achieve high visibility regardless of the intensity of external light. Therefore, the display device of one embodiment of the present invention can be favorably used in portable electronic devices, wearable electronic devices (wearable devices), e-book readers, and the like.

Figure 25A:
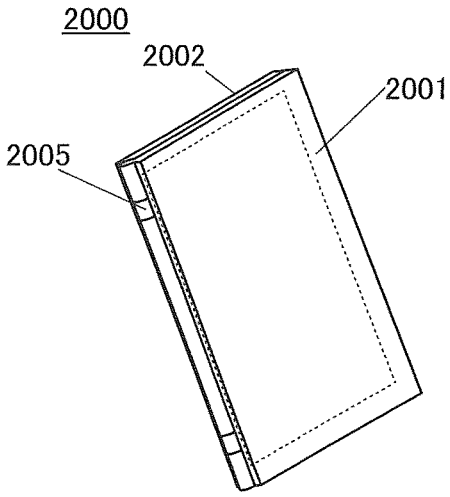
FIGS. 25A to 25D illustrate structure examples of electronic devices.
Figure 25B:
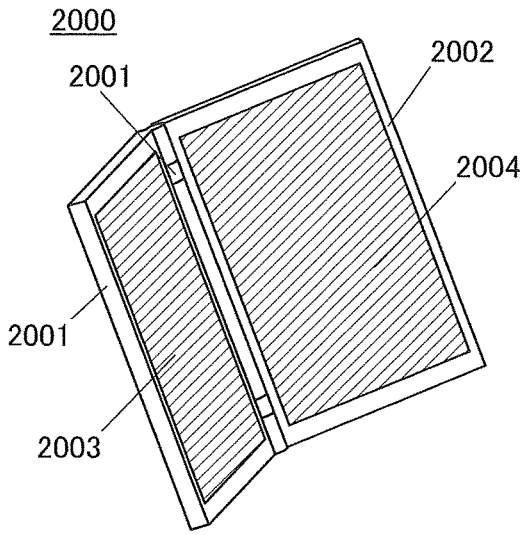

FIGS. 25A and 25B illustrate an example of a portable information terminal 2000. The portable information terminal 2000 includes a housing 2001, a housing 2002, a display portion 2003, a display portion 2004, a hinge portion 2005, and the like.

The housing 2001 and the housing 2002 are connected with the hinge portion 2005. The portable information terminal 2000 folded as in FIG. 25A can be changed into the state illustrated in FIG. 25B, in which the housing 2001 and the housing 2002 are opened.

For example, the portable information terminal 2000 can also be used as an e-book reader, in which the display portion 2003 and the display portion 2004 each can display text data. In addition, the display portion 2003 and the display portion 2004 each can display a still image or a moving image. Furthermore, the display portion 2003 may be provided with a touch panel.

In this manner, the portable information terminal 2000 has high versatility because it can be folded when carried.

Note that the housing 2001 and the housing 2002 may include a power switch, an operation button, an external connection port, a speaker, a microphone, and/or the like.

Note that the portable information terminal 2000 may have a function of identifying a character, a figure, or an image using a touch sensor provided for the display portion 2003. In this case, learning in the following mode becomes possible: an answer is written with a finger, a stylus pen, or the like on an information terminal that displays a workbook or the like for studying mathematics or for learning language, and then the portable information terminal 2000 determines whether the answer is correct or not. The portable information terminal 2000 may have a function of performing speech interpretation. In this case, for example, the portable information terminal 2000 can be used in learning a foreign language. Such a portable information terminal is suitable for use as a teaching material such as a textbook, a notebook, or the like.

Figure 25C:
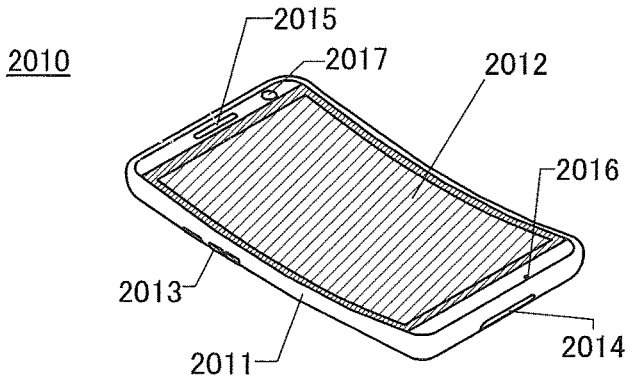

FIG. 25C illustrates an example of a portable information terminal. A portable information terminal 2010 illustrated in FIG. 25C includes a housing 2011, a display portion 2012, an operation button 2013, an external connection port 2014, a speaker 2015, a microphone 2016, a camera 2017, and the like.

The portable information terminal 2010 includes a touch sensor in the display portion 2012. Operations such as making a call and inputting a letter can be performed by touch on the display portion 2012 with a finger, a stylus, or the like.

With the operation buttons 2013, power on or off can be switched. In addition, types of images displayed on the display portion 2012 can be switched; for example, switching images from a mail creation screen to a main menu screen is performed with the operation button 2013.

When a detection device such as a gyroscope sensor or an acceleration sensor is provided inside the portable information terminal 2010, the direction of display on the screen of the display portion 2012 can be automatically changed by determining the orientation of the portable information terminal 2010 (whether the portable information terminal 2010 is placed horizontally or vertically). Furthermore, the direction of display on the screen can be changed by touch on the display portion 2012, operation with the operation button 2013, sound input using the microphone 2016, or the like.

The portable information terminal 2010 functions as, for example, one or more of a telephone set, a notebook, and an information browsing system. For example, the portable information terminal 2010 can be used as a smartphone. The portable information terminal 2010 is capable of executing a variety of applications such as mobile phone calls, e-mailing, viewing and editing texts, music reproduction, reproducing a moving image, Internet communication, and computer games, for example.

Figure 25D:
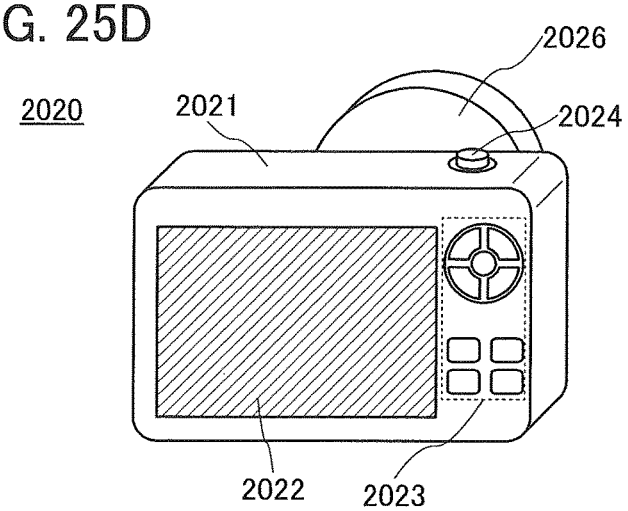

FIG. 25D illustrates an example of a camera. A camera 2020 includes a housing 2021, a display portion 2022, operation buttons 2023, a shutter button 2024, and the like. Furthermore, an detachable lens 2026 is attached to the camera 2020.

Although the lens 2026 of the camera 2020 here is detachable from the housing 2021 for replacement, the lens 2026 may be included in the housing.

Still and moving images can be taken with the camera 2020 at the press of the shutter button 2024. In addition, images can be taken at the touch of the display portion 2022 which serves as a touch panel.

Note that a stroboscope, a viewfinder, and the like can be additionally attached to the camera 2020. Alternatively, these may be included in the housing 2021.

The decoder 30 described in the above embodiment can be provided in any of the above electronic devices. The display portion 20, the display device 200, or the display device 400 described in the above embodiment can be provided in the display portion of any of the above electronic devices. Thus, the display system of one embodiment of the present invention can be mounted on any of the electronic devices.

Note that the decoder 30 may be provided outside any of the electronic devices. In this case, a plurality of video signals generated by the decoder 30 are input to the electronic device.

<Example of Communication System>

Figure 26A:
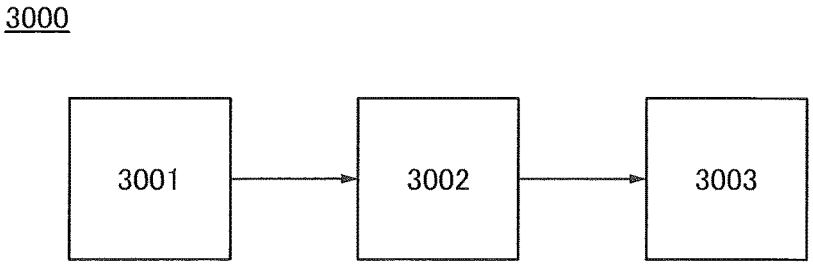
FIGS. 26A to 26C illustrate structure examples of communication systems.

Next, structure examples of a communication system using any of the above electronic devices is described. A communication system 3000 illustrated in FIG. 26A includes a transmitting portion 3001, a receiving portion 3002, and a display portion 3003.

The transmitting portion 3001 has a function of transmitting data corresponding to a video to be displayed on the display portion 3003. As the data transmitted from the transmitting portion 3001, the data BD or the like described in the above embodiment can be used. Note that transmission of data may be performed with or without wire.

The receiving portion 3002 has a function of receiving data transmitted from the transmitting portion 3001, dividing the data, and generating a plurality of video signals. The receiving portion 3002 can be formed using the decoder 30 or the like described in the above embodiment, for example. A video signal generated in the receiving portion 3002 is transmitted to the display portion 3003. Note that transmission of a video signal may be performed with or without wire.

The display portion 3003 has a function of displaying a video in accordance with a video signal input from the receiving portion 3002. The display portion 3003 can be formed using the display portion 20 or the like described in the above embodiment, for example.

Figure 26B:
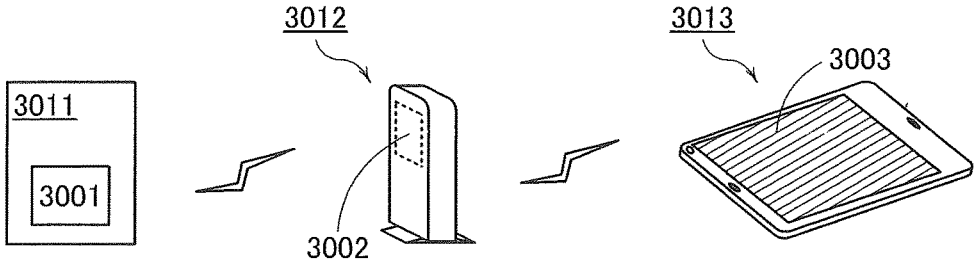

Next, specific structure examples of the communication system are described. FIG. 26B illustrates a structure of a communication system 3010.

The communication system 3010 includes a transmitter 3011 including the transmitting portion 3001, a receiver 3012 including the receiving portion 3002, and a portable information terminal 3013 including the display portion 3003. Note that each of the electronic devices illustrated in FIGS. 25A to 25D can be used instead of the portable information terminal 3013.

Data transmitted from the transmitter 3011 to the receiver 3012 by a wireless signal is divided into a plurality of data and converted into a plurality of video signals by the receiver 3012. The video signals generated in the receiver 3012 are transmitted to the portable information terminal 3013 by a wireless signal. Thus, the portable information terminal 3013 displays a predetermined video.

In the case where the portable information terminal 3013 is used as a teaching material, a notebook, or the like, for example, a video signal can be transmitted at the same time from the receiver 3012 to the portable information terminal 3013 possessed by people in a certain range from the receiver 3012 (for example, in the same room). Thus, a material used in a lecture, or the like can be transmitted to an audience at the same time.

Figure 26C:
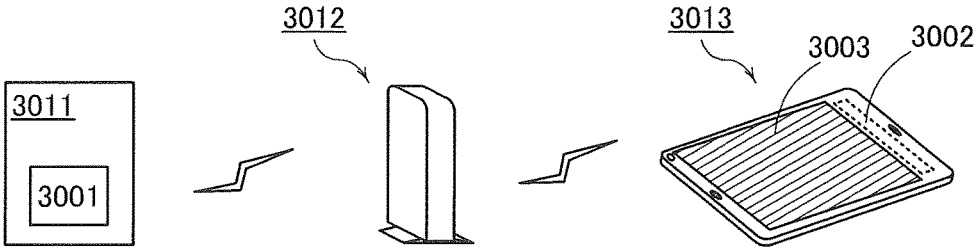

Note that as illustrated in FIG. 26C, the receiving portion 3002 may be incorporated in the portable information terminal 3013. In this case, a video signal is generated in the portable information terminal 3013. In the case where the receiving portion 3002 is incorporated in the portable information terminal 3013, data transmitted from the transmitter 3011 can be directly input to the portable information terminal 3013 without via the receiver 3012. The portable information terminal 3013 has a function of displaying a predetermined video in accordance with the data input from the transmitter 3011 or the receiver 3012 by a wireless signal.

This embodiment can be combined with any of the other embodiments as appropriate.

This application is based on Japanese Patent Application Serial No. 2016-101129 filed with Japan Patent Office on May 20, 2016, the entire contents of which are hereby incorporated by reference.

What is claimed is:

1. A circuit comprising:

a first circuit;

a second circuit;

a third circuit;

a fourth circuit; and a fifth circuit, wherein the first circuit is configured to output a first signal corresponding to input data, wherein the second circuit is configured to generate a first video signal in accordance with the data and the first signal, wherein the third circuit is configured to generate a second video signal in accordance with the data and the first signal, wherein the fourth circuit is configured to output the first video signal in the case where the first video signal and a third video signal output from the fourth circuit immediately before input of the first video signal to the fourth circuit do not match, wherein the fourth circuit is configured to output a second signal corresponding to a result of comparison between the first video signal and the third video signal, wherein the fifth circuit is configured to output the second video signal in the case where the second video signal and a fourth video signal output from the fifth circuit immediately before input of the second video signal to the fifth circuit do not match, wherein the fifth circuit is configured to output a third signal corresponding to a result of comparison between the second video signal and the fourth video signal, and wherein the first video signal and the second video signal are different kinds of video signals.

2. The circuit according to claim 1, wherein the first video signal is a video signal for displaying a character, and wherein the second video signal is a video signal for displaying a video other than a character.

3. A display system comprising:

the circuit according to claim 1; and a display portion, wherein the display portion includes a first pixel group, a second pixel group, a first driver circuit, and a second driver circuit, wherein the first video signal is input to the first pixel group via the first driver circuit, and wherein the second video signal is input to the second pixel group via the second driver circuit.

4. The display system according to claim 3, wherein the display system is configured to individually control the first driver circuit and the second driver circuit.

5. The display system according to claim 3, wherein the display portion further includes a sixth circuit and a seventh circuit, wherein the sixth circuit is configured to control power supply to the first driver circuit in accordance with the second signal, and wherein the seventh circuit is configured to control power supply to the second driver circuit in accordance with the third signal.

6. The display system according to claim 3, wherein the first pixel group includes a first pixel, wherein the second pixel group includes a second pixel, wherein the first pixel includes a reflective liquid crystal element, and wherein the second pixel includes a light-emitting element.

7. The display system according to claim 6, wherein the first pixel and the second pixel each include a transistor, and wherein the transistor includes an oxide semiconductor in a channel formation region.

8. A display module comprising:

the display system according to claim 3; and at least one of an FPC and an IC.

9. An electronic device comprising:

the circuit according to claim 1, wherein the electronic device is configured to display a predetermined video in accordance with the data input with a wireless signal.

10. A circuit comprising:

a first circuit;

a second circuit;

a third circuit;

a fourth circuit; and a fifth circuit, wherein the first circuit is configured to output a first signal corresponding to input data, wherein the second circuit is configured to generate a first video signal in accordance with the data and the first signal, wherein the third circuit is configured to generate a second video signal in accordance with the data and the first signal, wherein the fourth circuit is configured to output a second signal corresponding to a result of comparison between the first video signal and a third video signal input to the fourth circuit before input of the first video signal to the fourth circuit, wherein the fifth circuit is configured to output a third signal corresponding to a result of comparison between the second video signal and a fourth video signal input to the fifth circuit before input of the second video signal to the fifth circuit, and wherein the first video signal and the second video signal are different kinds of video signals.

11. The circuit according to claim 10, wherein the first video signal is a video signal for displaying a character, and wherein the second video signal is a video signal for displaying a video other than a character.

12. A display system comprising:

the circuit according to claim 10; and a display portion, wherein the display portion includes a first pixel group, a second pixel group, a first driver circuit, and a second driver circuit, wherein the first video signal is input to the first pixel group via the first driver circuit, and wherein the second video signal is input to the second pixel group via the second driver circuit.

13. The display system according to claim 12, wherein the display system is configured to individually control the first driver circuit and the second driver circuit.

14. The display system according to claim 12, wherein the display portion further includes a sixth circuit and a seventh circuit, wherein the sixth circuit is configured to control power supply to the first driver circuit in accordance with the second signal, and wherein the seventh circuit is configured to control power supply to the second driver circuit in accordance with the third signal.

15. The display system according to claim 12, wherein the first pixel group includes a first pixel, wherein the second pixel group includes a second pixel, wherein the first pixel includes a reflective liquid crystal element, and wherein the second pixel includes a light-emitting element.

16. The display system according to claim 15, wherein the first pixel and the second pixel each include a transistor, and wherein the transistor includes an oxide semiconductor in a channel formation region.

17. A display module comprising:

the display system according to claim 12; and at least one of an FPC and an IC.

18. An electronic device comprising:

the circuit according to claim 10, wherein the electronic device is configured to display a predetermined video in accordance with the data input with a wireless signal.

* * * * *